US009980564B2

(12) United States Patent
Roberts et al.

(10) Patent No.: US 9,980,564 B2
(45) **Date of Patent: *May 29, 2018**

(54) SYSTEM AND METHOD FOR ASSEMBLING AND USING ASSISTED STORAGE

(71) Applicants: Jonathan Roberts, Frisco, TX (US); Clark Davis, Genola, UT (US); Ian Davis, Genola, UT (US); Brian D. Owens, Plano, TX (US)

(72) Inventors: Jonathan Roberts, Frisco, TX (US); Clark Davis, Genola, UT (US); Ian Davis, Genola, UT (US); Brian D. Owens, Plano, TX (US)

(73) Assignee: Jonathan Roberts, Frisco, TX (US)

( * ) Notice: Subject to any disclaimer, the term of this patent is extended or adjusted under 35 U.S.C. 154(b) by 24 days.

This patent is subject to a terminal disclaimer.

(21) Appl. No.: 13/833,578

(22) Filed: Mar. 15, 2013

(65) Prior Publication Data

US 2014/0263122 A1 Sep. 18, 2014

(51) Int. Cl.
*A47B 46/00* (2006.01)
*A47B 51/00* (2006.01)

(52) U.S. Cl.
CPC ..... *A47B 46/005* (2013.01); *A47B 51/00* (2013.01); *Y10T 29/49826* (2015.01)

(58) Field of Classification Search
CPC ..... E05Y 2201/416; E05Y 2400/44; E05Y 2600/11; E05Y 2900/502; E05Y 2900/538; B64D 11/003; E05D 15/46; E05F 1/1091; Y02T 50/46; A47B 96/067
USPC ..... 248/566, 571, 572, 560, 573, 636, 610, 248/585–588; 188/284, 285, 312, 321.11, 188/322.22, 282.9; 267/175, 34; 312/248, 247, 325, 319.2, 319.3; 52/29, 52/64; 74/469
See application file for complete search history.

(56) References Cited

U.S. PATENT DOCUMENTS

| | | | | | |
|---|---|---|---|---|---|
| 4,076,351 | A * | 2/1978 | Wyant | 312/247 |
| 4,768,762 | A * | 9/1988 | Lund | 267/172 |
| 4,813,064 | A * | 3/1989 | Jackson et al. | 378/197 |
| 4,883,249 | A * | 11/1989 | Garland | 248/566 |
| 4,915,461 | A * | 4/1990 | Kingsborough et al. | 312/247 |
| 5,058,846 | A * | 10/1991 | Close | 248/284.1 |
| 5,076,649 | A * | 12/1991 | Therkelsen | 312/246 |
| 5,224,677 | A * | 7/1993 | Close | 248/292.11 |

(Continued)

FOREIGN PATENT DOCUMENTS

| | | | | |
|---|---|---|---|---|
| DE | 4130644 A1 * | 3/1993 | | B64D 11/00 |
| DE | 4335151 A1 * | 4/1995 | | B64D 11/00 |

(Continued)

*Primary Examiner* — Andrew M Roersma
(74) *Attorney, Agent, or Firm* — Goodhue, Coleman & Owens, P.C.

(57) ABSTRACT

A storage system and associated method of assembling the storage system. The storage system includes one or more rails for attaching the storage system to a structure. The storage system further includes one or more arms attached to the one or more rails. The storage system further includes a counterbalance mechanism attached to the one or more arms configured to provide a force to assist lifting or lowering a load applied to the one or more lift arms. The storage system further includes a release for engaging the counterbalance mechanism to assist a user in raising or lowering the one or more lift arms.

18 Claims, 49 Drawing Sheets

(56) References Cited

U.S. PATENT DOCUMENTS

| | | | | |
|---|---|---|---|---|
| 5,228,763 | A * | 7/1993 | Gingold | 312/266 |
| 5,249,858 | A * | 10/1993 | Nusser | 312/319.6 |
| 5,857,756 | A * | 1/1999 | Fehre | 312/246 |
| 6,243,988 | B1 * | 6/2001 | Salice | 49/445 |
| 6,471,311 | B1 * | 10/2002 | Snyder | 312/247 |
| 7,118,068 | B2 * | 10/2006 | Graf et al. | 244/118.5 |
| 7,143,977 | B2 * | 12/2006 | Graf et al. | 244/118.1 |
| 7,428,855 | B2 * | 9/2008 | Duval | 74/516 |
| 7,481,397 | B2 * | 1/2009 | Steinbeck et al. | 244/118.5 |
| 8,061,789 | B2 * | 11/2011 | Krueger | 312/248 |
| 2002/0002799 | A1 * | 1/2002 | Terpstra et al. | 52/36.1 |
| 2007/0236114 | A1 * | 10/2007 | Fuentes | 312/246 |
| 2011/0266937 | A1 * | 11/2011 | Roberts et al. | 312/319.1 |
| 2014/0260735 | A1 * | 9/2014 | Roberts et al. | 74/98 |

FOREIGN PATENT DOCUMENTS

| | | | | |
|---|---|---|---|---|
| DE | 4446772 | C1 * | 5/1996 | B64D 11/00 |
| DE | 19617657 | A1 * | 11/1997 | B64D 11/00 |

* cited by examiner

FIG. 40

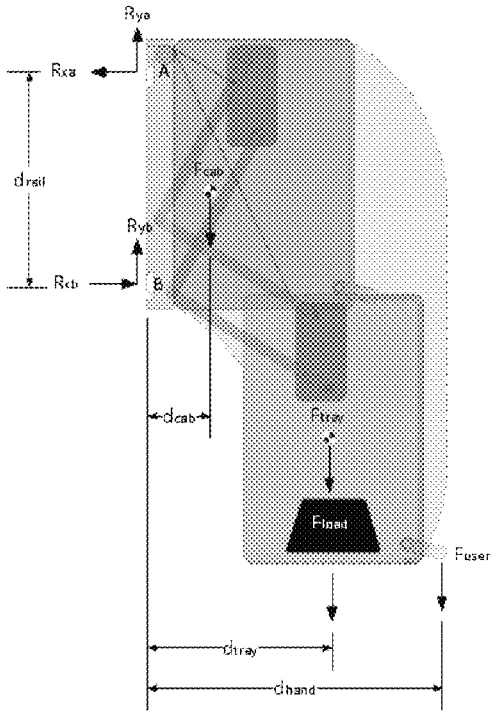

Forces in X

Rxb – Rxa = 0

Rxa = Rxb

Forces in X

Rya = Ryb (assume equal loading)

Rya + Ryb - Fcab - Ftray - Fload - Fuser = 0

Rya = Ryb = (Fcab + Ftray + Fload + Fuser)/2

Moments at B

Rxa*drail – Fcab*dcab – Ftray*dtray – Fload*dtray – Fuser*dhand = 0

Rxa = (Fcab*dcab + Ftray*dtray + Fload*dtray + Fuser*dhand)/drail

| Illustrated | | Test Case | |
|---|---|---|---|
| Fcab | 30 | Fcab | |
| Ftray | 30 | Ftray | |
| Fload | 150 | Fload | 300 |
| Fuser | 150 | Fuser | |
| dcab | 8 | dcab | |
| dtray | 27 | dtray | 24 |
| dhand | 39 | dhand | |
| drail | 36 | drail | 18 |
| | | | |
| Rxa | 304 | Rxa | 400 |
| Rxb | 304 | Rxb | 400 |
| Rya | 180 | Rya | 150 |
| Ryb | 180 | Ryb | 150 |

SYSTEM AND METHOD FOR ASSEMBLING AND USING ASSISTED STORAGE

RELATED APPLICATION DATA

This patent application is a continuation-in-part of U.S. Utility application Ser. No. 13/098,155 filed Apr. 29, 2011 entitled System and Method for an Automatically Adjusting Force Engine and Assisted Storage which claims priority from U.S. provisional application 61/330,797 filed May 3, 2010 and U.S. provisional application 61/473,623 filed Apr. 8, 2011 all of which are hereby incorporated by reference in their entireties. The patent application also claims priority to U.S. provisional application 61/660,646 entitled System and Method for Manufacturing and Using Assisted Storage filed Jun. 15, 2012 which is hereby incorporated by reference in its entirety.

BACKGROUND OF THE INVENTION

Counterbalance systems may provide a method for compensating for a load. Existing counterbalance engine and systems may be constrained by their respective designs to small loads, limited motion, complex load adjustments, unorthodox travel patterns and positions, or may have other functional issues. In many cases, counterbalancing systems are not easily utilized or integrated with devices, systems, furniture, or other elements because of their weight, size, shape, center of gravity, contour, frame or load bearing structure, and complexity.

For example, counterbalance systems have not been effectively utilized in storage systems. In particular, many simple and complex forms of vertical storage, including overhead storage, are inconvenient or difficult to access. For example, many individuals, such as children, elderly individuals, disabled parties, and those that are vertically challenged may have some difficulty accessing cabinets, shelves, or other storage elements within a home, commercial facility, or other structure. An individual's capacity to exert a sufficient operational force, even upon accessing a cabinet, shelf or other storage element, may be limited based on age, physical impairments or other mobility/agility challenges. For example, exerting force when ones arms are in an awkward position, above the shoulders or below the waste or knees may be limited or even prohibitive based upon a human condition or limitation. Likewise, bending over to access stored goods may be equally difficult for other individuals. As a result, it may be difficult to utilize vertical storage space effectively while still providing users full and uninhibited access to the stored goods.

In many cases, the cited prior art has undesirable limitations. In particular, existing systems have been limited to very specific solutions and are not equipped with a function and/or optimized for performing automatic balancing for a load. Existing systems without automatic adjustments and optimized transformations of a balancing force are shown in U.S. Pat. No. 7,798,035 to Duval and U.S. patent application Ser. No. 12/052,155 to Van Dorsser. In many cases, the existing systems are also not adaptable to different applications, structures, hardware, environments, and user needs. For example, in some situations or circumstances a single type of energy storage device, such as a coil spring may be utilized or required and a path of a carriage may be limited reducing adaptability. A system that may require an extremely strong spring and supporting linkages with a limited force generation capacity and displacement is shown in U.S. Pat. No. 2,910,335 to Wales. Another existing system may require a zero free length spring, significant load displacement, and changes to the energy state of the spring to adjust to a load as is described in U.S. Pat. No. 4,387,876 to Nathan. Other aircraft specific solutions may tilt the load during displacement, provide limited displacement paths, and utilize force engine and linkage configurations that may be complex or cumbersome, such as U.S. Pat. No. 5,244,269 to Harriehausen and U.S. Pat. No. 7,481,397 to Steinbeck.

Illustrative embodiments of the present invention provide a force engine and counterbalancing system that automatically adapts to changing loads while optimizing and enhancing the magnitude, path, orientation, and displacement of the load and the systems and methods for driving the load. In addition, the systems, methods, and components described in the illustrative embodiments may be interchangeable and customized for numerous applications and required functionality thereby providing flexibility in configuring and transferring forces to meet needs of the user.

The additional use of kinematic transformations at multiple positions within the force engine and storage system and positioning of the force engine and lift arms improves the flexibility in designing systems that achieve desirable results.

SUMMARY OF THE INVENTION

One embodiment provides a storage system and method of assembly. The storage system may include one or more rails for attaching the storage system to a structure. The storage system may further include one or more lift arms attached to the one or more rails and configured to raise and lower a tray. The storage system may further include an assistance mechanism attached to the one or more lift arms configured to provide force to lift or lower the tray. The storage system may further include a release for engaging the assistance mechanism to assist a user in raising or lowering the tray.

Another embodiment provides a method for assembling a storage system. Rails are attached to a wall. Lift arms are secured to the rails. An assistance mechanism is attached to the rails and dynamically attached to the lift arms. A tray is attached to the lift arms. A release is attached to the assistance mechanism.

BRIEF DESCRIPTION OF THE DRAWINGS

Illustrative embodiments of the present invention are described in detail below with reference to the attached drawing figures, which are incorporated by reference herein and wherein:

FIG. 40 is a pictorial representation of forces acting on the auto-balancing system in accordance with an illustrative embodiment;

DETAILED DESCRIPTION OF THE DRAWINGS

Figure 1:
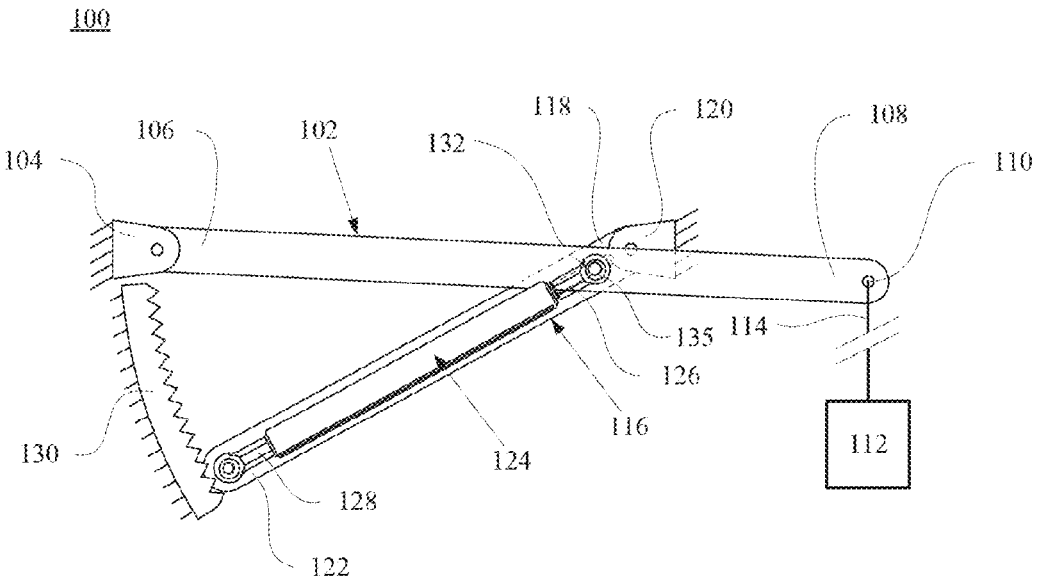
FIGS. 1-16 are pictorial representations of force engines in accordance with illustrative embodiments.

Illustrative embodiments provide an automatic adjusting force engine and a system and method for utilizing and incorporating the force engine. The force engine is an energy storage and generating system that provides a balancing force. The force engine may be utilized in any number of applications, and systems a few of which are described herein. In one embodiment, the force engine provides a counterbalancing force to a load. The counterbalancing force may be applied directly or indirectly. The force engine provides the force so the weight of the load may be moved with minimal user input or effort, in other words the force engine provides a balancing force acting against a load which provides an assistive-force to user's operational input or effort.

In various embodiments, the force engine may automatically adjust to the load with minimal user input. In other embodiments, the force engine may adjust based on a user initiating the adjustment or in response to the user performing the adjustment. Automatic adjustment may include configuring, reconfiguring, or otherwise adjusting the operating relationship and positioning of the energy reservoir, members, linkages, arms, and other components of the force engine to provide the balancing force.

The illustrative embodiments also provide an automatic counterbalancing system (or auto-balancing system). The automatic counterbalancing system may be utilized for assisted storage systems. In the automatic counterbalancing system, the load may include a force or weight of goods applied to the auto-balancing system. Goods or stored goods are defined to include household or business items, machinery, sporting and recreational equipment, or any other products, articles or goods that a user may need to store or secure. For example, the assisted storage systems may utilize a force engine to drive motion of a cabinet, shelf, tool, or other carriage through a displacement path. The displacement path may be an out-and-down, down-and-out, direct drop, inclined drop, or other arcuate or curved path as described herein.

The automatic counterbalancing system may be particularly useful in storage applications, such as in garages, kitchens, closets, commercial offices, retail stores, warehouses, transportation craft (air, ground, rail or water), carriages, or in other structures or crafts. The automatic counterbalancing system may be attached to a wall, floor, or ceiling of the structure, or a frame, enclosure, or a rigid or moveable support structure to ensure stability and for convenience. In automatic counterbalancing system may also be integrated with existing, cabinets, shelves, tools, furniture, or other structural components. The counterbalancing systems allow goods to be raised, lowered or otherwise repositioned to an out of the way storage position.

The components and configurations of the described embodiments are interchangeable and not meant to be limiting, but rather are illustrative embodiments. Various illustrative embodiments of the force engine and counterbalance system may be configured utilizing a basic framework. For example, the described systems may utilize any number of energy reservoirs depending on the load requirements and selected linkages depending on a selected displacement path for the load. In particular, a variable load is moved through the same fixed displacement or output path. If the load is less than a maximum load, only a portion of the capacity of the energy reservoir is utilized.

The following provides a framework for understanding the embodiments and drawings relative to a methodology, structure, and function. The framework may also explain the potential combinations and variations of the embodiments. For example, the described systems may utilize any number of energy reservoirs depending on the load requirements and selected linkages depending on a selected displacement path for the load. In another example, the described methods may utilize any number of energy reservoirs depending on the load requirements and selected linkages depending on a selected displacement path for the load. In particular, the framework is applicable to the subsequently described force engines and counterbalance systems, such as an auto-balancing cabinet or carriage.

An energy reservoir may be utilized that is capable of storing potential energy which may be deployed to create a counterbalancing force. An energy potential or reservoir such as may result, at least in part, from mechanical, gravitational or hydraulic potential may be utilized for force or load balancing. As is described herein, a variety of suitable energy reservoirs exists and may be effectively utilized. In one possible application, the counterbalance force may be utilized to lift or reposition a load from a loading/unloading height to a stored height during an operating mode or cycle. Potential energy is transferred from the energy reservoir to the load being lifted. The system is also capable of transferring, capturing or harvesting potential energy in the energy reservoir, that might otherwise be lost as kinetic energy, as the load is lowered or repositioned from the stored position to the load/unload position. Energy is captured and released between the load and the energy reservoir as the load is raised, lowered or otherwise repositioned.

Energy is transferred between the load and the energy reservoir through a linkage capable of transmitting forces between the energy reservoir and a carriage (storing the load), or other point to which the load may be attached or repositioned relative thereto. The linkage may be embodied in any number of ways and configurations. The energy reservoir is capable of storing enough energy to lift or counterbalance a maximum load over or through a set displacement or displacement path. The counterbalance system is capable of being reconfigured during an adjusting mode to adjust the amount of energy transferred from or an output force of the energy reservoir to balance any load between a maximum and minimum load during the operating mode. The rate at which energy is transferred is variable. For example, when operating with a maximum load, the entire or at least a greater portion of the energy capacity of the energy reservoir is transferred as the load displaces through the displacement path. With a 50% load, only or up to 50% of the energy will be transferred from the energy reservoir as the load is displaced over the same range of the displacement path. With a minimum load, only a minimal amount of energy is transferred from the energy reservoir as the load is displaced over the same range of the displacement path.

In these embodiments, the load is displaced over the same range of the displacement path, but the amount of energy transferred from the energy reservoir to the load varies. This may be accomplished by adjusting or reconfiguring the operating relationship of the linkage between the energy reservoir and the carriage in an adjusting mode. In particular, the operating relationship, kinematic relationship, or coupling ratio of the linkage is increased to accommodate heavier loads. These relationships and ratios may likewise be decreased to accommodate lighter loads. An increased coupling ratio indicates that the energy reservoir will have a greater displacement for the same displacement of the carriage.

The adjustment of the operating relationship of the linkage may be accomplished by varying the operating relationship of a variable member within that linkage when the force engine is in adjusting mode. There is a range of positions or configurations through which the variable member may rotate or otherwise be moved. At one end of the range, is a minimum capacity position of the variable member corresponding to the minimum coupling ratio of the operating relationship. At the other end of the range, is a maximum capacity position of the variable member corresponding to the maximum coupling ratio of the operating relationship. The variable member may be moved or reconfigured to any number of points along this range during the adjusting mode with little or no change in the energy state of the energy reservoir or load. Upon moving, adjusting, or reconfiguring the variable member to the position needed to achieve the needed operating relationship between the energy reservoir and carriage, the variable member's position or operating relationship may then be fixed within the linkage.

Automatic adjustment to a load is accomplished by introducing feedback between the load applied to the carriage and the position of the variable member. To create this feedback system, several key components may be utilized including: a means of coupling the position of the variable member to the displacement of the load, and means of biasing the variable member toward the minimum capacity position.

The components or means of coupling the variable member to the load during the adjusting mode allows the variable member to be displaced toward the maximum capacity position in response to a greater load. Through this coupling means the biasing components may cause the force counteracting the load to increase as the load is displaced generally in the direction of the load. Additionally, the coupling ratio of the variable member to the load may be high, on the order of 10 to 20, meaning that a small displacement of the load in the direction of the load leads to a large displacement of the variable member toward the maximum position.

In the adjusting mode, as the load is increased the load may be displaced downward causing the variable member to displace against the biasing component or means, toward the maximum capacity position. The variable member may continue to displace until equilibrium is reached the balancing force as determined by the position of the variable member counteracting and equal to the load. The operating relationship of the variable member may then be fixed. Counterbalancing systems may preferably be designed and optimized so that the rate at which energy is transferred from the energy reservoir in the operating mode due to the fixed position of the variable member matches the load applied during the adjusting mode. The provided illustrative embodiments achieve this result.

Multiple mechanisms and general means of coupling the variable member to the load are possible. In one embodiment, during the adjusting mode, the displacement of the variable member is coupled to the displacement of the traveling member. Displacement of the carriage may be transferred through the linkage to the traveling member. Due to coupling between the traveling member and the variable member, a displacement in the carriage will cause a displacement in the variable member. In another embodiment, the load acts on a secondary carriage inside of the main carriage. In the adjusting mode the traveling member may be locked in position, but the secondary carriage is movable inside of the main carriage. The relative displacement of the two carriages may be transmitted through a secondary linkage, such as a sheathed or Bowden cable to position the variable member. In a yet another embodiment, the linkage is a cable or other similar flexible tension bearing member. A first end of the cable is attached to the variable member, and a second end to the carriage. At least one point of the cable may pass over a pulley attached to a displacing portion of the traveling member. In the adjusting mode the traveling member is fixed. Displacement of the carriage pulls on the cable leading to a displacement of the variable member. In operating mode, the variable member is fixed and displacement of the traveling member leads to displacement of the carriage through the range of movement of the traveling member.

Multiple components and means of biasing the variable member toward the minimum position may be utilized. In one embodiment, a biasing component such as a coil spring or gas spring applies a force to the variable member causing the variable member to be biased toward the minimum capacity position. In this configuration the linkage is designed so that there is little or no change in the energy state of the reservoir as the variable member is displaced. In another embodiment, the variable member may be biased toward the minimum capacity by designing the linkage so that as the variable member displaces toward the maximum capacity position, the energy state of the energy reservoir increases, but only slightly. This configuration has the advantage of requiring no extra biasing components. In addition, the reliability of the system is improved because the biasing and force generating features are provided by the same component and will age together (i.e., drift). One embodiment accomplishes this by utilizing a variable member which is a rotating arm, a first end of the variable member is attached to a ground point and a second end is attached to an energy reservoir, such as a spring. The other end of the energy reservoir is attached to some point on the linkage which is close to, but not concentric with the first end of the variable member. As the variable member is rotated, the energy reservoir will displace slightly, increasing the reservoirs energy state and biasing the reservoir in the opposite direction commensurate with the increased energy state of the reservoir. In another embodiment, a combination of (1) biasing as a result of the energy reservoir displacing as the variable member is moved during adjusting mode, and (2) the use of biasing components is utilized to create the net biasing needed.

Another practical implementation of automatic adjusting counterbalance systems described herein is a component or means for transitioning between the operating and the adjusting mode. The variable member may be fixed during the operating mode and free to move as based on the coupling with the load during the adjusting mode. The traveling member is free to move during operating mode. During the adjusting mode, the traveling member is either fixed or coupled to the displacement of the traveling member. It may be preferable that during transitioning between modes, the fixing of the variable member and the traveling member overlap slightly to prevent system instabilities. A number of components, linkages, and other means of achieving overlapping of modes may be utilized.

Additionally, the performance and usefulness of automatic adjusting counterbalancing systems may be improved by adding components to the linkage which change the kinematic relationship between the energy reservoir and the load. This linkage may be used to change the force displacement characteristics from a non-constant (i.e., variable) profile to a more constant profile. For example, linkages which have a non-constant (i.e., variable) coupling ratio may be utilized. Additionally, such linkages may be placed in the linkage between the energy reservoir and the traveling member or between the traveling member and the carriage, or in both places, to achieve the desired result.

The usefulness of the counterbalancing system may be increased in an overhead storage system by designing the system and transformations so that the balancing force is not constant throughout the range of motion during the operating mode. At the bottom of the range, the balancing force provided may be less than the load, requiring the user to provide a lifting force. This ensures that the carriage does not inadvertently start lifting without the user intending for it to do so. At the top of the range, the balancing force provided by the engine may be more than the load, causing the carriage to be pulled into the stored position and preventing the carriage from lowering without the user applying a downward force.

The force engines and auto-balancing systems may utilize different configurations in any number of embodiments. The drawings illustrate a number of those embodiments and in addition systems or components of those embodiments may be combined, repositioned and rearranged to form additional embodiments. For example, the embodiments may be characterized by adjustments including: mechanical/manual, automatic, and sensor/actuator. The embodiments may be first characterized by the manner in which the variable member is positioned.

Positioning methods include: (1) External Input—positioning via some external input (manual, actuator, external load, etc.); (2) Direct Positioning—positioning based on the load point by kinematically coupling the variable member to the load point; (3) Relative Positioning—positioning by coupling the variable member to the relative load point using a secondary linkage; and (4) Pass through—positioning of the variable member by use of a flexible tension bearing component, a first end of the cable attached to the variable member, a second end of the cable attached to the carriage, and at least one point of the cable passing over a pulley attached to a displacing portion of the traveling member.

As second characterization includes the manner in which the force engine or system is biased in the adjusting mode. Biasing methods include: (A) No Biasing—the variable member may be moved to any position with practically no input of energy to the engine or system. In application, this may only work with positioning via an external input, such as direct user input or with an actuator; (B) Biasing Component—the energy reservoir is unbiased, but a separate biasing component is included which biases the variable member to the minimum displacement position. The path of the variable member (or variable member path) is unbiased; and (3) Reservoir Path Biasing—the energy reservoir is designed so that the energy reservoir is slightly biased toward the minimum displacement position. In other words, the path of the variable member is biased.

Combinations of the first and second characterizations may result in the following embodiments illustrated in Table 1.

TABLE 1

| | | Variable Member Positioning | | | |
|---|---|---|---|---|---|
| | | External Input (1) | Direct Positioning (2) | Relative Positioning (3) | Pass Through (4) |
| Biasing | No Biasing Free Adjustment (A) | (1A) Free Adjustment (Manual or Actuator Adjustment) | (2A) | (3A) | (4A) |
| | Biasing Component (B) | (1B) | Scheme (2B) | (3B) | (4B) |
| | Reservoir Path Biasing (C) | (1C) | Scheme (2C) | (3C) | (4C) |
| | Combination Biasing (D) | (1D) | (2D) | (3D) | (4D) |

Referring now to FIG. 1 illustrating a pictorial representation of a force engine 100 in accordance with an illustrative embodiment. The force engine 100 includes a traveling member 102 hingedly connected to a hinge 104 at a first end 106. The hinge 104 is connected to a frame, wall, or other motionless element or component hereinafter referred to as "ground point." The invention contemplates that the ground may be configured in a device that is portable, transportable, moveable, or relocatable. For example, a portable carriage may be carried by or housed within portable structure or device to which hinge 104 is rigidly affixed or connected. Thus, although the component or device to which hinge 104 is affixed or attached may be moved, it is considered "motionless" since the connection point does not move relative to the portable component or device. In one embodiment, the force engine 100 may be configured on a cabinet or caster supported bench that is relocatable within a location. In the embodiment illustrated in FIG. 1, the hinge 104 is a joint that secures the traveling member 102 to the ground point so that the traveling member 102 may rotate about the hinge 104. The hinge 104 may be attached to the ground point and rotate around a pin. Any number of hinges or hinged mechanisms known in the art may be utilized to connect the traveling member 102 to the ground point.

A second end 108 of the traveling member 102 includes a load point 110 that is directly or indirectly coupled to the load 112. Motion of the load point 110 on the traveling member 102 drives the motion of the load 112. The load 112 is illustrated as indirectly coupled to the load point 110 by a cable 114. In one embodiment, the cable is a braided cable. However, a rope, cord, strap, line lead, chain, or belt may alternatively be utilized. The traveling member 102 may also be coupled to the load 112 by a linkage, or translation component. The load 112 is representative of one or more weights, applied forces, articles, or goods that are moved through a displacement path. The counterbalancing force substantially counteracts the load 112 (i.e., counteracts the force of gravity acting on the mass of load 112). The load point 110 is the point, portion, or segments of the traveling member 102 from which the load 112 is applied or driven. Alternatively, the load point 110 may be located at any point along the traveling member 102. The load point 110 may vary between the illustrative embodiments. In the embodiment, the traveling member 102 travels the same displacement for every load 112 regardless of whether it is a load within a capacity rating (i.e., between a suggested minimum and maximum.

The traveling member 102 may be temporarily coupled to a variable member 116 during the adjusting mode as is subsequently described. The variable member 116 may include a first end 118 hingedly connected to a hinge 120 which is attached to a ground point; the hinge 120 rotates about a pivot point 119. The hinge 120 may be similar to the hinge 104. A second end 122 of the variable member 116 may be hingedly attached to an energy reservoir 124 including a first end 126 and a second end 128. In one embodiment, the traveling member 102 and the variable member 116 are mechanical arms that may rotate during the adjusting mode with only the traveling member 102 moving during the operating mode to drive the load 112.

In one embodiment, a variable member lock 130 may fix the positions of the second ends 122 and 128 of the variable member 116 and the energy reservoir 124, respectively. In one embodiment, the variable member 116 may include a release that engages the variable member lock 130 to fix the position of the second ends 122 and 128. For example, the variable member lock 130 is an arcuate shaped rack with cogging or teeth that engage with a latch and release associated with the second end 122 of the variable member 116. In other embodiments, the variable member lock 130 may include a pin and hole configuration for locking the position of the variable member 116 relative to the variable member lock 130. The second end of 122 of the variable member 116 may also be configured with a pawl wheel for engaging the variable member lock 130 and a pawl for selectively controlling rotation of the pawl wheel along the variable member lock 130 for controlling the position of the variable member 116. The variable member lock 130 may be engaged and disengaged. The variable member 116 may include a slot operable to receive a roller 132 of the traveling member 102 to create a coupling between the traveling member 102 and the variable member 116. In another embodiment, the slot on the traveling member 102 receives a roller 132 on the variable member 116. Any number of other high ratio couplings between the traveling member 102 and the variable member 116 may also be utilized. For example, coupling may include four bar linkages, gears, pulleys and cables, and other known configurations. The slot and roller 132 are shown for purpose of understanding potential couplings that may be used.

The force engine 100 is configured to operate in an adjusting mode and an operating mode. These modes may be alternatively described as a weighing/counterbalance synchronization mode and a lifting mode, respectively. In the operating mode, the load 112 is raised and lowered and the energy reservoir 124 provides and captures the energy applied to and lost by the load 112. In the adjusting mode, the load 112 may be either increased or decreased and a magnitude of the force provided by the energy reservoir 124 may be adjusted accordingly to match the load 112.

In one example, in the adjusting mode, the variable member 116 is temporarily coupled to the traveling member 102. As the traveling member 102 rotates downward, the variable member 116 also rotates downward and increases the angle between the energy reservoir 124 and the traveling member 102. The roller 132 rides in the slot of the variable member 116. The roller 132 may be located coincident or nearly coincident with an attachment point 135 of the energy reservoir 124 to the traveling member 102. As a result, a length of the energy reservoir 124 changes very little or not at all. A bias component (not shown) may be utilized to bias the variable member 116 toward a minimum capacity position. Alternatively, the location of the roller 132 and the attachment point 135 may be positioned close to each other, but not coincident to bias the variable member 116 toward a minimum capacity position for the energy reservoir 124.

Increasing the angle of the variable member 116 away from the traveling member 102 increases the angle at which the energy reservoir 124 approaches the variable member 116 thereby increasing the torque applied to the traveling member 102 to increase the balancing force for an increased load 112. When a load 112 is placed on the traveling member 102, the traveling member 102 begins to rotate clockwise thereby causing the variable member 116 to rotate counterclockwise and increasing a balancing torque. When the balancing torque equals a torque applied by the load 112 to the traveling member 102, the traveling member 102 stops rotating. Once a user input is provided by the user, the variable locking member 130 locks the variable member 116 in place. At this point, the force engine 100 has transitioned between the adjusting mode and the operating mode.

In the adjusting mode, the force engine 100 acts as a closed feedback system. The load 112 causes the load point 110 to be displaced. Displacement of the load point 110 is linked to a position of the variable member 116. As the variable member 116 is displaced or rotated it causes the balancing torque provided by the energy reservoir 124 (or a biasing component) to be increased or decreased depending on the direction of displacement. The increase in balancing torque on the force engine 100 arrests further displacement of the load point 110. At this point, the user may provide input to enter the operating mode. The closed loop feedback system of the force engine 100 has moved the variable member 116 to a position required for the energy reservoir 124 to balance the load 112 throughout an operating range of the load 112.

The balancing forces generated by the force engine 100 during the operating mode are a function of the displacement or rotation of the variable member 116 and are not dependent on the load 112. Moving the variable member 116 determines how much of the energy capacity of the energy reservoir 124 is utilized and the resulting balancing force. In particular, the variable member 116 may be released, repositioned, and fixed in place. The adjustments to the force engine 100 may be performed automatically or manually.

In the illustrative embodiments, no lifting is done in the adjusting mode. In the operating mode, the variable member 116 is fixed and the load 112 may be lifted and lowered. The amount of displacement of the energy reservoir 124 may be configured to match the load 112 by varying the operating or kinematic relationship between the traveling member 102 and the energy reservoir 124 in the adjusting mode. The operating relationship is the respective position and angle of the energy reservoir 124, traveling member 102, and the variable member 116 relative to each other. As a result, the energy exchanged between a partial load over the displacement range of the energy reservoir 124 and the full effort or energy provided by the energy reservoir 124 over a partial range of the energy reservoir 124 are substantially equal. In the two different modes, the force engine 100 acts as different mechanisms and thereby is more efficient than many previous force generation systems that were only manually adjustable. In addition, the force engine 100 is capable of providing a variable counterbalancing force to accommodate the load 112.

Once the corresponding torques are balanced, the variable member 116 is fixed along its corresponding rotation by the variable member lock 130. The roller 132 is released from the slot, disengaging the coupling of the traveling member 102 and the variable member 116. The variable member 116 is fixed in the operating mode such that the second end 122 of the variable member 116 provides a fixed-position or stationary pivot point for the energy reservoir 124 to drive motion of or impart motion to the traveling member 102. The force transmitted to the load 112 is dependent on the operating configuration and relationship of the variable member 116 as positioned during the adjusting mode.

Motion of the second end 122 of the variable member 116 along the variable member lock 130 before it is fixed or locked in place is referred to as a displacement pathway. In one embodiment, the energy reservoir 124 is a compressed or extension gas spring. As known in the art, a compressed gas spring stores energy by pressing a rod into a chamber of a compressed gas. When gas springs are compressed, the pressure in the spring rises which in turn increases the extension force. The difference in force from the extended position or nominal force to the compressed position is measured and expressed as progressivity. Compressed gas springs are useful because they generally have a lower progressivity factor, which provides a more constant force. In another embodiment, the energy reservoir 124 is a coil spring (compression, torsion, tapered, volute, clock, leaf, garter, or tension). In other embodiments, the energy reservoir 124 may be a torsional spring, deflecting beam, elastoresistive member, electromagnets, one or more masses acting against gravity, or a buckling beam.

In other embodiments, the traveling member 102 may be referred to as a lift arm, the variable member 116 as an adjustment arm, the energy reservoir 124 as a spring, gas spring, compression spring, torsion spring, the hinges 104 and 120 as bases, and the variable member lock 130 as a tooth or cogged plate to name a few alternative terms. In yet another embodiment, hinges 104 and 120 may be configured as biased hinges (by actuation of a spring, flexure, elastoresistive element, or the like) to bias or encourage rotation of traveling member 102 and/or variable member 116. Other hinge connections of force engine 100 may also be so configured.

Figure 2:
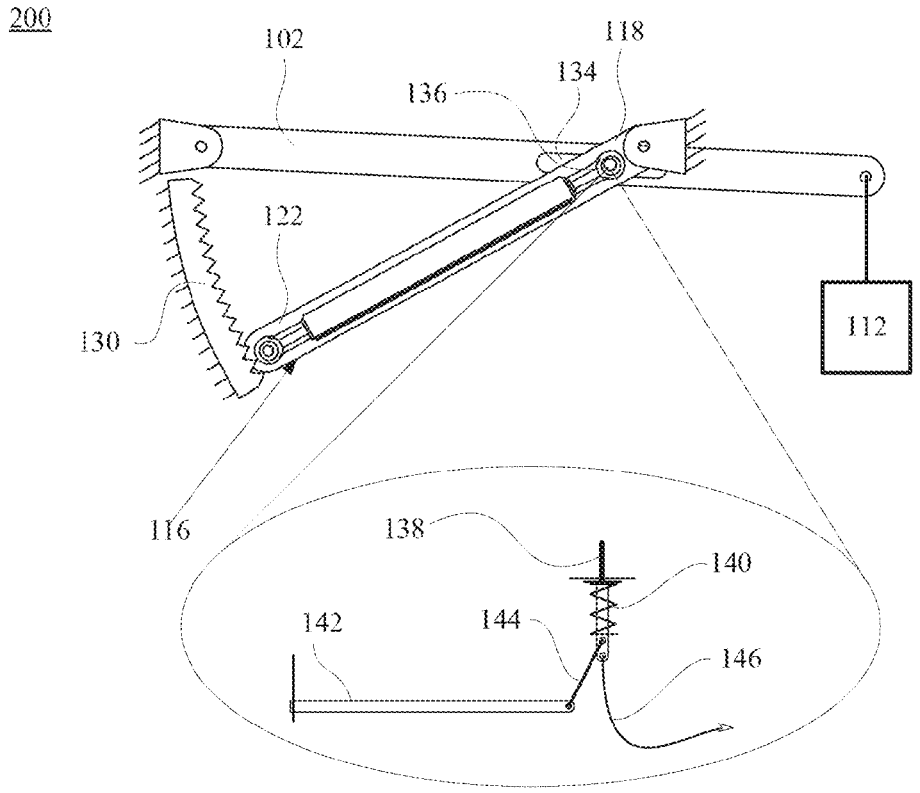

Turning now to a force engine 200 of FIG. 2. The force engine 200 is an alternative embodiment of the force engine 100 of FIG. 1. The traveling member 102 may define a slot 134. A release 136 is operable to engage the slot 134 and fix a second end 122 generally opposite a second end 118 of the variable member 116 against the variable member lock 130.

In one embodiment, the release 136 includes a pin 138. The pin 138 is mounted to the variable member 116. The pin 138 is biased by a spring 140. The pin is coupled to a rod 142 by a rod 144 and separately coupled to cable 146. The rod 142 extends along a length of the variable member 116. The pin 138 engages with the slot 134 to fix the variable member 116 to the traveling member 102 during the adjusting mode to create a coupling. The pin is retracted during the operating mode such that the rod 142 engages with the variable member lock 130 to fix the position of the variable member 116 and establish the operating relationship. The cable 146 may be coupled directly or indirectly to a handle, lever, dial, or other mechanical interface for receiving user input to select the operating mode. In one embodiment, the pin 138 may be configured, such that the pin 138, by being selectively biased, automatically engages with the slot 134 in response to the traveling member 102 being displaced to a load/unloading position.

The release 136 is one of multiple releases that may be utilized to fix the position of the variable member 116 during the operating mode and couple the traveling member 102 and the variable member 116 during the adjusting mode.

Figure 3:
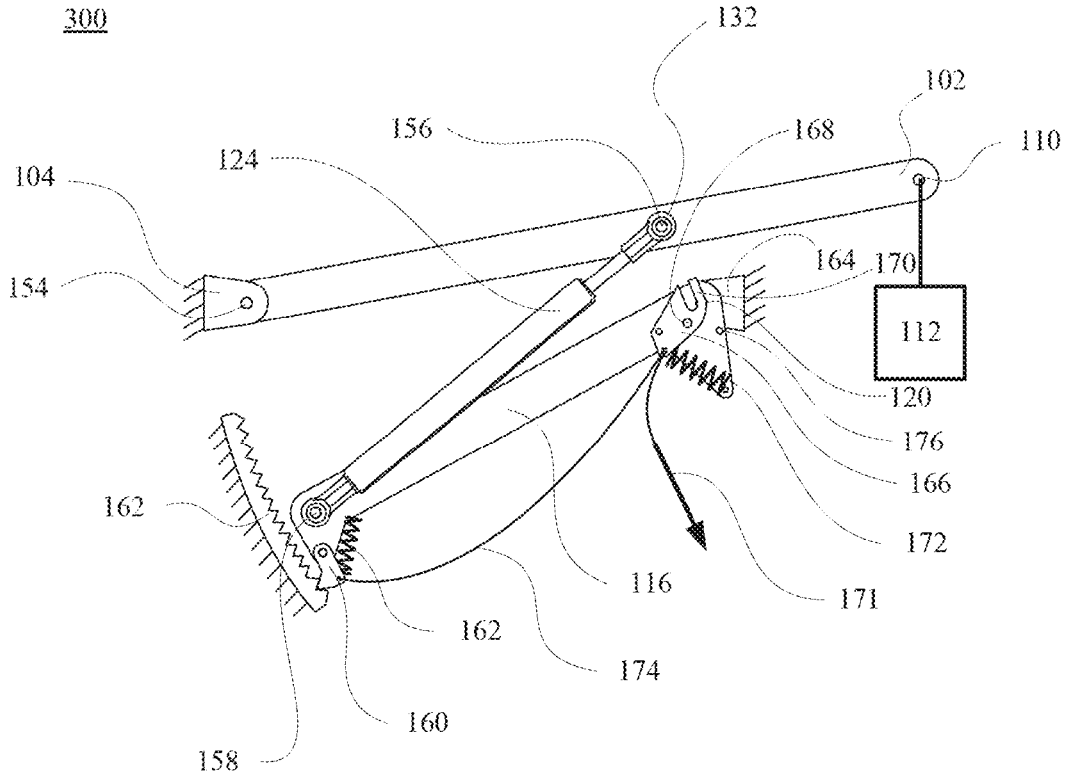
Figure 4:
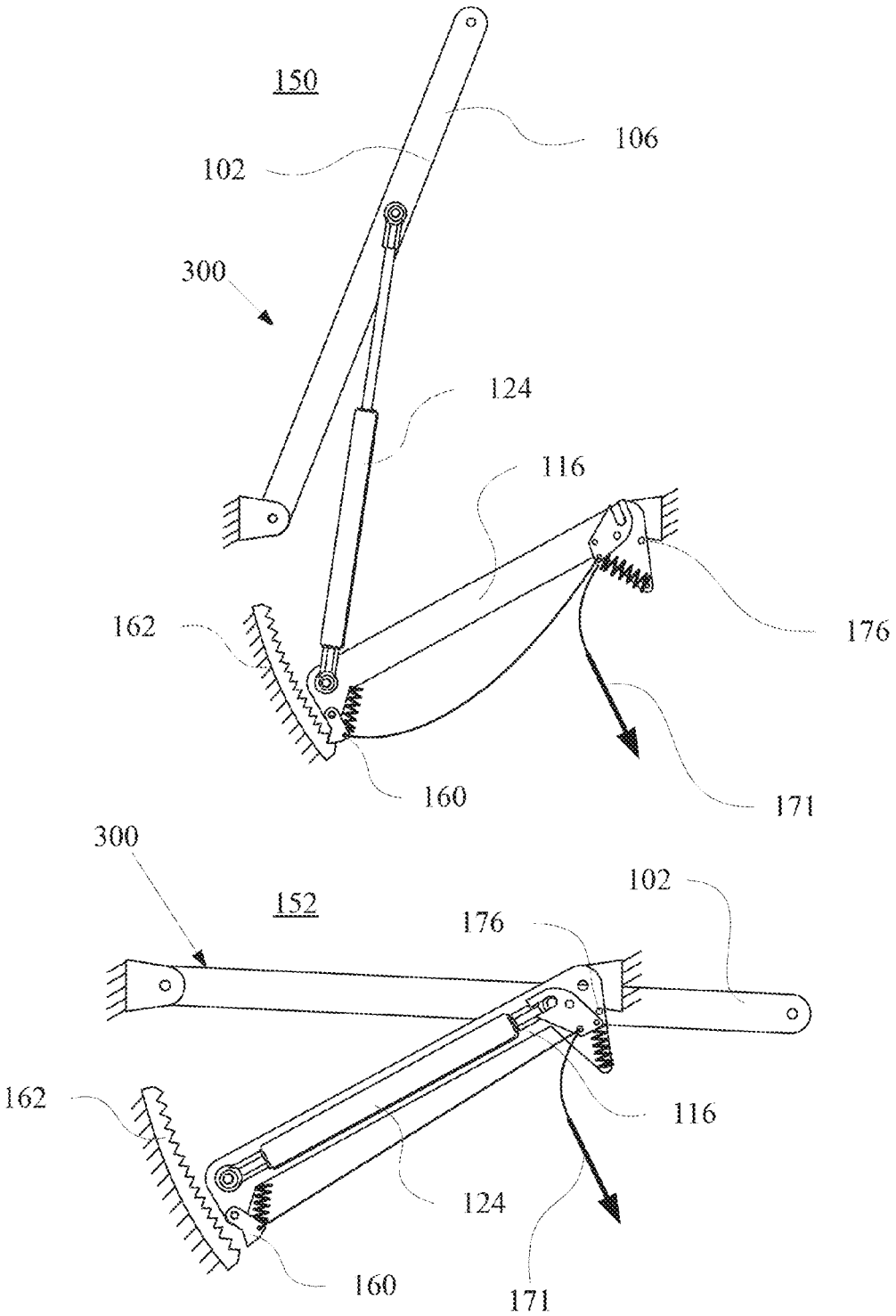

FIGS. 3 and 4 illustrate a force engine 300. FIG. 3 is more detailed embodiment of the force engine 100 of FIG. 1 and includes many of the same components and functions. FIG. 4 illustrates the force engine 300 in a lifting mode 150 and an adjusting mode 152. As shown in FIG. 3, the force engine 300 may include the traveling member 102 hingedly connected to the hinge 104 and rotating about a pivot point 154. Various components of the force engine 300 are connected or pinned to a ground point (i.e., a framework or case). In one embodiment, a cable 114 may be connected to the traveling member 102 at a load point 110. The load point 110 may also be configured with a pulley rotationally attached to the traveling member 102.

The traveling member 102 is rotationally connected to an energy reservoir 124 at attachment point 156. The traveling member also includes the roller 132 located nearly concentric with the attachment point of the energy reservoir 124, but may be located at a different depth in or out of the plane coincident with the attachment point. The attachment point 156 may be positioned generally closer to the load point 110 of the traveling member 102. The roller 132 may be a roller or pin, of either a bearing or bearingless type. The biasing component or energy storage device connected to the traveling member 102 at the attachment point 156 may be a constant force spring. In one embodiment, the bias component is the energy reservoir 124. The first end of the energy reservoir 124 is connected to the traveling member 102 at the attachment point 156 and the second end of the energy reservoir 124 is rotationally connected to the variable member 116 at an attachment point 158.

The second end of the variable member 116 includes a latch 160 hingedly connected to the variable member 116 and is connected to a latch spring 162. The latch 160 slidably interfaces with a rack 162. In one embodiment, the rack 162 has an arcuate shape and is affixed to the case or support structure of the force engine 300. The rack 162 and latch 160 (e.g., pawl) allow the operating relationship between the variable member 116 and the traveling member 102 to be fixed such that the energy reservoir 124 provides a force corresponding to a load 112 applied at the load point 110.

The first end of the variable member 116 may be hingedly connected to a hinge 120 with a pinned connection to a ground point that rotates about a pivot point 164. A rotational linkage 166 is hingedly connected at the first end of the variable member 116 and rotates about an attachment point 168. The rotating linkage 166 includes a linkage slot 170 and is connected to a stay spring 172. The motion of the rotating linkage 166 may be limited by a stop 176. The rotating linkage 166 is connected to the latch 160 by a decoupling linkage 174. In one embodiment, the decoupling linkage is a cable. The decoupling linkage 174 may also be configured as mechanical linkage, such as a rod, shaft, bar, strap or other like member or configuration. The stay spring 172 biases the rotating linkage 166 such that the decoupling linkage 174 does not disengage the latch 160 from the rack 162 until the roller 132 engages and is generally secured within the slot 170, causing the linkage to rotate and pull the decoupling linkage 174 to actuate latch 160 out of engagement with the rack 162 by overcoming the resistive bias of stay spring 190. As previously described, the traveling member 102 may be connected to a carriage, cabinet or a like component directly or indirectly through a linkage, such as a pulley and cable system.

As previously described with regard to FIG. 4 and with reference to some components in FIG. 3, the force engine 300 is configured to operate in two modes: an adjusting mode 152 and an operating mode 150. In one example, during the adjusting mode 152, the traveling member 102 is lowered such that the roller 132 slides into and engages the linkage slot 170. Coupling occurs as the roller 132 is inserted into the linkage slot 170 causing the rotating linkage 166 to rotate and pull taut the decoupling linkage 174. As the rotating linkage 166 continues to rotate, the rotating linkage 166 compresses the spring 172 until it has reached a maximum compression. As the rotating linkage 166 continues to rotate, the torque profile on the rotating linkage 166 changes from a clockwise-acting torque to a counterclockwise-acting (e.g., applied by spring 172) torque after rotating past the equilibrium position, and simultaneously at which point the rotating linkage 166 continues to disengage the latch 160 by actuation of decoupling linkage 174. The latch 160 is entirely disengaged at the point which the rotating linkage 166 has come to rest against the pin 176. As a result, the force engine 300 may automatically transition from the operating mode or lifting mode 150 to the adjusting mode 152 in response to the traveling member 102 being lowered to couple with the variable member 116. Once the latch 160 is disengaged from the cogged rack 162 such that the attachment point 156 of the variable member 116 may rotate up or down the relative to rack 162 to a counter-resistive position offsetting a weight of the goods in the carriage, cabinet, like component. To reengage the latch 160 with the rack 162, the user provides user input on cable 171 causing the rotating linkage 166 to release the roller 132 and allowing the spring 190 to urge the latch 160 into the cogged rack 162. For example, a handle engaged by the user may pull on the cable 171.

During the adjusting mode 152, the variable member 116 and the energy reservoir 124 are nearly aligned and the ends near the cogged rack 162 move in unison to a position along the rack 162 that configures the energy reservoir 124 to provide a force required to lower and raise the load 112 with minimal user input being required for offsetting the weight of the load and the carriage, cabinet or like component. When the latch 160 is engaged at the bottom of the rack 162 (or a maximum load capacity point), the force engine 300 is configured to provide the most force corresponding to the maximum load capacity of the force engine 300. When the latch 160 is engaged at the top of the rack 162 (or a minimum load capacity position), the force engine 300 is configured to provide the minimum force that may be required to lift the carriage with zero or a minimal load.

During transition between the two modes, the coupling and uncoupling movement of latch 166 and fixing and unfixing movement of the latch 160 overlap slightly such that the force engine 300 does not enter an unstable position (e.g., when latch 166 is uncoupled at the same time latch 160 is unfixed) or a state during which the energy stored by the energy reservoir 124 rapidly releases stored energy or accelerates the load.

FIG. 4 shows the force engine 300 being utilized in the operating mode 150 and in the adjusting mode 152 to further illustrate the described components and their interactions, the method of operation, and functionality of the force engine 300.

During the operating mode 150, the energy reservoir 124 extends the traveling member 102. The energy reservoir 124 is able to extend the traveling member 102 hinged on the support from the interconnected variable member 116 and affixed position of the latch 160 against the cogged rack 162. The position or displacement of the latch 160 along the cogged rack 162 corresponds to the stored energy used by the force engine 300 and applied by the energy reservoir 124. The latch 160 being positioned at the top of the tooth plate 162 generally corresponds to a minimum force being applied by the energy reservoir 124. The latch 160 being engaged at the bottom of the cogged plate 162 corresponds to a maximum force being applied by the energy reservoir 124. The cogged plate may lock the variable member 116 at many positions and is operable to bear the load exerted on the variable member 116 by the energy reservoir 124 during the operating mode 150. The latch 160 is able to engage with the cogged plate 162 once user input is provided to reengage the latch 160 actuation of the cable 171.

Figure 5:
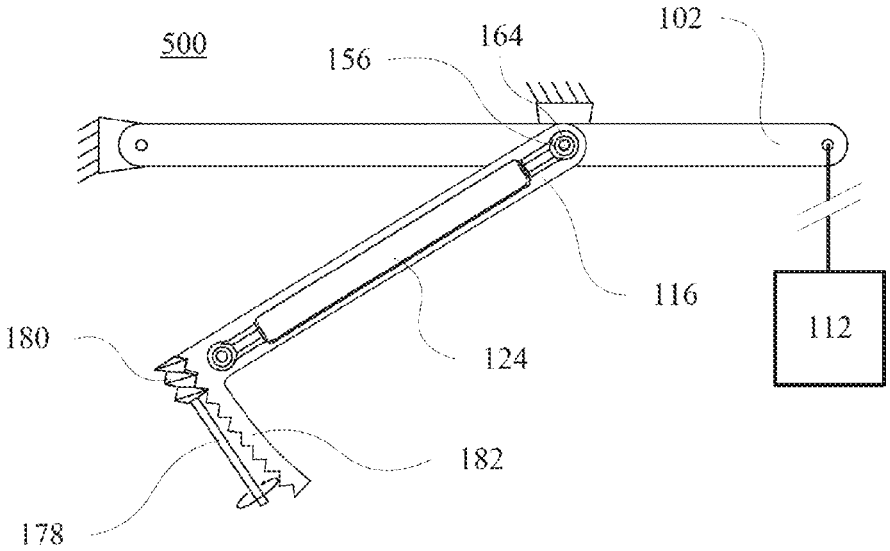

Turning now to FIG. 5 showing a pictorial representation of a manual adjust engine 500. The manual adjust engine 500 may include many of the same components as the auto-balancing engine 200 of FIG. 2. In one embodiment, the user may manually set the position of the variable member 116 and the corresponding operating relationship of the traveling member 102 and the energy reservoir 124 for selecting the balancing force. The adjustment is performed based on the user input with minimal or no compression or change of the energy state of the energy reservoir 124. This results from the attachment point 156 being coincident with the pivot point 164. The user may adjust the manual adjust engine 500 utilizing a knob, lever, handle, strap, dial, pedal, button, or other mechanical adjustment component.

In one embodiment, a dial (not shown) may be directly or indirectly coupled to a shaft 178. The shaft 178 may include a worm gear 180. The worm gear 180 may be operable to interface and engage with cogged rack 182 of the adjustment arm 116. Turning the dial and corresponding shaft 178 positions the cogged rack 182 and corresponding adjustment arm 116 such that the energy reservoir 124 or other energy storage element is positioned and biased to provide the required force to the traveling member 102.

Figure 6:
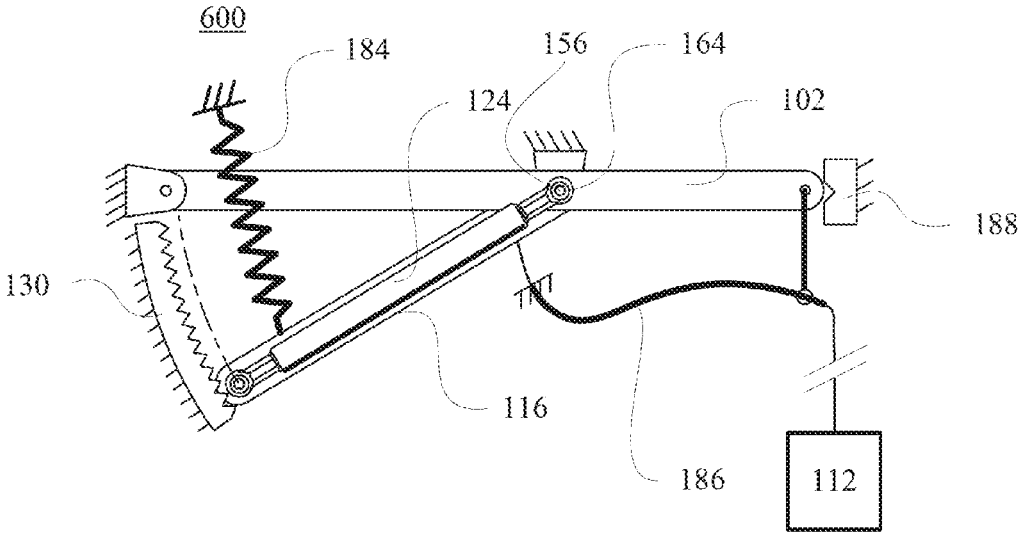

In FIGS. 6-9, the biasing may be performed by a biasing component 184 or by biasing the path of the energy reservoir 124. Also, FIGS. 6-9 illustrate a variety of ways of linking the position of the variable member 116 to the displacement of the load 112. The combinations shown are a few of many combinations possible. Turning now to FIG. 6 illustrating a force engine 600. The force engine 600 includes one or more components in addition to many of the components of the force engine 100 of FIG. 1. In particular, the biasing component 184 may bias movement of the variable member 116 toward a minimum capacity position. For example, a coil spring or other resistive element may bias the variable member 116 toward a minimum capacity position. In one embodiment, the bias component 184 is a coil spring with a first end connected to a ground point and a second end connected to the variable member 116. As a result, the energy reservoir 124 is not utilized for biasing the variable member 116. The pivot point 164 is positioned coincident with an attachment point 156 of the energy reservoir 124 to the traveling member 102 when fixed in the adjusting mode. The variable member 116 may be moved without significant change of the length (and thus energy state) of the energy reservoir 124 as a result of the pivot point 164 being generally coincident with the attachment point 156. When the force engine 600 changes to the operating mode, the variable member 116 is fixed in position relative to the cogged rack 130 and the traveling member 102 is released.

In the adjusting mode the traveling member 102 is fixed and a load 112 is coupled to the variable member 116 by a sheathed cable 186 or other secondary linkage. The sheathed cable 186 may move with the traveling member 102 during the operating mode while still allowing the rotation of the variable member 116 during the adjusting mode. By attaching the sheathed cable 186 near a pivot point 164 of the variable member 116, the load 112 displaces only slightly to move the variable member 116 through its entire range of motion along a path.

The force engine 600 may further include a traveling member lock 188. The traveling member lock 188 may be operable to secure the traveling member 102 in the adjusting mode and release the traveling member 102 in the operating mode. The traveling member lock 188 may utilize a hook, latch, pin, bolt, catch, pawl, clip, or other release mechanism.

Figure 7:
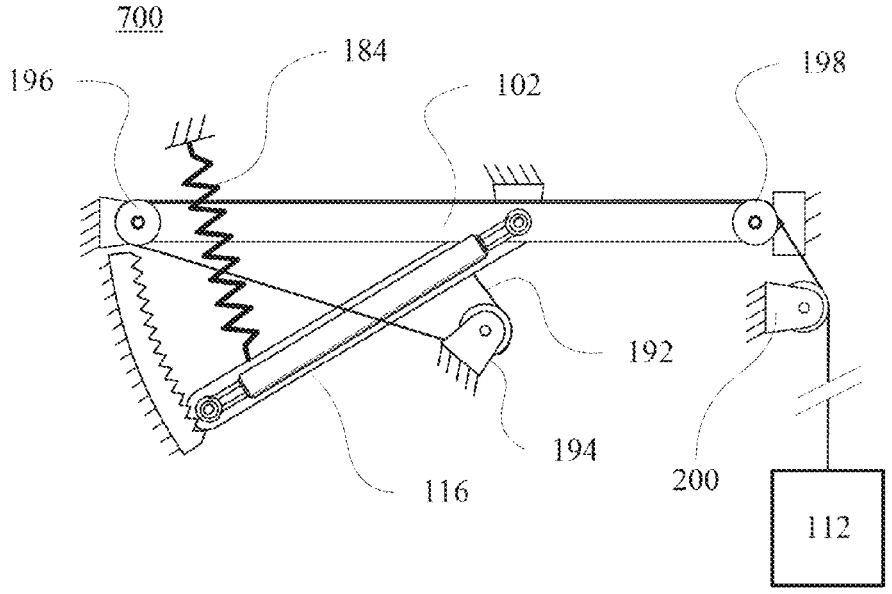

FIG. 7 is a pictorial representation of a force engine 700 in accordance with another illustrative embodiment. The force engine 700 is similar to the force engine 600 of FIG. 6 with some minor changes to the path of the cable 192 being configured through pulleys 194, 196, 198, and 200. The pulleys 194 and 200 may be attached to a ground point as previously described. The pulleys 196 and 198 are attached to the traveling member 102, and the cable 192 is attached to variable member 116. The pulleys 194, 196, 198, and 200 redirect the cable to use the force provided by the energy reservoir 124 and applied through the traveling member 102 to actuate the load 112. In adjusting mode, the traveling member 102 is fixed, and the variable member 116 is free to move. As an additional load is applied to the cable or carriage attached to the cable, the cable 192 displaces in the direction of the load 112 along the pulley configuration. This displacement pulls in a direction generally perpendicularly on the variable member 116 causing it to displace toward the maximum capacity position. As the variable member 116 displaces the variable member 116 stretches the biasing component 184, increasing the force in the cable 192, which is transmitted by the biasing component 184 through the cable to the load 112. The load 112 keeps displacing until the force from the biasing component 184 and the force from the load 112 are generally equal. In response to a user input, the variable member 116 may be locked and the traveling member 102 may be freed to rotate. The variable member 116 is now positioned to provide the counterbalancing force needed to lift the load 112 through the range of motion. The force engine 700 provides a more simple mechanical mechanism for coupling the load 112 to the variable member 116. The traveling member 102 may be simply locked during operating mode utilizing any number of locking mechanisms known in the art and described herein.

Figure 8:
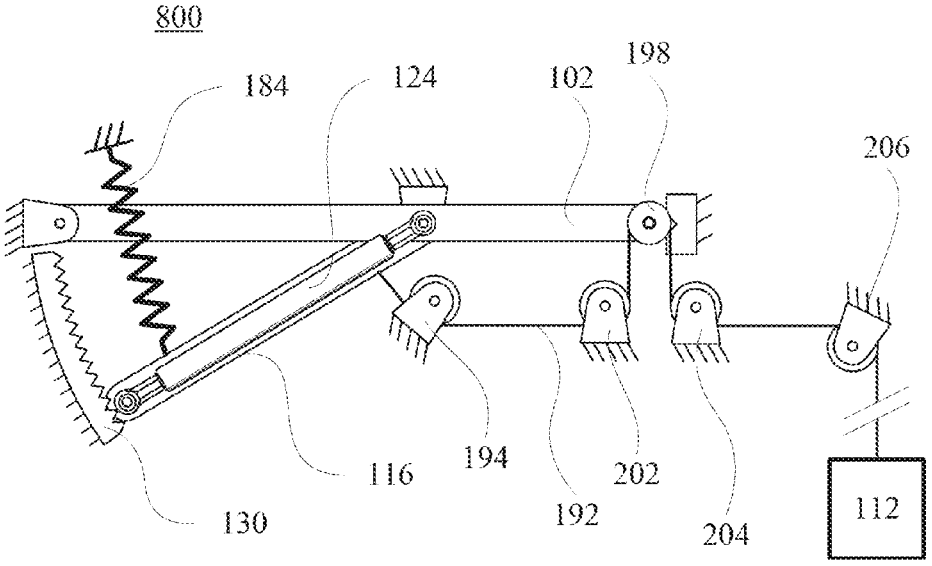

FIG. 8 is a pictorial representation of a force engine 800 in accordance with another illustrative embodiment. The force engine 800 is similar to the previously described embodiments. The force engine 800 utilizes pulleys 194, 198, 202, 204, 204, and 206 to apply the counterbalancing force to the load 112. The pulleys 194, 202, 204, and 206 may also be attached to a ground point. An advantage of this configuration is that the displacement of the cable 192 as a result of the rotating traveling member 102 is twice the displacement of the cable 192 in the force engine 700. Other pulley configurations are contemplated. A pulley configuration may be arranged to have a multiple of the amount of displacement of force engine 700 in FIG. 7. Even multiple additional pulleys could be added to the pulley configuration in FIG. 8 to multiply the displacement of the cable relative to rotation of traveling member 102. Changing the force of the cable 192 acting on the variable member 116 can also be controlled by a pulley configuration. Multiple pulleys could be arranged to manipulate the force of the cable 192 acting on the variable member 116 for the same load, such as in the case where at least one end of the cable 192 is connected to a ground point.

Figure 9:
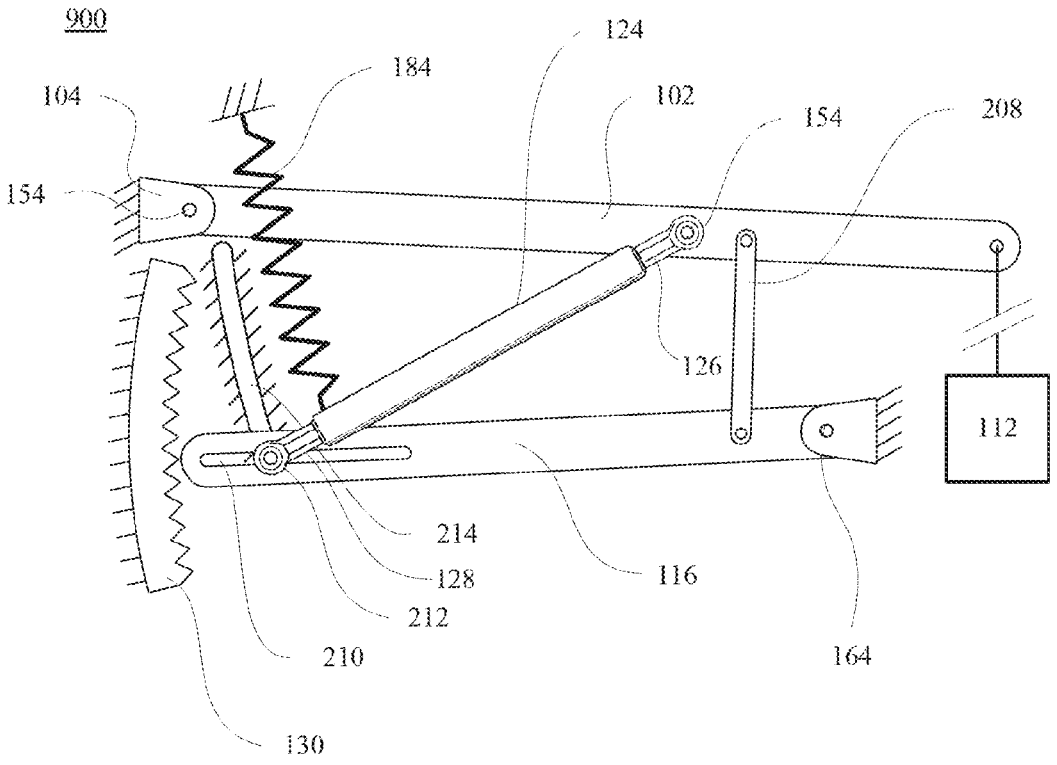

Turning now to FIG. 9, FIG. 9 illustrates a force engine 900. The force engine 900 is similar to the previously described embodiments. The force engine 900 may include a link 208 connecting the traveling member 102 to the variable member 116. The link 208 is a coupling member attached far from the pivot point 154 of the traveling member 102 and close to a pivot point 164 of the variable member 116, thereby achieving a large mechanical advantage between the traveling member 102 and the variable member 116. The variable member 116 defines a slot 210 for allowing a roller 212 attached to an end of the energy reservoir 124 to be slidably displaced. A track 214 may be further connected to a ground point allowing the roller 212 and corresponding ends of the energy reservoir 124 and the variable member 116 to be slidably displaced anywhere along the track 214.

Movement of the variable member 116 does not change the energy state of the energy reservoir because the track 214 is shaped so that as the ends of the reservoir 126 and 128 move the length of the energy reservoir 124 does not change. The energy state change of the load 112 is counterbalanced, transferred or taken up by the energy state of the energy reservoir 124. The load 112 will displace until the force engine 900 reaches equilibrium and while the bias component 184 adjusts the variable member 116 and the energy reservoir 124, such that the force engine 900 provides the energy profile at the proper magnitude to drive the load 112.

Figure 10:
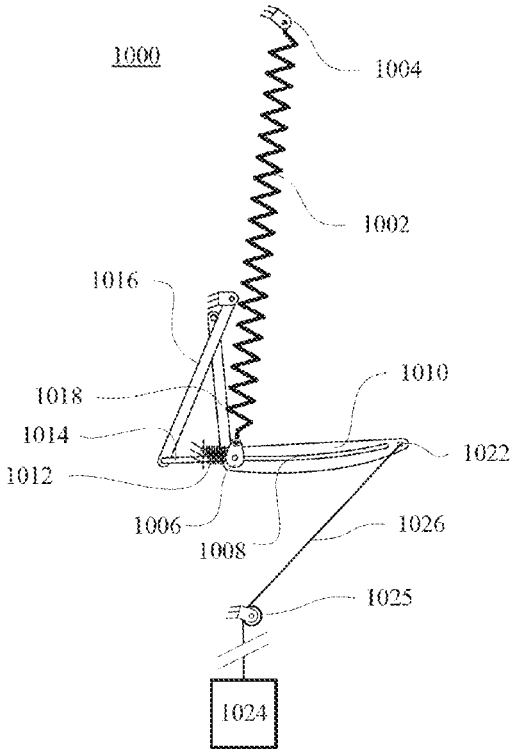

FIG. 10 is a pictorial representation of a force engine 1000 in accordance with another illustrative embodiment. The force engine 1000 illustrates another configuration. As shown, an energy reservoir 1002 is connected at one end to a base 1004 attached at a ground point. The other end of the energy reservoir 1002 is coupled to a variable member 1006. The variable member 1006 is slidably coupled to slot 1008 defined in a traveling member 1010 and moveable within the slot 1008 during the adjusting mode. For example, the variable member 1006 may connect through the slot 1008 on either side of the traveling member 1010. The variable member 1006 slides along the slot 1008 until it reaches an equilibrium position within the slot. There is a means of pivotally fixing the position of the variable member 1006 within the slot upon transition from adjusting mode to operating mode. Such means could include a compression mechanism configured to couple movement of the variable member 1006 to the traveling member 1010. A pin configured as part of the variable member 1006 and slidably received within the slot 1008 may be configured with a specific geometry or a stop that engages the slot and/or traveling member 1010 by adjusting the position of the pin, rotating the pin, or inserting a separate stop pin.

One end of the variable member 1006 may be coupled to a biasing component 1012. The biasing component is coupled to a ground point on its opposite side for biasing the motion of the variable member 1006 toward a minimum capacity position (i.e., next to or generally adjacent the left side of the traveling member 1010). The shape of the slot 1008 may also be formed so that it biases the variable member 1006 to the minimum position. An arcuate shaped slot may be configured in traveling member 1010; the arcuate shaped slot has an equilibrium position where the horizontal force component switches directions thereby biasing movement of the variable member 1006 toward the minimum or maximum position. Arm 1014 is hingedly coupled to the variable member 1006 and arm 1016. Arm 1016 is hingedly coupled to arm 1014 on one end and a ground point on another end. Arm 1018 is hingedly coupled at one end to the traveling member 1010 and to a ground point at its opposite end. The arm 1018 is coupled to the traveling member 1010 during the adjusting mode. A roller 1019 at the end of arm 1018 is receivable engaged in and acts on the arm 1016 to create a coupling between the traveling member 1010 and the variable member 1006. Displacing the traveling member 1010 a small amount may cause the variable member 1006 to be displaced a large amount. This coupling is only active during the adjusting mode. When transitioning from the adjusting mode, the variable member is uncoupled. Any number of mechanisms may be utilized to couple the displacement of the load 1024 to the displacement of the variable member 1006. In one embodiment, the linkage may utilize a cable 1026 which is attached to the variable member 1006 at one end and the load 1024 or carriage at the other end, and passes over at least one pulley located on the traveling member 1010 similar to FIG. 7. In another embodiment the force engine 1000 may utilize a sheathed cable or Bowden cable configured similar to FIG. 6.

Additionally, the force engines shown in FIGS. 10-14 may be manually adjustable by not including a component for coupling the load 1024 to the variable member 1006. The biasing component 1012 may be excluded to make the adjustment effortless. Biasing may be still included in manually adjustable engines to provide feedback to the user in the form of a force resisting adjustment to the maximum capacity position.

A cable 1026 couples a load point 1022 of the traveling member 1010 to the load 1024 through one or more pulleys including pulley 1025. As previously described, the variable member 1006 may be fixed in position during the operating mode and released to travel along the traveling member 1010 in the adjusting mode. By adjusting the position of the variable member 1006 and corresponding energy reservoir 1002 the energy reservoir may use the adjustable length of a moment arm (i.e., adjusting the distance of the variable member 1006 from the load point 1022) along the traveling member to counterbalance the load 1024 through weight changes.

A constant force output to match the load 1024 may be attained by positioning the pulleys in different places. In many cases, the force output at the load point 1022 is not constant, but by creating a transformation using one or more pulleys, the force output may be changed to exhibit a constant force profile.

Figure 11:
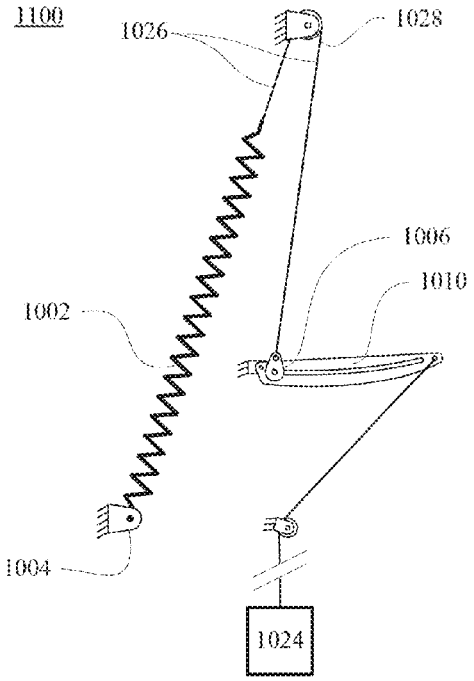

FIG. 11 is a pictorial representation of a force engine 1100 in accordance with another illustrative embodiment. The force engine 1100 includes components similar to those of the force engine 1000 of FIG. 10. The energy reservoir 1002 may be a coil spring, such as a tension spring. The energy reservoir 1002 may be positioned remotely from the main body of the force engine 1100 and in any number of orientations. As a result, a larger or higher capacity energy reservoir 1002 may be utilized outside of an enclosed area or limited operating space in which the force engine is used. Additionally, an enclosure, housing or required operational footprint of the force engine 1100 may be much smaller. As a result, any number of standard springs, zero free length springs, sub zero free length springs, pre-tensioned springs, or very long springs may be incorporated into the force engine's auto-balancing system. Also, there is more flexibility in positioning a ground point, such as a pulley 1028 affixed to a ground point to achieve enhanced performance.

The energy reservoir is connected to the base 1004 at one end and couple to a cable 1026 at another end. The cable 1026 may be routed through one or more pulleys including a routing pulley 1028 to redirect and carry the force applied by the energy reservoir 1002 through the cable 1026 to, for example, the traveling member 1010.

Figure 12:
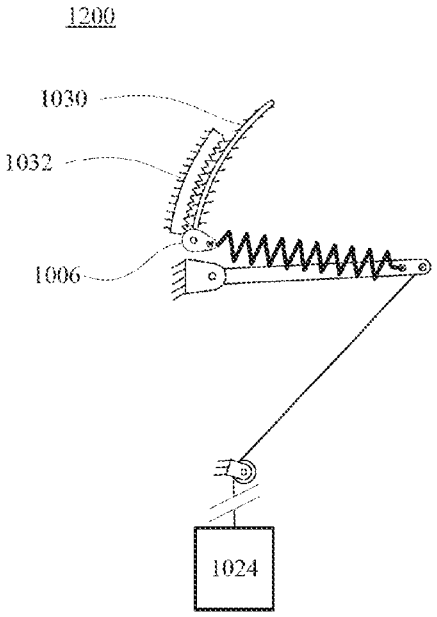

Turning now to FIG. 12, FIG. 12 illustrates a force engine 1200 according to another embodiment. The force engine 1200 further illustrates a combination of the previous embodiments. In an operating mode, the variable member 1006 may slide along a path 1030 and may be fixed in position against a cogged rack 1032 using a release, latch, or pawl as previously disclosed. Furthermore any number of means for coupling the variable member to the load 1024 may be used. Any of the previously describe components and means of biasing the variable member to the minimum position may also be utilized including using a biasing component or biasing the path of the spring along the path.

Figure 13:
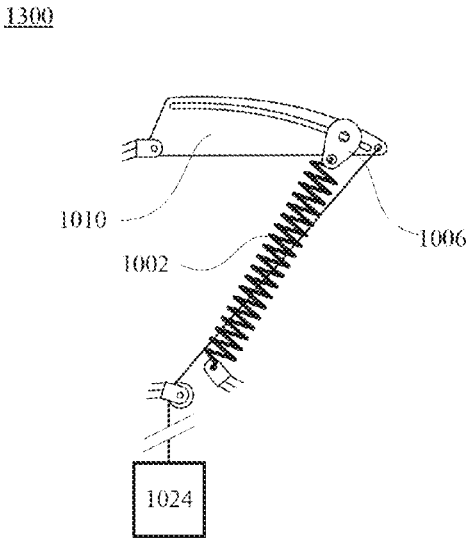

FIG. 13 illustrates a force engine 1300. By placing the energy reservoir 1002 below the traveling member 1010, the overall size and resulting operational footprint of the force engine 1300 may be reduced. The previously described embodiments of the force engines may also be configured as shown in FIG. 13. In another embodiment, automatic adjustment is achieved utilizing the systems and components for fixing the variable member's 1006 position relative to the traveling member 1010 and releasing the variable member 1006 in the different modes. Similarly, different techniques for biasing the variable member to the minimum capacity position may be utilized.

Figure 14:
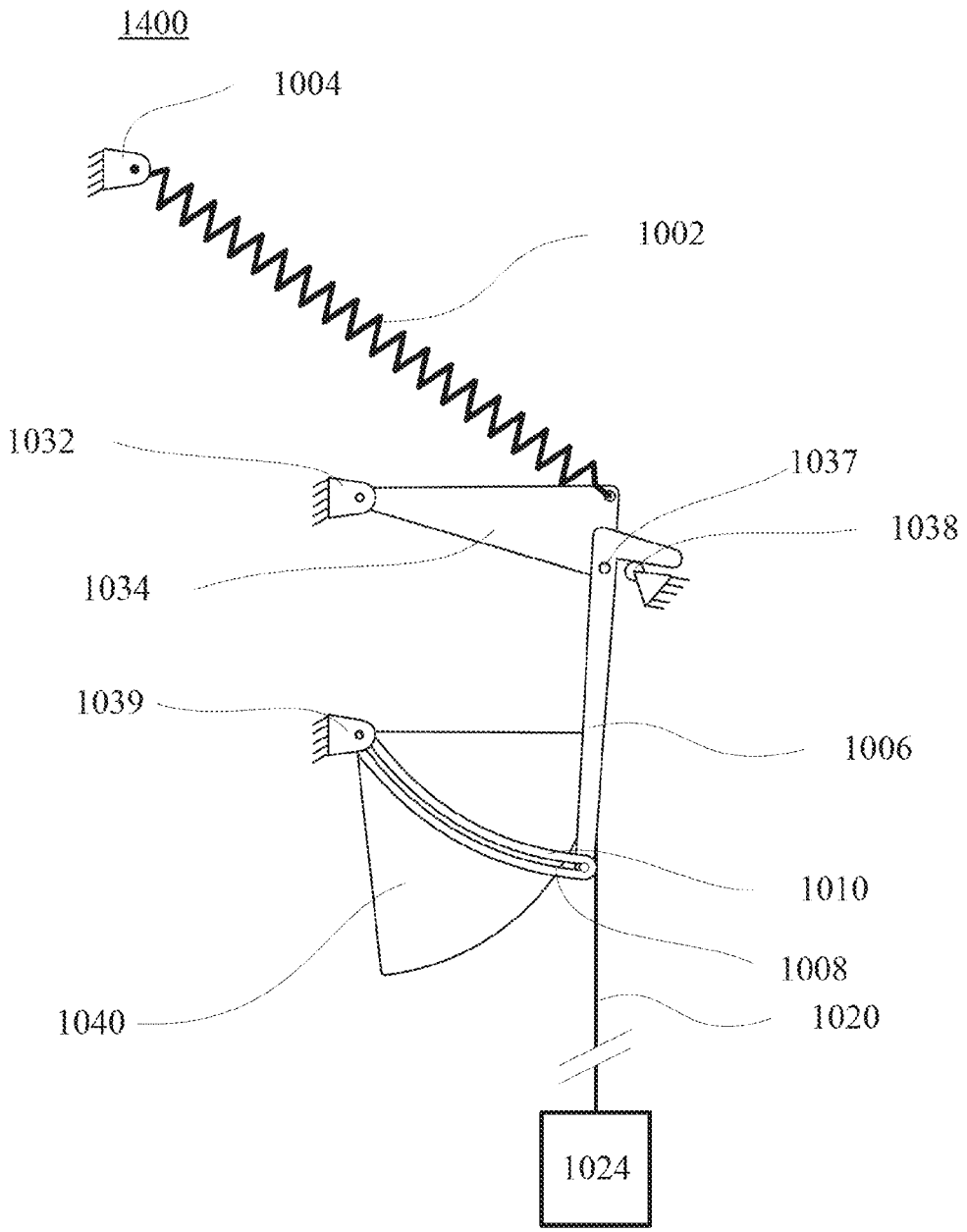

Turning now to FIG. 14, FIG. 14 illustrates a force engine 1400 in accordance with another illustrative embodiment. The force engine 1400 may include many of the components of the previous embodiments. This embodiment employs an additional linkage between the energy reservoir 1002 and the traveling member 1010 which provides a kinematic transformation that enables enhanced performance and consistent application of the balancing forces. One end of the energy reservoir 1002 is coupled to the base 1004 attached to a ground point. The other end of the energy reservoir 1002 is coupled to a torque arm 1034. The torque arm 1034 is hingedly coupled to a base 1036 attached to a ground point at one end and hingedly coupled to the energy reservoir 1002 and the variable member 1006 on opposing sides at or near the opposing end. In one embodiment, the variable member 1006 is shaped like a backwards seven, similar to an L-bracket. A roller 1038 is connected to a ground point and may be utilized to provide a stop and allow free rotation of the variable member 1006 about a pivot point 1037 connecting the torque arm 1036 to the variable member 1006 during the operating mode.

Another end of the variable member 1006 is slidably coupled to the traveling member 1010 that also defines the slot 1008 operable during the adjusting mode. The end of the traveling member 1010 may be hingedly fixed in the slot 1008 during the operating mode. The traveling member 1010 is fixedly connected to a constant radius cam 1040 (e.g., a quarter of a round shaped cam). Another end of the traveling member 1010 is hingedly connected to a base 1039 that is connected to a ground point. The cam 1040 provides a constant transformation from the torque of the traveling member 1010 to the lifting force of the cable and also ensures that the load 1024 is always lifted straight up and down. Other cam shapes may be used, such as egg-shaped, ellipse, eccentric, hexagonal, snail, or the like for controlling the torque transformation to meet a specific performance requirement for the force engine 1400. In another embodiment, the load 1024 may be connected through a cable that is attached directly to the traveling member 1010 and routed through pulleys to another location, or to provide a transformation to improve the performance of the force engine 1400. As the variable member 1006 adjust to a changing weight of the load 1024 by sliding along the slot 1008, the variable member 1006 slides generally up and down and pivots against the roller 1038. The variable member 1006 is fixed to the traveling member 1010 during the operating mode. For example, an increased load 1024 causes the variable member 1006 to rotate around the roller 1038 and pull on the torque arm 1034. As a result, the variable member 1006 rotates clockwise toward a maximum capacity position.

In the embodiment of FIG. 14, the variable member 1006 is biased toward the minimum position by shaping the slot 1008 so that the energy reservoir 1002 is displaced slightly as the variable member rotates counterclockwise toward the maximum capacity position. In another embodiment, the slot 1008 is shaped so that the energy state of the variable member 1006 does not change as the variable member 1006 is displaced toward the maximum capacity position. A separate biasing component attached from a pivot point 1039 to the end of the variable member 1010 may bias the variable member 1010 toward a minimum capacity position.

In another embodiment, the cable 1020 connected to the load 1024 is routed over pulleys on the traveling member 1010 and on the cam 1034 and attached to the variable member 1006 to achieve the coupling of the load to the variable member 1010. In this example, the roller 1038 is not used. In another embodiment, a sheathed cable or Bowden cable may be utilized to achieve the coupling of the variable member 1010 to the load as described in the included framework. In another embodiment the traveling member 1010 is located above the torque arm 1034 instead of below it.

Figure 15:
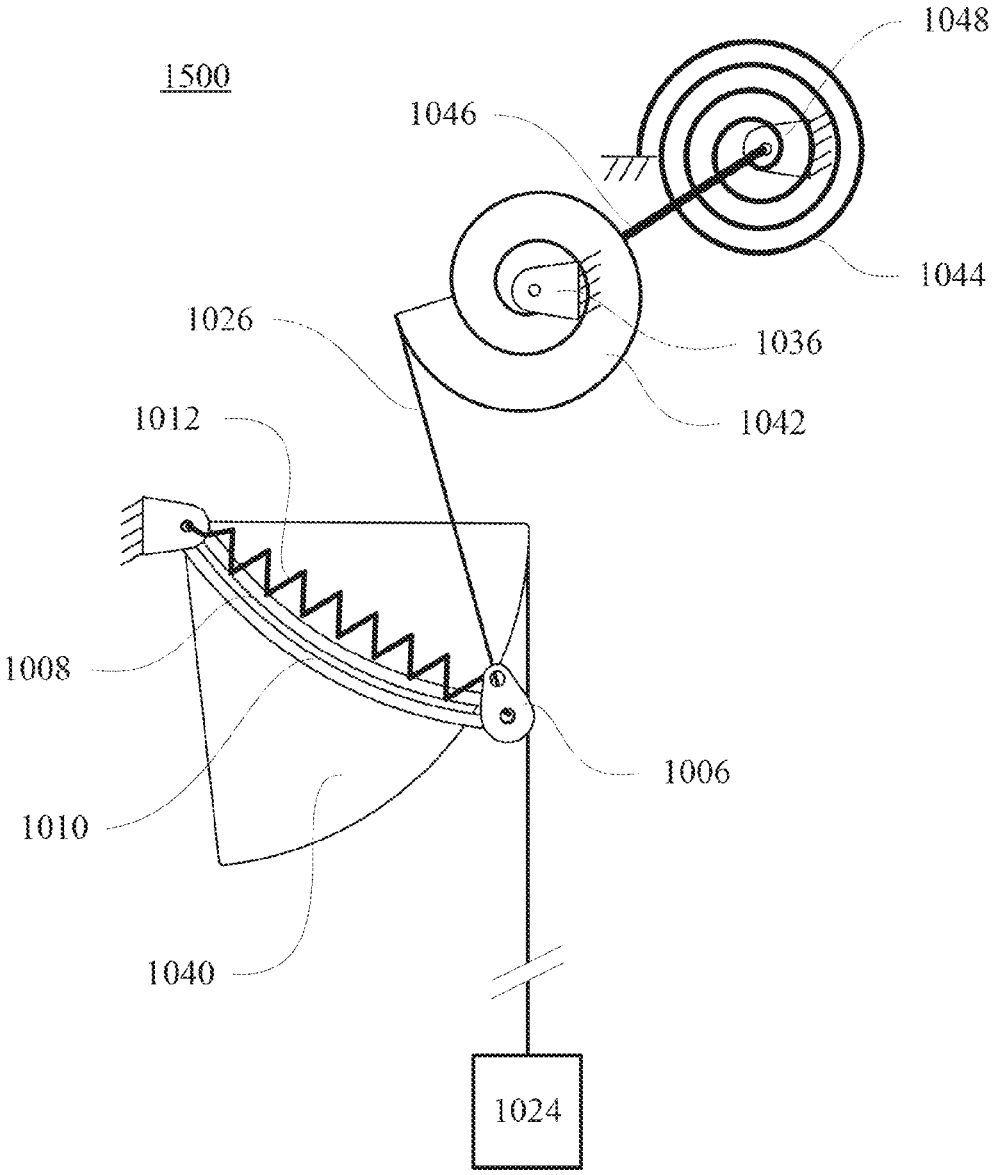

Turning now to FIG. 15, FIG. 15 illustrates a force engine 1500 in accordance with another illustrative embodiment. Similar methods of biasing the variable member to the minimum position, and coupling the variable member 1006 to the load may be used with this configuration. Force engine 1500 provides another example of a means for transforming the force-displacement characteristics of the energy reservoir before interaction with the traveling member 1010 to achieve better performance. As with the previous embodiments, the variable member 1006 is slidably attached to the slot 1008 of the traveling member 1010. The variable member 1006 is connected to the biasing component 1012. The traveling member 1010 is fixedly coupled to the cam 1040. The cam 1040 is coupled to the load 1024. The variable member 1006 is coupled to a pulley or a cam of varying radius by a cable 1026. In one embodiment this is a spiral pulley 1042 or cam. The spiral pulley 1042 rotates about base 1036 which is connected to a ground source. The spiral pulley 1042 is attached to a torsional spring 1044 by a rotating shaft 1046.

The torsional spring 1044 is connected to the base 1048 and rotates counterclockwise when the torsional spring 1044 is being compressed or storing energy from the spiral pulley 1042 through the rotating shaft 1046 and clockwise when it is releasing energy to the spiral pulley 1042 through the rotating shaft 1046. The torsional spring 1044 acts as the energy reservoir. In one embodiment, the torsional spring 1044 is similar to those utilized for garage doors and other commercial applications. In another embodiment, the torsional spring 1044 may be replaced by a tension spring, attached to ground at one end, and a cable at the other end. The cable 1026 may then be attached to a rotating pulley on the shaft 1046. The spiral pulley 1036 or cam assists in transforming the linear nature of the torsional spring 1044 to a constant force profile.

The torsional spring 1044 provides a counterbalance force to the traveling member that corresponds to the position of the variable member 1006 that may be fixed anywhere along the slot 1008 of the traveling member 1010. The force engine 1500 may be configured to allow the torsion spring 1044 (and possibly the spiral pulley 1042) to be mounted remotely from the traveling member 1010 and interconnected components to reduce the local size or space of its installed or operational footprint while maximizing the potential capacity. In various embodiments, the force engine 1500 and any incorporating system do not require occupation of a footprint on the floor or ground.

Figure 16:
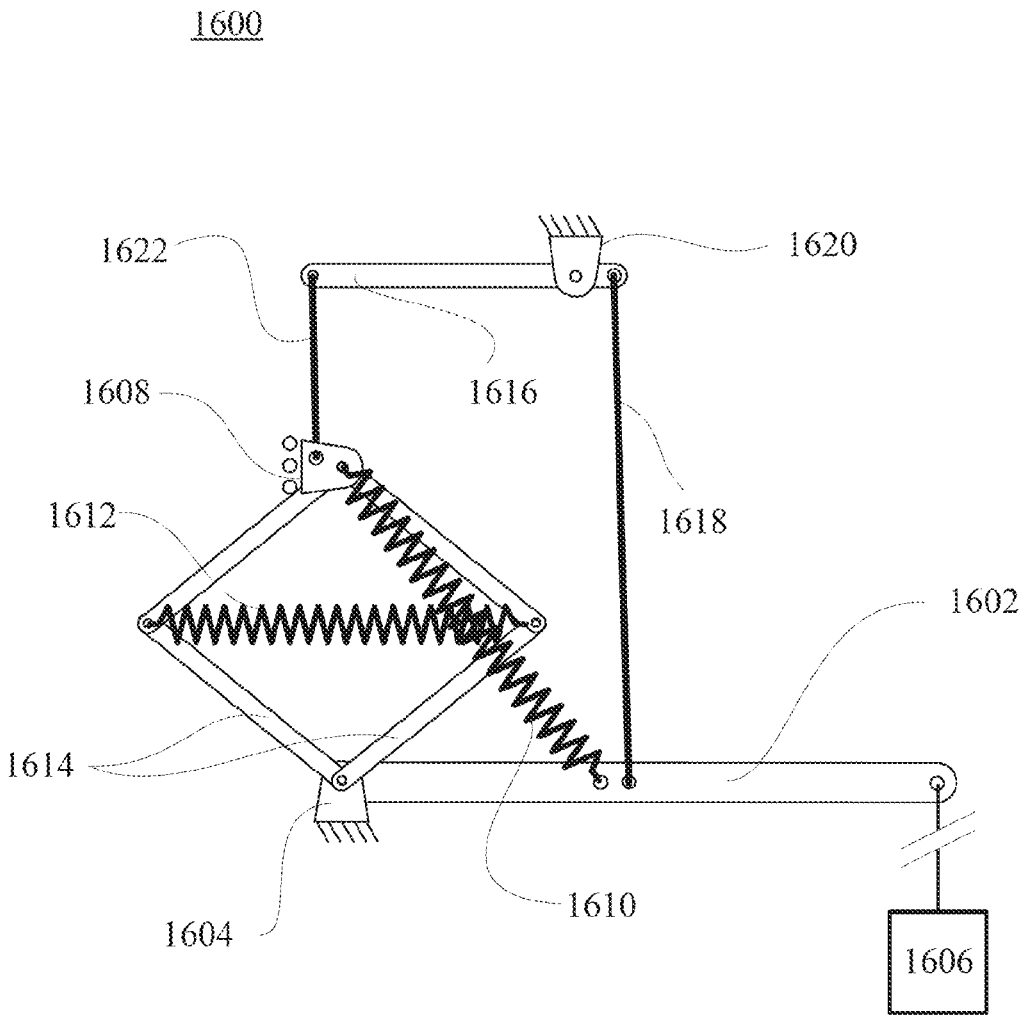

FIG. 16 illustrates a force engine 1600. In this embodiment, a traveling member 1602 is hingedly attached to a base 1604 on one end and a load 1606, either directly or indirectly at opposite ends. An energy reservoir 1610 connects to the traveling member 1602 at one end and to a variable member 1608 at the other. During adjust mode, the variable member 1608 may be moved vertically. Displacing the variable member 1608 upward increases the lifting force of the force engine 1600. A slide, guide, rail, groove, sleeve, slot, or other means may be operable to control the direction of the movement of the variable member 1608, such as slidably in the vertical direction. However, this displacement requires a large input of energy. A second energy reservoir 1612 is used to provide the energy needed for this adjustment. A parallelogram linkage 1614 is hingedly connected to the variable member 1608 at one end and the base 1604 at the other end. The energy reservoir 1610 connects generally between mid-points of the parallelogram linkage 1614. The spring characteristics (e.g., Young's modulus, spring wire diameter, free length, number of active windings, Poisson ratio, spring outer diameter, etc.) may be selected so that the variable member 1608 may be adjusted with little or no change in the energy state of the energy reservoirs 1610 and 1612. In one embodiment, the energy reservoirs 1610 and 1612 are tension springs.

To accomplish automatic adjustment during the adjusting mode, a linkage is used to couple displacement of the load 1606 to displacement of the variable member 1608 with the variable member 1608 being biased toward the minimum position. In one embodiment, the coupling is accomplished by connecting traveling member 1602 to an end of the amplifying link 1616 (i.e., a lever arm) by a link 1618. The amplifying link 1616 hingedly rotates about the base 1620. The other end of the amplifying link is connected to a variable member 1608 by a link 1622. A small downward displacement of the load 1606 results in a large upward displacement in the variable member 1608. A variety of other means of coupling the variable member 1608 to the load 1606 may be used as previously described.

In one embodiment, biasing of the variable member toward the minimum capacity position is accomplished by adding a biasing element attached to the variable member, parallelogram linkage, or coupling linkage to bias the variable member toward the minimum capacity position. In another embodiment, the spring rates of the energy reservoirs 1610 and 1612 are selected so that the downward force of the main energy reservoir 1610 on the variable member 1608 is slightly greater than the upward force acting on the variable member 1608 from the parallelogram linkage 1614 due to energy reservoir 1612. In another embodiment, linkage lengths and the path of the variable member are changed to accomplish a biasing effect of the variable member toward a minimum position.

As with other embodiments, the variable member 1608 may be fixed in position during the operating mode and released during the adjust mode utilizing the systems and methods similar to those previously described. The traveling member 1602, or load 1606 may also be coupled to the variable member during adjust mode, and decoupled from the variable member during operating mode.

The load 1606 is either directly attached to the traveling member 1602, or through some additional linkage. In one embodiment, the load 1606 is applied to a second rotating linkage which is pivotally connected to the free end of the traveling member at a first end, and vertically slidably constrained to ground at the other end, so that the load 1606 displaces vertically.

Figure 17:
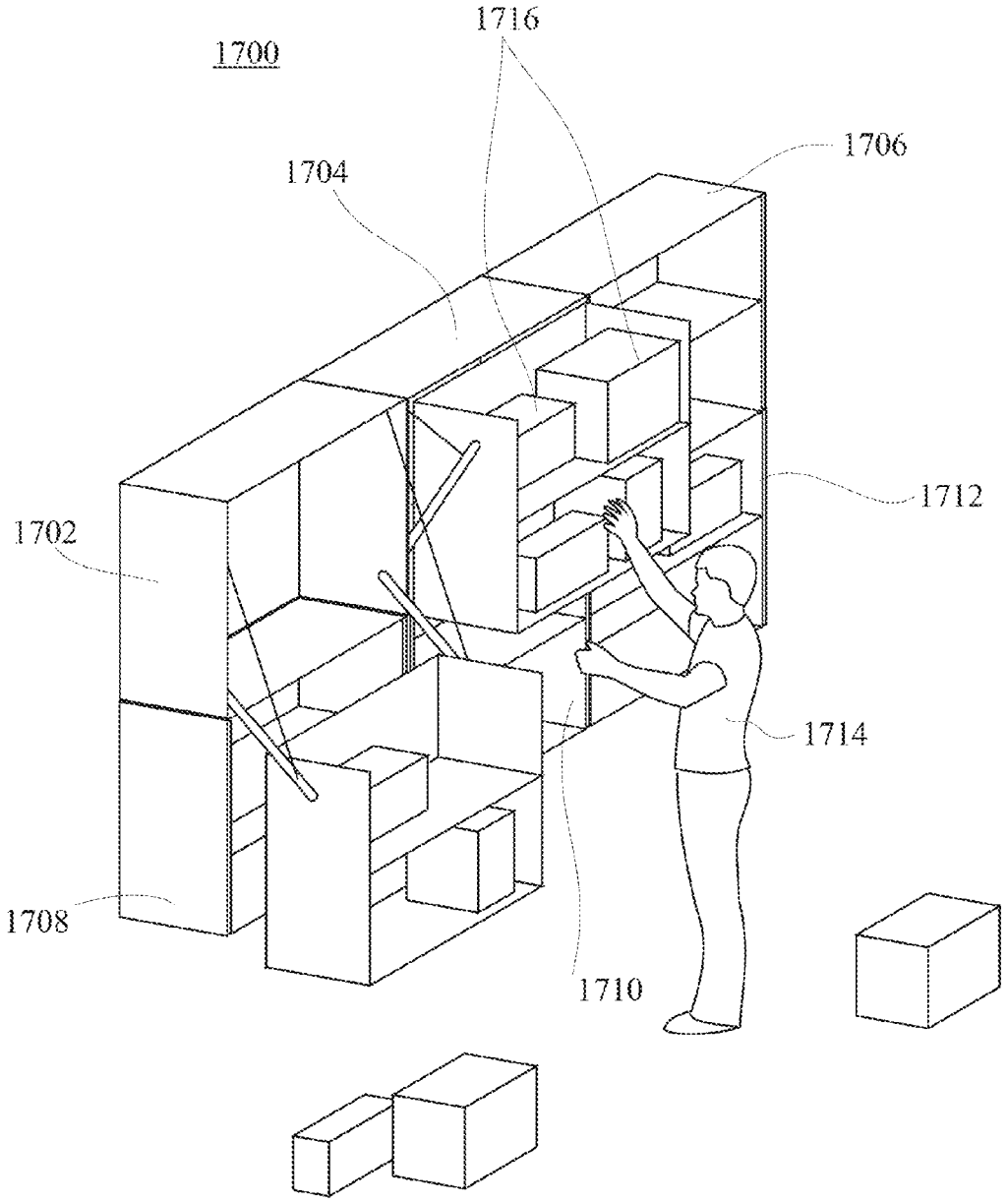
FIG. 17 is a pictorial representation of a storage environment in accordance with an illustrative embodiment.

FIG. 17 is a pictorial representation of a storage environment 1700 including auto-balancing cabinets 1702, 1704, and 1706 in accordance with an illustrative embodiment. The storage environment 1700 of FIG. 17 illustrates one configuration of multiple auto-balancing cabinets 1702, 1704, and 1706 as well as cabinets 1708, 1710, and 1712. The cabinets 1708, 1710, and 1712 are standard cabinets that are affixed to a wall and do not include the auto-adjust. The number of horizontal or vertical cabinets comprising the embodiment of the cabinet array is configurable by the user's needs or application. Cabinets 1708, 1710, and 1712 may be replaced by auto-balancing cabinets that may be adjacently positioned as shown. As shown, the auto-balancing cabinets 1702, 1704, and 1706 may be positioned adjacent to one another while still maintaining functionality. As an example, a user 1714 may access the auto-balancing cabinets 1704 loaded with goods 1716 without touching, interfering with, being impeded by, or damaging the cabinet 1710 below or cabinets 1702 and 1706 to the sides of the auto-balancing cabinet 1704. In particular, the auto-balancing cabinet 1704 may lift the goods 1716 out and over the existing cabinetry or objects below when lowering the goods 1716, such as the cabinet 1710. The auto-balancing cabinets 1702, 1704, and 1706 may utilize any of the previously described force engines to drive the motion and balancing force provided to the user 1714 in lowering and lifting the goods 1716.

The storage environment 1700 as shown reduces the footprint required to store goods. In one embodiment, the auto-balancing cabinets 1702, 1704, and 1706 may lift a load of 150 lbs. over 30 inches of vertical travel with minimal input from the user. The minimum and maximum weight and vertical travel ranges are a parameter of configuration that may be customized for each user application and during manufacturing and assembly. The auto-balancing cabinets 1702, 1704, and 1706 may be configured to automatically configure themselves for the weight placed in the storage bin and then adjust the counterbalance force provided by the auto-balancing or manual force engine to supply the energy needed to substantially lift or lower the auto-balancing cabinets 1702, 1704, and 1706.

The auto-balancing cabinets 1702, 1704, and 1706 provide many advantages. For example, the auto-balancing cabinets 1702, 1704, and 1706 may function as both a scale and energy storage device, which stores sufficient energy to lift and lower a maximum load through a given displacement that include both horizontal and vertical components as shown by the auto balancing cabinet 1704 that is in motion. After configuring itself to the load or during the adjusting process, the auto-balancing engine is transformed to provide the amount of energy required to assist in substantially lifting or lowering the load. In particular, the force engines of each of the auto-balancing cabinets 1702, 1704, and 1706 balance the weight of the load when a carriage is lowered and provide a substantial portion of the lifting force required to raise the carriage. For example, the auto-balancing cabinets 1702, 1704, and 1706 may adjust between applying a minimum force and a maximum force corresponding to a specified maximum load and a minimum load (i.e. empty), respectively. Any of the previously described force engines may be utilized by the auto-balancing cabinets 1702, 1704, and 1706.

Auto-balancing cabinet 1702 is shown as fully extended in a load/unload position. The auto-balancing cabinet 1702 extends past the cabinet 1708 without touching, damaging, or otherwise interfering with the cabinet 1708. The auto-balancing cabinet 1702 is shown in an adjusting mode during which the user 1714 may add or remove goods thereby changing the load. The auto-balancing cabinet 1702 adjusts to the load (whether increasing or decreasing) so that the user 1714 provides minimal user force to raise and subsequently lower the carriage of the auto-balancing cabinet. As illustrated, the goods 1716 are much more accessible when the auto-balancing cabinet 1702 is fully extended.

The auto-balancing cabinet 1704 is shown in an operating mode during which the auto-balancing cabinet 1704 is providing a counterbalancing force so that the user 1714 may provide minimal force to raise or lower the goods 1716 to a more accessible height, such as that shown for auto-balancing cabinet 1702.

In an alternative embodiment, the auto-balancing cabinets may also be operable to lift goods to users by positioning the force engines and lifting components of the auto-balancing cabinets. As shown the multiple auto-balancing cabinets 1702, 1704, and 1706 and cabinets 1708, 1710, and 1712 may be aligned or stacked horizontally and vertically without interfering with the operation of each independent unit.

Figure 18:
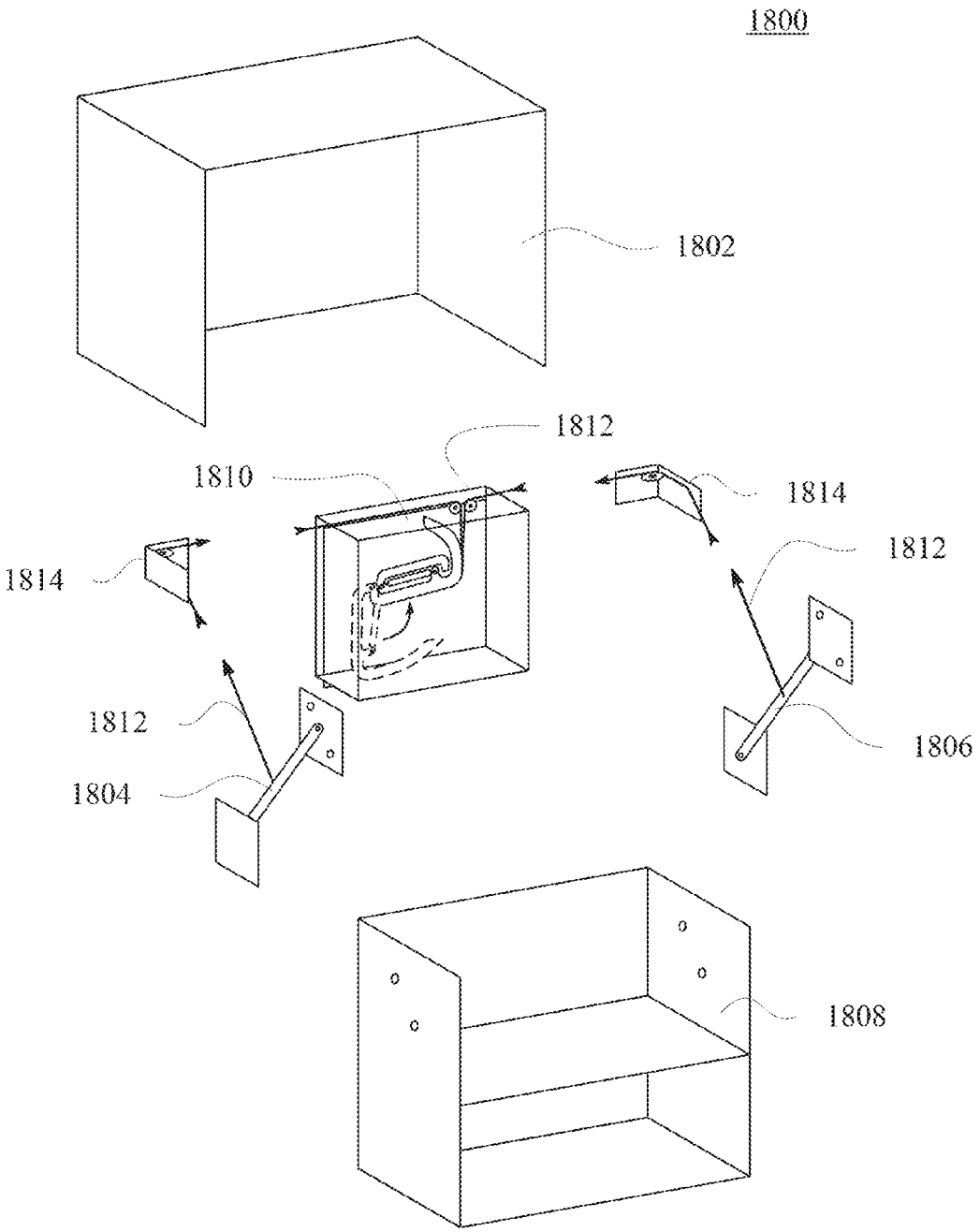
FIG. 18 is an exploded view of systems of an auto-balancing cabinet 1800 in accordance with an illustrative embodiment.

FIG. 18 is an exploded view of systems of an auto-balancing cabinet 1800 in accordance with an illustrative embodiment. The auto-balancing cabinet 1800 is one implementation of the auto-balancing cabinets 1702, 1704, and 1706 of FIG. 1700. The auto-balancing cabinet 1800 may be assembled in any number of configurations to meet the needs of a user and environmental conditions of a storage environment. In particular, the auto-balancing cabinet 1800 may include a number of systems that are interchangeable for different configurations of the described auto-balancing cabinets and storage systems. For example, the auto-balancing cabinet 1800 utilizes a pulley and cable configuration. The auto-balancing cabinet 1800 may be used to access and utilize out-of-reach storage areas, such as walls of garages, small apartments with limited floor space, and other similar structures. The auto-balancing cabinet 1800 may be particularly useful for individuals, such as persons with disabilities, children, and shorter individuals that are unable to reach or lift objects to high places. An alternative embodiment may be utilized to lift goods from a lower position, such as near the ground, up to a level more easily accessed by a user. The force engine may be positioned to provide the lift forces for lift arms that raise the goods or load. The adjusting mode similarly occurs during a fully-extended or lifted position (rather than a lowered position).

In one embodiment, the auto-balancing cabinet 1800 includes a case 1802. The case 1802 is a frame enclosing the mechanical components of the auto-balancing cabinet 1800 used to counter-balance the stored goods and assist in lifting and lowering the goods. The case or a wall or other structure to which the case is connected or attached may act as a ground to many of the components of the auto-balancing cabinet. The case 1802 is secured to a support structure, such as a wall, metal framework, studs or other similar support elements. Various embodiments do not utilize the case 1802 to further reduce the materials and space required for the auto-balancing cabinet 1800. The case 1802 may include mounting holes or slots, rails, or other components known in the art on a back, top, or support-facing side for allowing the case 1802 to be connected to a wall or support to secure the entire auto-balancing cabinet 1800.

The auto-balancing cabinet 1800 further includes a lift guide system for guiding the carriage. In one embodiment this includes lift arms 1804 and 1806. The lift arms 1804 and 1806 are connected to a carriage 1808. The lift arms 1804 and 1806 lift and raise the carriage 1808 to make goods stored in the carriage 1808 more accessible to a user. The lift arms 1804 and 1806 may utilize any number of configurations as is further described in FIG. 19. The lift arms 1804 and 1806 may be configured to include a four-bar linkage or any of the embodiments of FIG. 19. In another configuration the carriage is guided up and down by rollers. In one embodiment the lift arms 1804 may attach to the side of the carriage 1808. In another embodiment, the lift arms 1804 may attach to the back of the 1808 carriage.

The carriage 1808 stores goods during operation of the auto-balancing cabinet 1800. The carriage 1808 may be any combination of shelves, drawers, cupboards, and racks. The engine or engine lift arm configuration may be designed to provide automatic balancing to existing cabinetry. In one embodiment, the carriage 1808 is user customizable using clips, holes, dowels, fasteners, rails, and other similar elements known in the art. The carriage 1808 may also be configured to include or incorporate nested containers, and other proprietary storage systems or components. The carriage 1808 may include a handle or grip for facilitating the user in pulling down or pushing up (or pushing down and pulling up) the carriage 1808. In one embodiment, the carriage may be a cabinet with prefabricated sides that allows the cabinet to expand in a width and height direction for customized installation and to reduce manufacturing costs for the auto-balancing cabinet.

The lift arms 1804 and 1806 are driven by a force engine 1810. The force engine 1810 may include any number of configurations based on the needs of the user and available storage environment. The force engine 1810 provides the forces to the lift arms 1804 and 1806 for lifting the carriage 1808. The force engine 1810 may utilize one or more energy reservoirs. The most common types of energy storage reservoirs and corresponding force engines are masses acting against gravity, springs of elastically deforming solids that are deflected, and springs made by compressing gasses.

For example, the auto-balancing cabinet 1800 may utilize an auto-adjust force engine, a manual adjust force engine, a fixed balancing force engine using an energy reservoir, an electric engine, and a hydraulic engine. The auto-balancing cabinets of the illustrative embodiments are configured, such that any of the described force engines may be utilized interchangeably without special configuration of the auto-balancing cabinet.

In one embodiment, the force engine 1810 provides the balancing force through cables 1812 and pulleys 1814. Alternatively, the auto-balancing cabinet 1800 may utilize belts, chains, levers, rods, linkages, or other components for transferring forces throughout the auto-balancing cabinet 1800 to assist the user in lowering and raising the carriage

1808 to access the stored goods. The pulleys 1814 are configured to directionally transfer the forces through the cables 1812. In one embodiment, the cables 1812 are directly connected to the lift arms 1804 and 1806 for lowering and raising the lift arms 1804 as well as stabilizing the lift arms 1804 and 1806 and carriage. The manner in which the cables 1812 and pulleys 1814 are coupled to the force engine 1810 and lift arms 1804 and 1806 may provide a force-displacement transformation that allows the carriage 1808 to be used over a wider range of vertical and horizontal motion with improved performance.

In another embodiment, the carriage 1808 is provided with a balancing force from the engine with chains, levers, rods, linkages, or other components for transferring forces. The carriage 1808 may be guided up and down using rollers, wheels, linear glides, slides, or tracks.

In one embodiment, the force engine 1810, lift arms 1804 and 1806, cables 1812 and pulleys 1814 may be integrated with the case 1802 so that the components are more easily installed. In addition, the auto-balancing cabinet 1800 may be a modular unit that is easily installed. The case 1802 may also include doors for opening and accessing the carriage 1808.

In another embodiment, one or more force engines 1810 may be directly integrated or connected to the lift arms 1804 and 1806. For example, an engine and lift arm may be incorporated into either side of the auto-balancing cabinet 1800. Each engine and lift arm may be configured to operate independently or one may be a master mechanism with the other side being a slave lift mechanism. The movement of the carriage 1808 may be synchronized between a single force engine 1810 or multiple engines and integrated lift arms.

In another embodiment, the engine and lift arms may all be located on the back of the carriage. In one embodiment, force engines 1810 and lift arms 1804 and 1806 can be affixed to existing cabinetry, providing the counterbalance or counterweight methods by utilizing users existing cabinetry. For example, the force engine may be integrated with a rear portion of the cabinet, the lift arms and other linkage may be connected to or integrated with the sides, or back of the cabinet, and the carriage may be configured to extend from the cabinet for access by a user.

Figure 19:
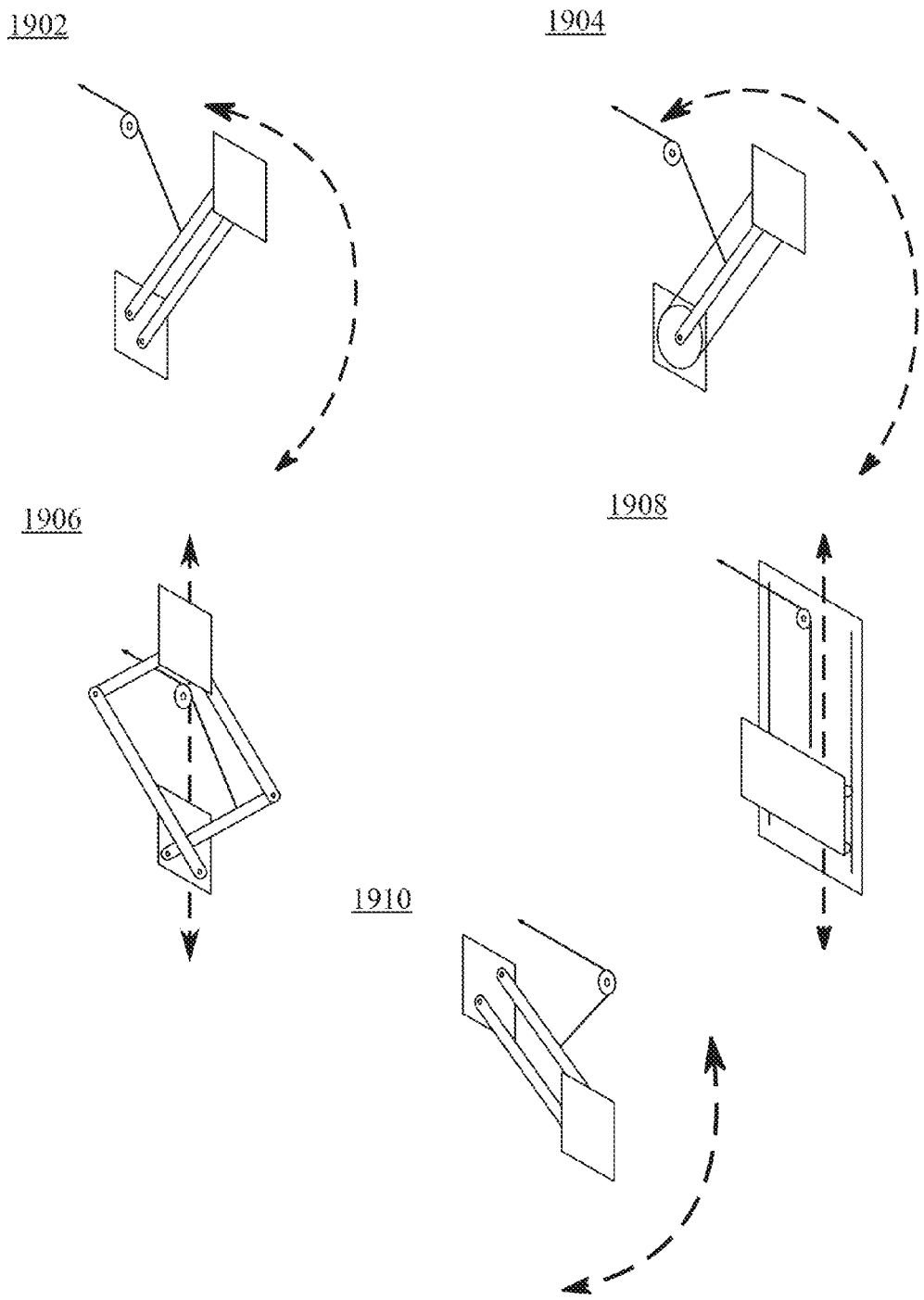
FIG. 19 is a pictorial representation of lift arm systems for the auto-balancing cabinet in accordance with illustrative embodiments.

FIG. 19 is a pictorial representation of lift arm systems for the auto-balancing cabinet in accordance with illustrative embodiments. In various embodiments, the auto-balancing cabinet may utilize lift arms 1902, 1904, 1906, pulley system 1908, or lift arms 1910.

In addition to the shown pulley and cable used provide the balancing force to the lift mechanism, lift arms 1902, 1904, and 1910 may utilize a four-bar linkage, two-bar linkage, double cable, or other means of stabilizing the carriage as it displaced. The angle and direction that the lift arm systems 1902-1910 extend the carriage depend upon each of the respective configurations. In one embodiment, the lift arm 1902 is not configured to have an auto-adjust system directly below because the carriage would interfere or hit the cabinet below. The lift arm system 1902 may be used to accomplish a displacement path that drops out and down. The lift arm system 1904 is utilized over a greater rotational range so that the carriage will displace out and over content or other cabinetry located below it before displacing downward.

Lift arms 1906 and 1908 are operable to lift the carriage vertically. Lift arm 1906 utilizes a scissor configuration for the linkage arms. Lift system 1906 displaces directly downward by using a lift arm attached to a base plate, with a second lift arm inverted and attached to the first lift arm. Pulley system 1908 may be utilized to lower and raise the carriage vertically utilizing a pulley and cable configuration. Pulley system 1908 may additionally include slides, wheels, rails, or other components to secure or stabilize the carriage while being raised or lowered. This provides the same kinematic transformation as a rotating lift arm but displaces directly downward. Lift system 1908 provides a vertical displacement with no kinematic transformation.

The lift arm 1910 is operable to assist a user in lifting a carriage from a lower position to a higher position. For example, some users have difficulty bending or reaching down very far. A handle connected to the carriage may allow a user to lift a carriage and stored goods up to an accessible height using very little force before pushing the carriage back into a rest or storage position below.

Figure 20:
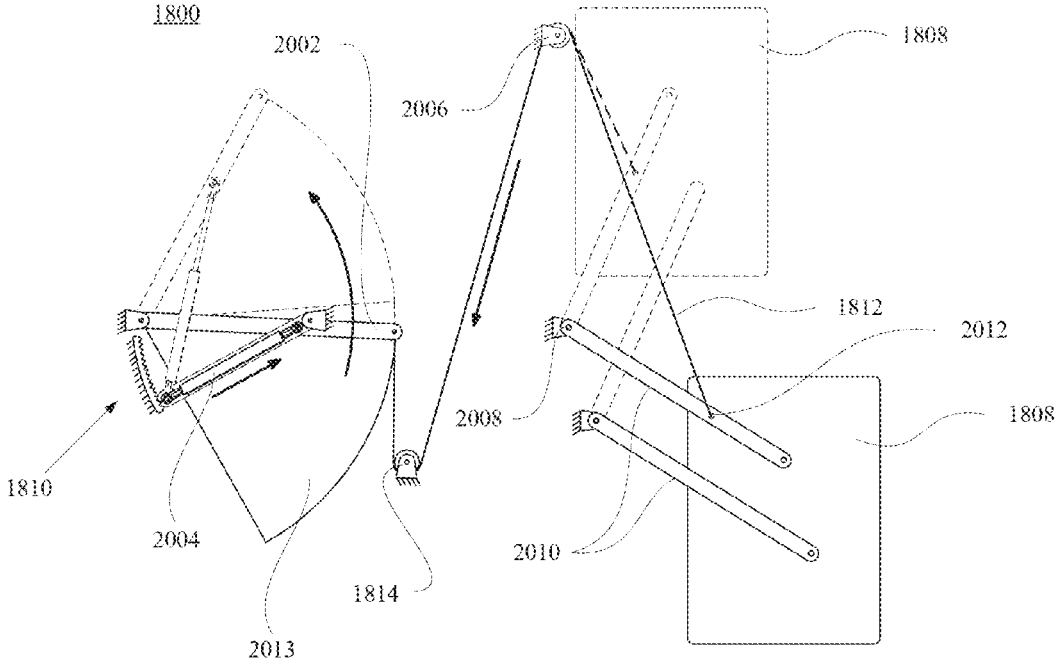
FIG. 20 is a dimensional view of portions of the auto-balancing cabinet of FIG. 18 in accordance with an illustrative embodiment.

FIG. 20 is a single dimensional view of portions of the auto-balancing cabinet 1800 of FIG. 18 in accordance with an illustrative embodiment. FIG. 20 shows a flattened view of portions of the auto-balancing cabinet 1800 for better explaining the interconnections. Referring now to FIGS. 18 and 20, a traveling member 2002 is connected to the cable 1812. The cable 1812 runs over a pulley 1814 and cam 2013 coupled to the traveling member. The cam may be of constant radius, or may vary in radius. The traveling member 2002 traces out an arced path when raising and lowering the carriage 1808. Positioning the engine 1810 at the back or top of the auto-balancing cabinet 1800 provides a greater range of motion with less user input required for the traveling member 2002 and for lifting the carriage 1808. The balancing force applied by the gas spring 2004 to the traveling member 2002 is mechanically transferred and redirected through the cable 1812 which may be included on both sides of the auto-balancing cabinet 1800. In one embodiment, the pulleys 1814 and 2006 may include any number of pulleys for translating the force through directional changes that may include one or more corners.

In one embodiment, a lift pulley 2006 is positioned directly above a base 2008 of lift arms 2010. This allows both positive and negative torque to be applied to the lift arms 2010 once the lift arm passes a 90° angle.

The lift force is applied to the carriage 1808 by at least the lift arms 2010 which may be connected to the traveling member 2002 through the cables 1812 and pulleys 1814.

As shown, the mechanical advantage provided by the linkage is negative. When the lift arms 2010 are in a vertical position (90°) pointing toward the pulley 216, the torque is zero. As the lift arms 2010 pass 90° the cable 1812 is taken up again and the torque applied by the auto-balancing cabinet 1800 is negative.

The relative positioning of the base 2008, the lift pulley 2006, and a connection point 2012 may be utilized to establish the mechanical advantage provided by the auto-balancing cabinet 1800. The positioning of the base 2008 of the lift arms 2010 and the connection point 2012 of the cable 1812 to the lift arms 2010 allows the lift arms 2010 to rotate past 90° in order to lift the carriage up and over the space below the case 1802 and auto-balancing cabinet 1800. The connection point of the cable to the lift arms 2010 allows them to pass under the lift pulley 2006. In one embodiment, the lift arms 2010 may be integrated with a cabinet or portion of the auto-balancing cabinet 1800 below. For example, the lift arms 2010 may be integrated with side portions of a lower portion or additional cabinet connected below the auto-balancing cabinet 1800 as further shown in FIG. 21.

Figure 21:
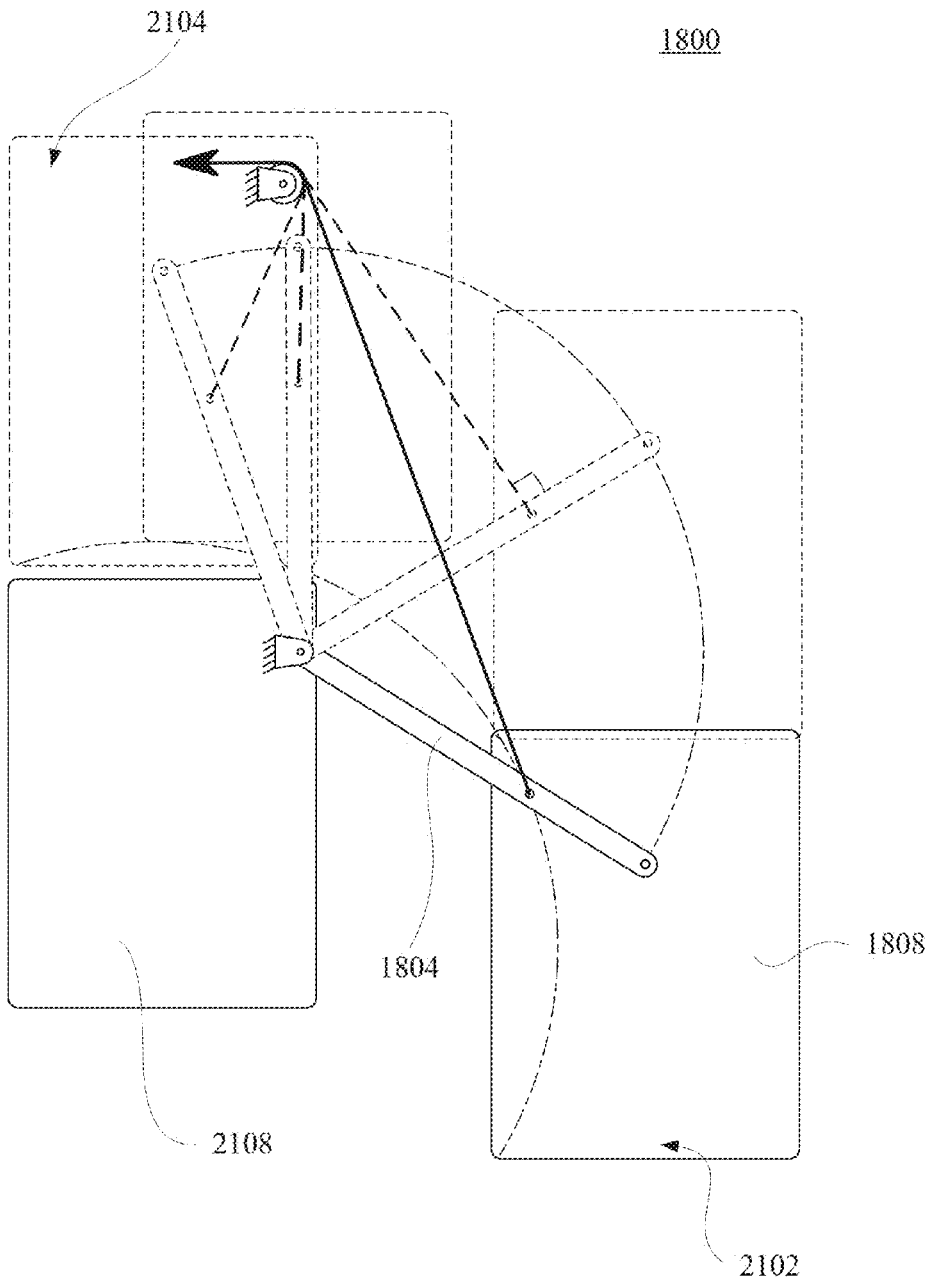
FIG. 21 is a pictorial representation of the auto-balancing cabinet showing a full range of motion in accordance with an illustrative embodiment.

FIG. 21 is a pictorial representation of the auto-balancing cabinet 1800 showing a full range of motion in accordance with an illustrative embodiment. The range of motion shown for the carriage 1808 illustrates one potential displacement path. The carriage 1808 rotates between an adjusting position 2102 (i.e., open and accessible or loading/unloading position) and a stored position 2104 (or stored position). As shown a lift arm 1804 is operable to rotate over an extended range including past a vertical position or 90° angle. The auto-balancing cabinet 1800 is operable to lift the carriage 1808 over the cabinet 2108 without interference. As shown the lift arm 1804 and corresponding components are integrated with the sides of the cabinet 2108.

Figure 22:
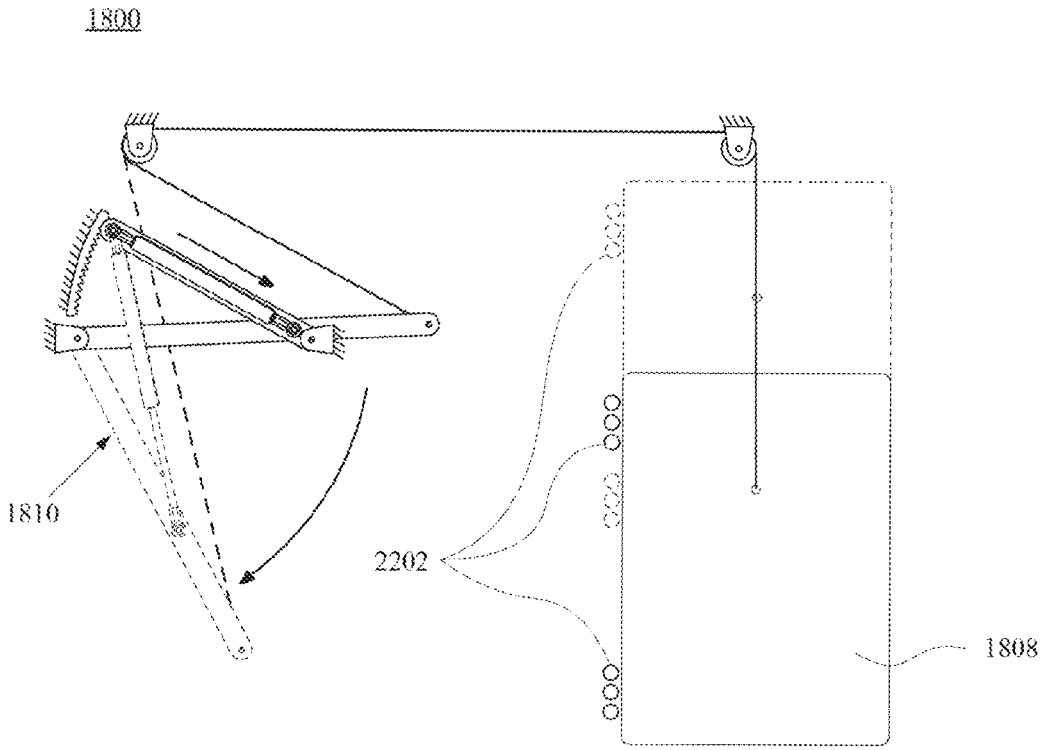
FIG. 22 is a pictorial representation of the auto-balancing cabinet utilizing a vertical range of motion in accordance with an illustrative embodiment.

FIG. 22 is a pictorial representation of the auto-balancing cabinet 1800 utilizing a vertical range of motion in accordance with an illustrative embodiment. The carriage 1808 is configured to be raised and lowered vertically as driven by the force engine 1810. The carriage 1808 may utilize rollers 2202, wheels, tracks, slides, or linear glides to guide and stabilize the carriage 1808 during raising and lowering. As a result, the force engine 1810 may conserve more space and provide a vertical drop-down configuration.

Figure 23:
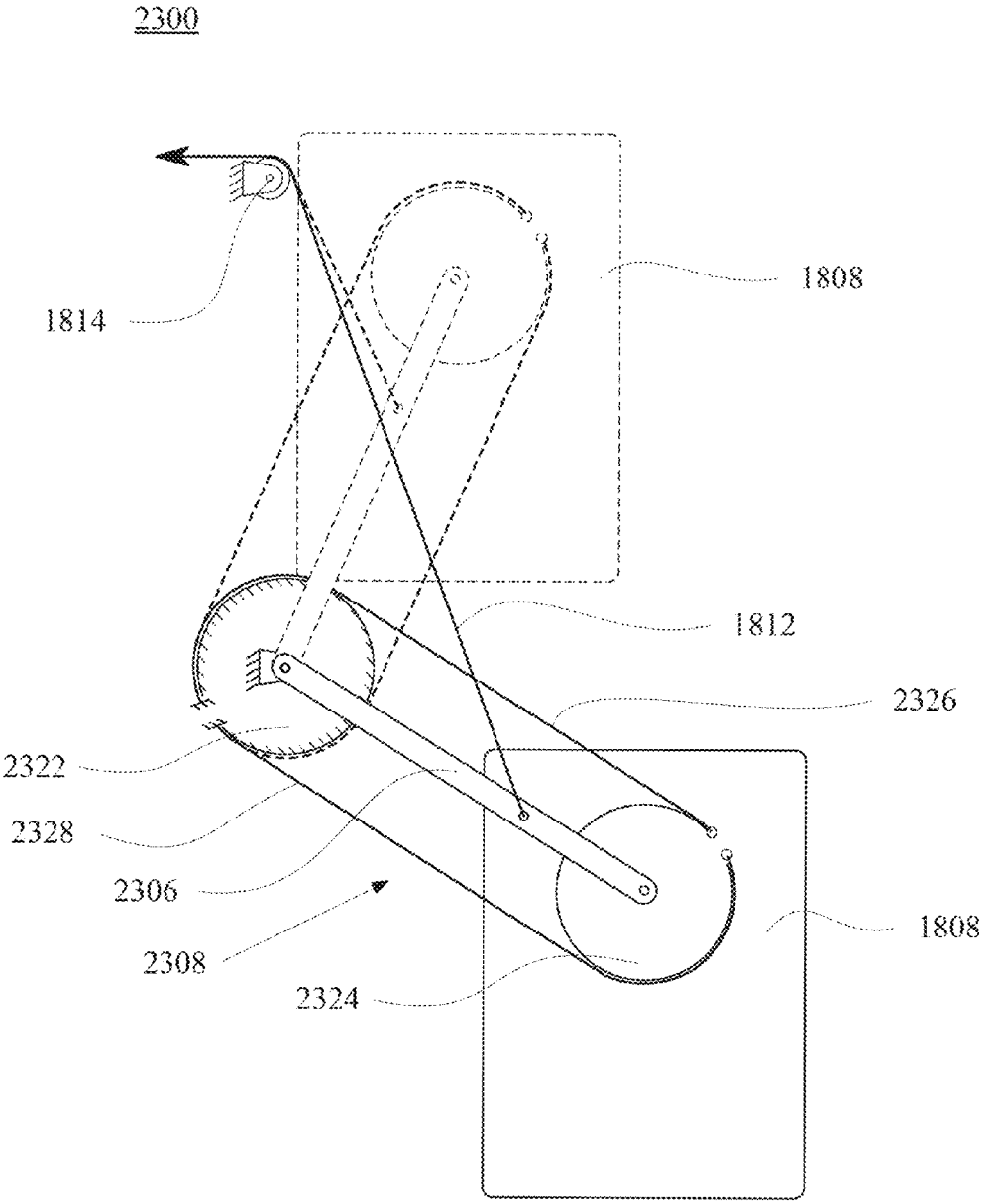
FIG. 23 is a pictorial representation of dual pulley lift arms in accordance with an illustrative embodiment.

FIG. 23 is a pictorial representation of a dual pulley lift arm 2300 in accordance with an illustrative embodiment. The lift arm 2306 may utilize a single arm or linkage. However, the linkage 2308 may include pulley 2322 rigidly attached to a ground point and pulley 2324 rigidly attached to the carriage connected by cables 2326 and 2328. Any flexible tension bearing member such as a cable, roller chain, cord, or rope may also be used. As the lift arm 2306 rotates the cables are not allowed to slip on the pulleys. In one embodiment the one end of the cable is attached to the ground pulley and the other end is attached to the carriage pulley. The pulleys 2322 and 2324 are linked so that the carriage 1808 remains aligned at a constant angle when moving between positions. The pulleys may also be linked to achieve a desired and controlled rotation in the carriage 1808 during rotation. In other words, the bottom of the carriage 1808 remains horizontal and flat for keeping the stored goods flat during motion. Multiple cables 2326 and 2328 are utilized to ensure that one cable is always in tension during the motion of the carriage up or down.

Figure 24:
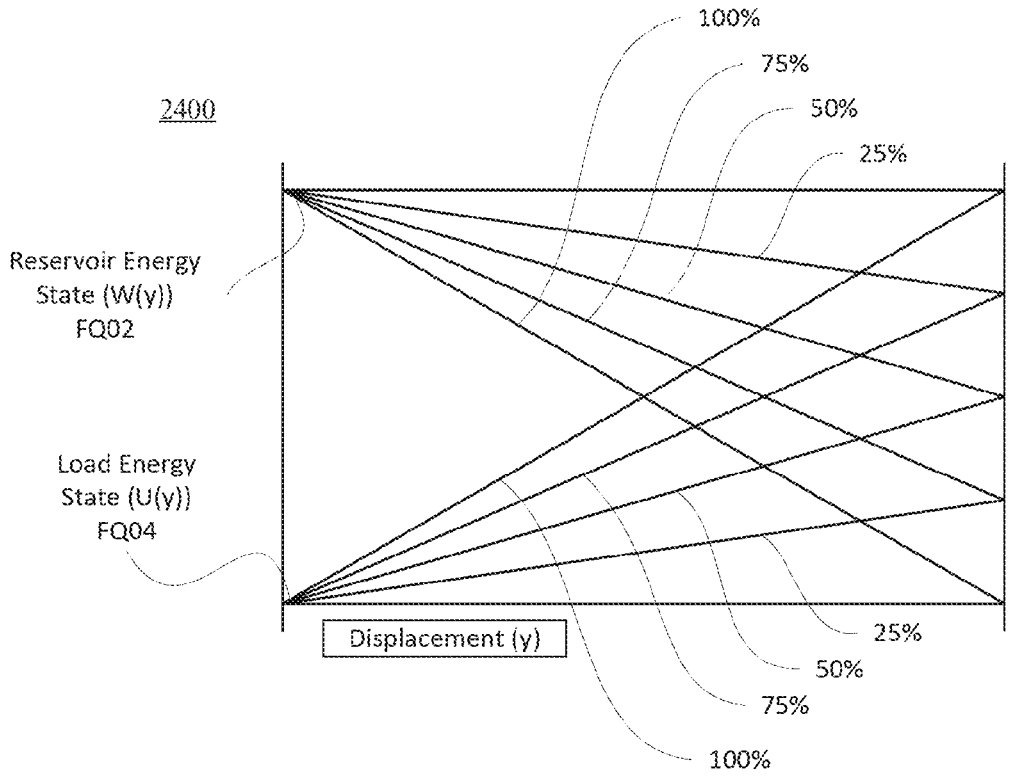
FIG. 24 is a graph illustrating energy transfer in an auto-balancing system in accordance with an illustrative embodiment.

FIG. 24 is a graph 2400 illustrating energy transfer in an auto-balancing system in accordance with an illustrative embodiment. The graph 2400 illustrates the transfer of energy between reservoir energy (i.e. spring or mass) and load energy (i.e. the energy of stored goods). The graph 2400 illustrates the transfer of energy from the energy reservoir to the load over a known displacement expressed in terms of percentages levels of reservoir energy and load energy. The energy change in the auto-balancing system as illustrated by graph 2400 is approximately proportional to the displacement of the load. In particular, during the weighing mode the linkage of the auto-balancing engine is configured so that when the auto-balancing engine is changed to lift mode, the stored energy (i.e. the spring energy) is released at approximately the same rate the stored energy is used to move the load.

Figure 25:
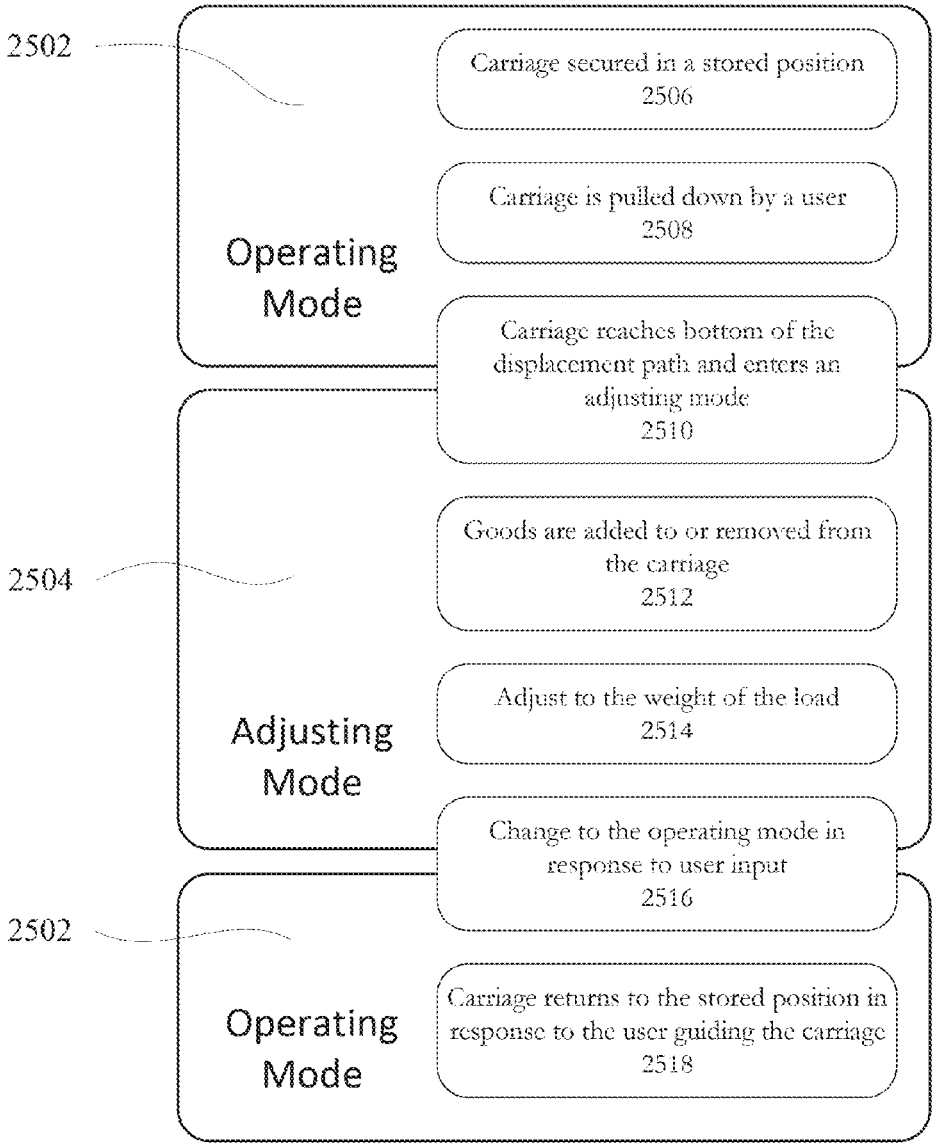
FIG. 25 is a flowchart of a process for operating an auto-balancing system in accordance with an illustrative embodiment.

FIG. 25 is a flowchart of a process for operating an automatically-balancing assisted storage system in accordance with an illustrative embodiment. The process of FIGS. 25-27 may be implemented by any number of devices or systems that incorporate the force engines, linkages, and auto-balancing components, and systems as herein described. For example, the auto-balancing system may be integrated as a cabinet or tool mount, or other similar device. Examples for the cabinet are provided herein for purposes of simplicity. Likewise, the cabinet is described in terms of an auto-balancing system that extends down; however, the cabinet may also be operable to extend upwards to a user and the process of FIG. 25 is thus equally applicable to that process.

The automatic-balancing system may operate in at least two modes including an operating mode 2502 and an adjusting mode 2504. The process may begin with a carriage secured in a stored position (step 2506). The stored position may be a closed position. In one embodiment, the cabinet may be secured by doors that are required to be opened to access the cabinet even in the stored position.

Next, the carriage is pulled down by a user (step 2508). The carriage path may be down and out, straight down, or down and then out. The carriage may include a handle, straps, grips, or other access components that allow a user to apply the force to the carriage. The force required by the user may depend on the motion of the carriage. For example, the user may be required to pull the carriage horizontally initially to overcome the equilibrium of the carriage before supporting the carriage with an upward force as the carriage drops down to an accessible height. During step 2508, the auto-balancing system provides a substantial balancing force, such that the user input is minimal. The user is not fully supporting the weight of the goods or load in the carriage. For example, the force engine may provide 90% of the force, such that the user is only supporting or providing a force equivalent to 10% of the weight. In another embodiment, the user may only be required to provide 5%, 10%, or 15% of the weight when lifting or lowering the carriage. In one embodiment, the user may only be required to provide 10-30 pounds of lifting force or approximately 2-30% of the weight corresponding to the load. These numbers may vary for commercial applications or tools. As a result, minimal user input is required with the auto-balancing system providing a substantial amount of the force required to move the carriage through the displacement path. In other embodiments, the user may actually be required to provide a downward force to pull the carriage to a loading/unloading or accessible position or an upward force to push the carriage to the stored position.

Next, the carriage reaches the bottom of the displacement path and enters an adjusting mode (step 2510) and the auto-balancing system changes to the adjusting mode 2504. The bottom of the displacement path or stroke represents the full extension of the carriage provided by the corresponding lift arms or carriage bearing linkage. As previously described, the motion, curve or line defining the displacement path of the carriage may depend on the type and configuration of the lift arms. At rest or static equilibrium for the auto-balancing system, no forces are required from the user to support the carriage.

Next, the goods are added to or removed from the carriage (step 2512). The goods are the load imposed upon the carriage. In the embodiments, the carriage is more accessible at the end of the displacement path than at the beginning of the path to all users and particularly children, elderly persons, and individuals with disabilities.

Next, the auto-balancing system adjusts to the weight of the load (step 2514). The force engine may automatically or manually adjust. In one embodiment, the force engine automatically enters an adjusting mode as the carriage approaches the bottom of the displacement range or as goods are added or removed from the carriage. In another embodiment, the user may push up or pull down on the carriage, pull a handle, push a button, press a lever or pull a strap to engage or initiate the operating mode 2502 or the adjusting mode 2504.

Alternatively, any number of dials, knobs, levers, slides, or other mechanisms may be utilized to manually set the force provided to the auto-balancing system by the force engine. For example, an easily turned dial may include a numeric indication of the force (associated with a weight of the goods) provided by the force engine to counterbalance the load. In one embodiment, the auto-balancing system may include analog or digital read outs that indicate the weight of the load as well as the force applied by the force engine.

Next, the auto-balancing system changes to the operating mode 2502 in response to user input (step 2516). The user input may be provided by pulling twisting, rotating or otherwise interacting with a handle, or other common physical interface known in the art. The user input may be the user providing a force against the carriage to return the carriage to the stored position. In another embodiment, the selection described for engaging the adjusting mode 2504 may be utilized to engage the operating mode 2502. The process ends with the carriage returning to the stored position in response to the user guiding the carriage (step 2518). As before, the user may only be required to provide a minimal force, or small fraction, portion, or percentage of the weight corresponding to the load. For example, for a 100 pound load, the user may only be required to provide 10 pounds of force to return the carriage to the stored position based on the assistance from the counterbalance force applied by the force engine to the carriage.

It is important to note that the modes of operation in the force engine and counterbalancing systems overlap briefly during transitions between the variable member being locked and/or the traveling member being locked. The overlapping modes prevent the force engine from reaching points of instability where the force engine may fail when transitioning back and forth between modes.

Figure 26:
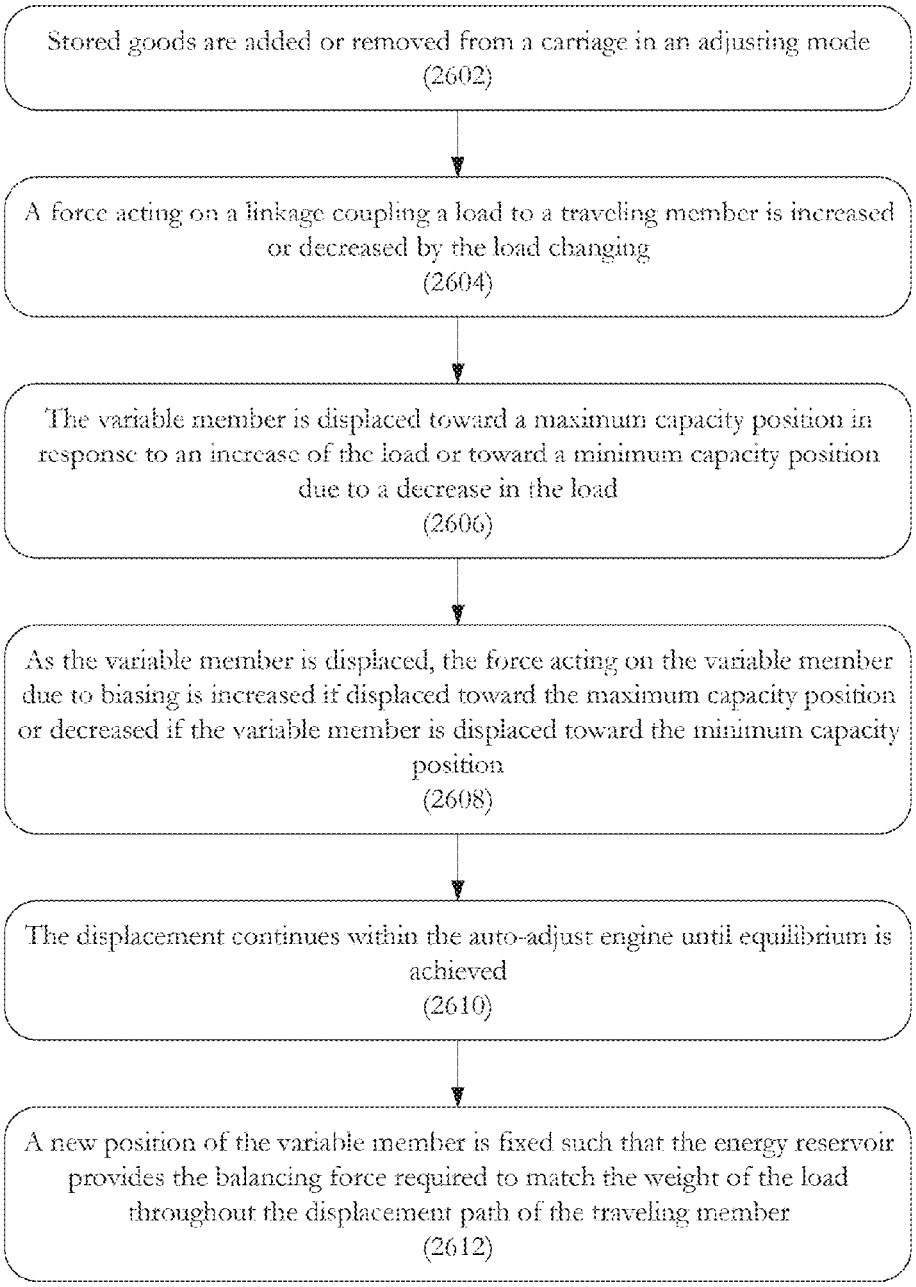
FIG. 26 is a flowchart of a process for configuring an auto-adjust engine in accordance with an illustrative embodiment.

FIG. 26 is a flowchart of a process for configuring an auto-adjust engine in accordance with an illustrative embodiment. The process of FIG. 26 is applicable to many of the embodiments of the force engines shown and described herein. The process of FIG. 26 may begin with stored goods being added or removed from a carriage in an adjusting mode (step 2602). The stored goods may represent the load imposed on the force engine. Next, a force acting on a linkage coupling a load to a traveling member is increased or decreased by the load changing (step 2604).

A variable member is displaced toward a maximum capacity position in response to an increase of the load or to toward a minimum capacity position in response to a decrease in the load (step 2606). As the variable member is displaced, the force acting on the variable member due to biasing is increased if displaced toward the maximum capacity position or decreased if the variable member is displaced toward the minimum capacity position (step 2608).

Next, the displacement continues within the auto-adjust engine until equilibrium is achieved (step 2610). A new position of the variable member is fixed such that the energy reservoir provides the balancing force required to match the weight of the load throughout the displacement path of the traveling member (step 2612).

Figure 27:
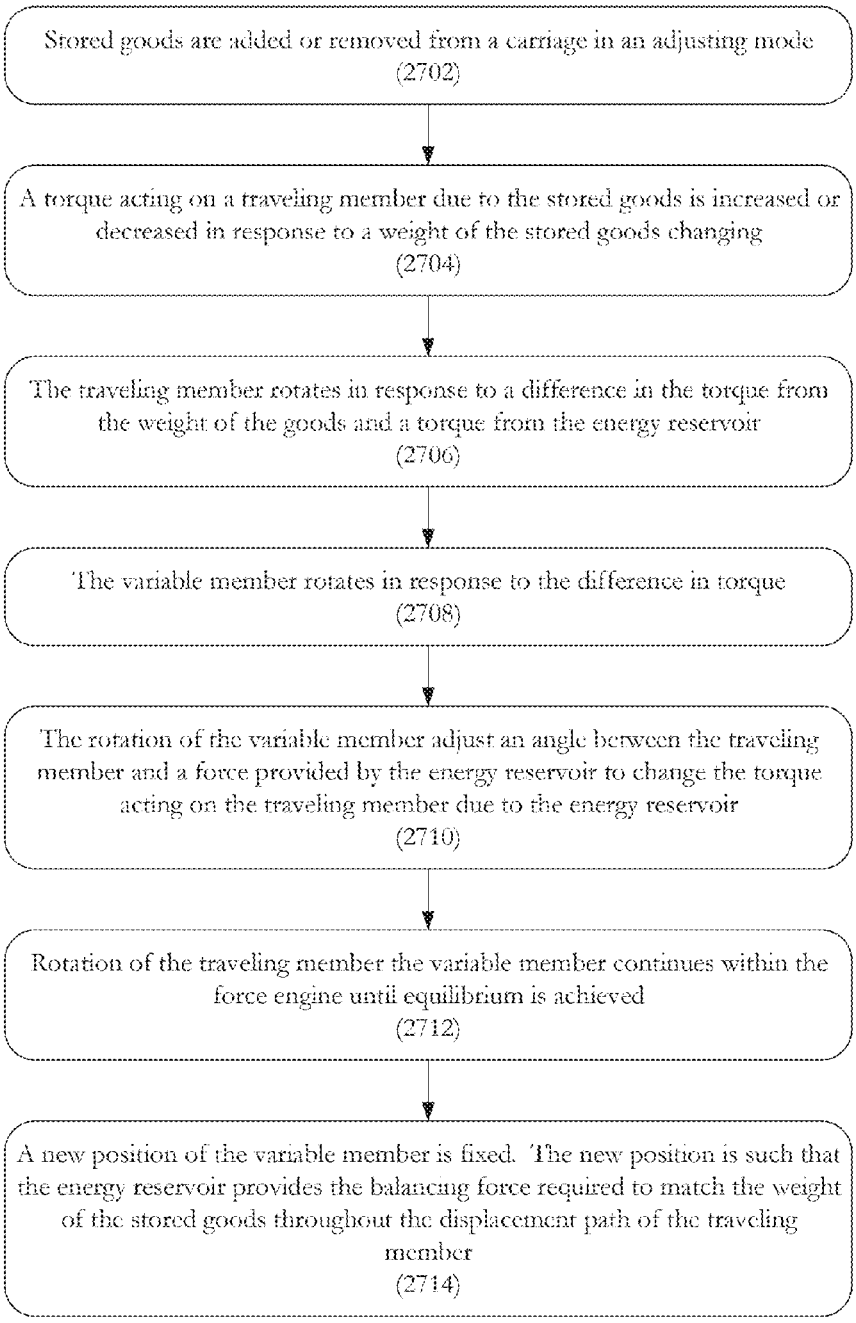
FIG. 27 is a flowchart of a process for adjusting the auto-balancing system in accordance with an illustrative embodiment.

FIG. 27 is a flowchart of a process for adjusting the auto-balancing system in accordance with an illustrative embodiment. The flowchart of FIG. 27 may be applied to the force engine 100 of FIG. 1. The process of FIG. 27 may begin with stored goods being added or removed from a carriage in an adjusting mode (step 2702). A torque acting on a traveling member due to the stored goods is increased or decreased in response to a weight of the stored goods changing (step 2704).

Next, the traveling member rotates in response to a difference in the torque between the weight of the goods and a torque from an energy reservoir (step 2706). Next, the variable member rotates due to the difference in torque (step 2708). The rotation of the variable member adjusts an angle between the traveling member and a force provided by an energy reservoir to change the torque acting on the traveling member due to the energy reservoir (step 2710). The variable member may rotate in response to the coupling between the variable member and the traveling member. The rotation of the variable member adjusts the operating relationship of the energy reservoir and the traveling member, changing the force applied by energy reservoir.

Rotation of the traveling member and the variable member continues within the force engine until equilibrium is achieved (2712). The rotation may continue due to the coupling between the members. The increase or decrease of the angle of the variable member increases or decreases the counterbalance force provided by the energy reservoir to correspond to the weight of the stored goods.

Next, a new position of the variable member is fixed. The new position is such that the energy reservoir provides the balancing force required to match the weight of the stored goods through a displacement path of the traveling member (step 2714).

Figure 28:
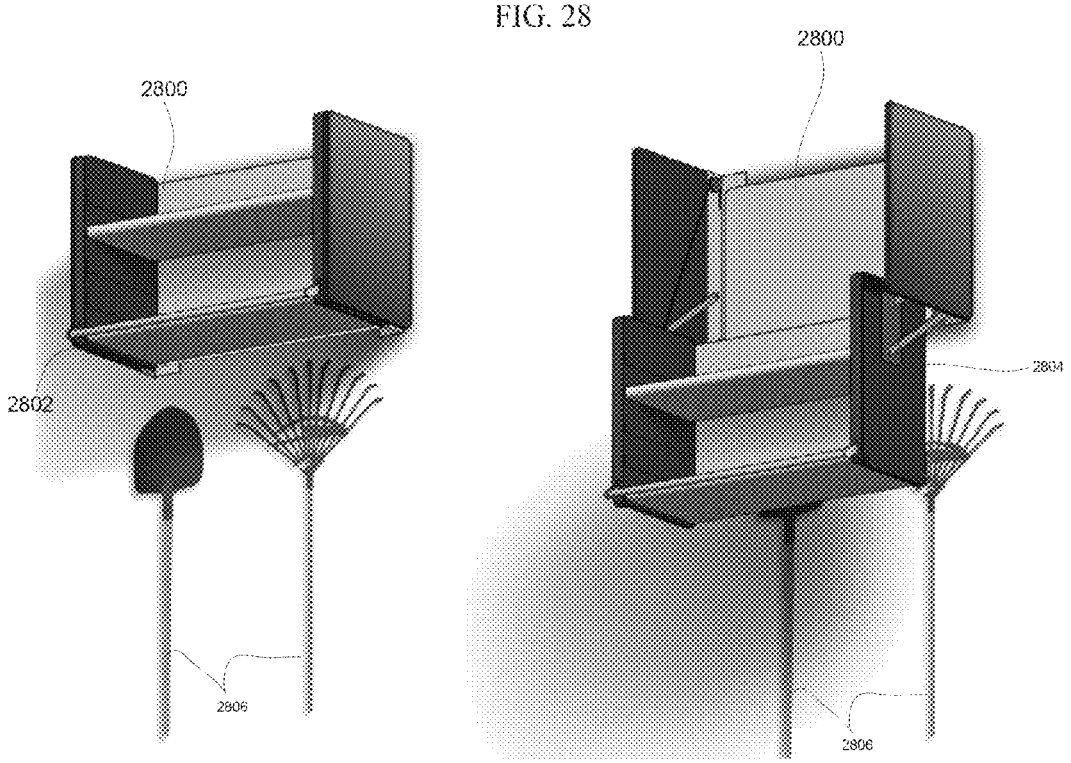
FIGS. 28-33 are pictorial representations of auto-balancing cabinets in accordance with illustrative embodiments.

FIGS. 28-33 are pictorial representations of auto-balancing cabinets in accordance with illustrative embodiments. FIG. 28 illustrates an auto balancing cabinet 2800 in a closed position 2802 or stored position and in an open position 2804 or load position. In one embodiment, the auto balancing cabinet 2800 may lift out and past anything below the auto-balancing cabinet, such as tools 2806.

Figure 29:
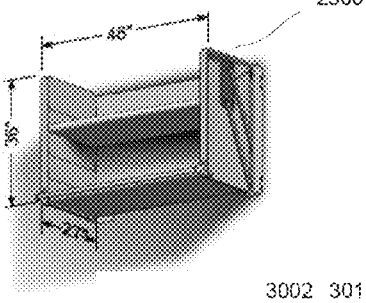

Turning now to FIG. 29, an auto-balancing cabinet 2900 illustrates potential dimensions of the auto-balancing cabinet 2900. In one embodiment, the auto-balancing cabinet 2900 may have a lift capacity of 150 lbs. However, the capacity may vary from as small as one pound in micro-auto balancing systems to thousands of pounds for commercial or industrial based auto-balancing systems.

Figure 30:
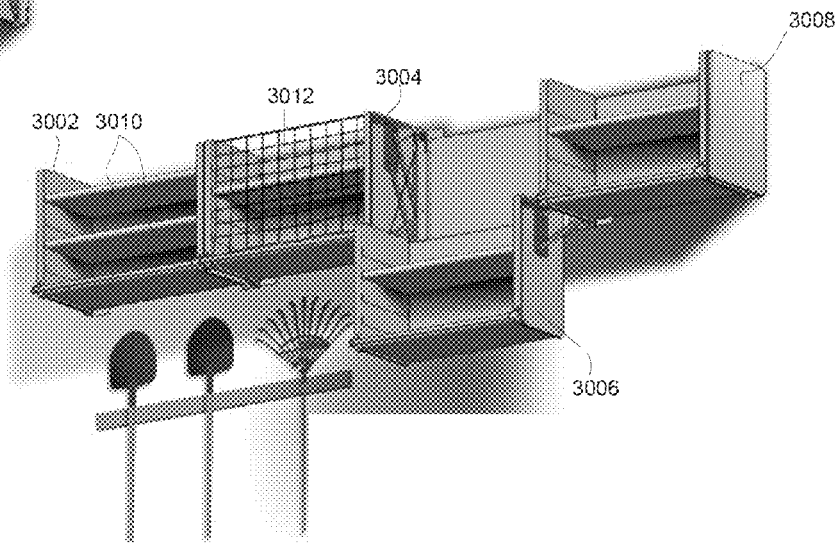

Turning now to FIG. 30, auto-balancing cabinets 3002, 3004, 3006, and 3008 further illustrate embodiments and configurations. The design, configuration, and shape of the auto-balancing cabinets 3002, 3004, 3006, and 3008 may allow them to be mounted side-by-side as shown, attached or even integrated. In one embodiment, a modular configuration allows the auto-balancing cabinets 3002, 3004, 3006, and 3008 to be installed at the convenience of the user. As shown by the auto-balancing cabinet 3002, the auto-balancing systems may include positionable shelves 3010. The shelves may be customizable positioned utilizing pre-drilled holes (and inserts), slits, slots, or other receiving mechanisms. End panels and shelves of the auto-balancing cabinets 3002, 3004, 3006, and 3008 may be made from any number of materials including metal, plastic, wood, or composite materials.

In one embodiment, the auto-balancing cabinet 3004 may include a safety net 3012. The safety net 3012 (or sheet) may be integrated with the auto-balancing cabinet 3004 or may be attached to any of the auto-balancing cabinets 3002, 3004, 3006, and 3008. For example, auto-balancing cabinet 3004 (or individual components thereof) may include hooks, tabs, rods, slots, or other connection points for securing the safety net 3012 to the front, top, or any other portion of the auto-balancing cabinet 3004. The safety net 3012 may help goods stay within the auto-balancing cabinet 3004 during movement. A safety net 3012 or sheet may also help keep contents clean. For example, the safety net 3012 may be ideal for a number of balls that tend to shift or roll during movement of the auto-balancing cabinet 3004. The safety net 3012 may also help store or secure goods that are oddly-shaped and that may protrude or extend from the shelves of the auto-balancing cabinet 3004. The safety net 3012 may also be attached to the top of the auto-balancing cabinet 3004.

Figure 31:
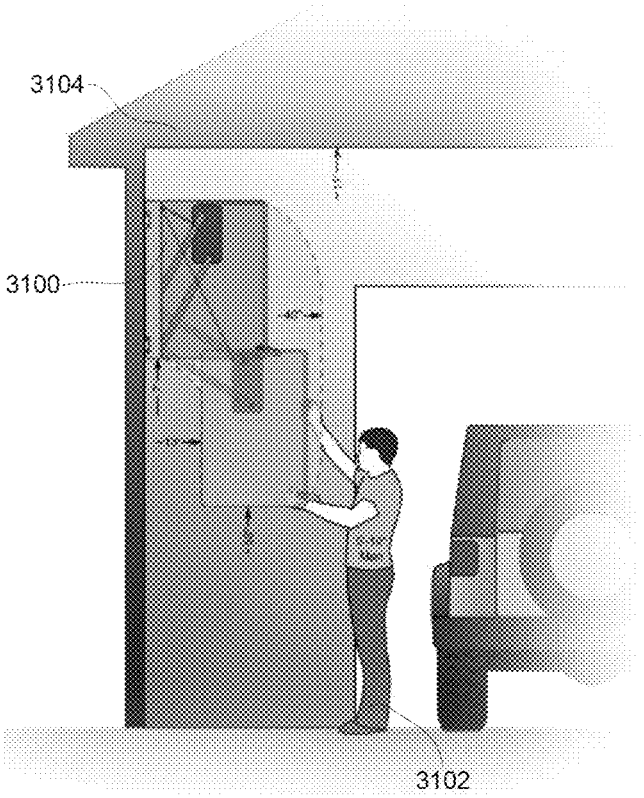

Turning now to FIG. 31, a pictorial representation illustrates an auto-balancing cabinet 3100 being lowered by a user 3102 in a garage 3104 or other similar environment. As is shown, the auto-balancing cabinet 3100 significantly reduces the footprint required to store goods. For example, floor space is increased for walking or other uses. As shown, the auto-balancing cabinet 3100 may be mounted above the head of the user 3102 while still being lowered to a height where the auto-balancing cabinet 3100 (and any contents) is accessible.

For example, the auto-balancing cabinet may be mounted at seven feet high above the walking height of most potential users. In the lowered position, the auto-balancing cabinet 3100 may lower the storage and accessible portion to 50" (a height accessible to many male and female adults). However, the auto-balancing cabinet 3100 may be mounted at any number of heights that may correspond to the height and needs of individual users (e.g. shorter individuals, children, etc.). In one embodiment, the auto-balancing cabinet 3100 may only extend approximately 13" from the mounted position when extended. The amount that the auto-balancing cabinet 3100 extends may be more or less than this example. In one embodiment, another small cabinet, shelves, or other structure may be mounted below the auto-balancing cabinet 3100 (or drop down cabinet).

Figure 32:
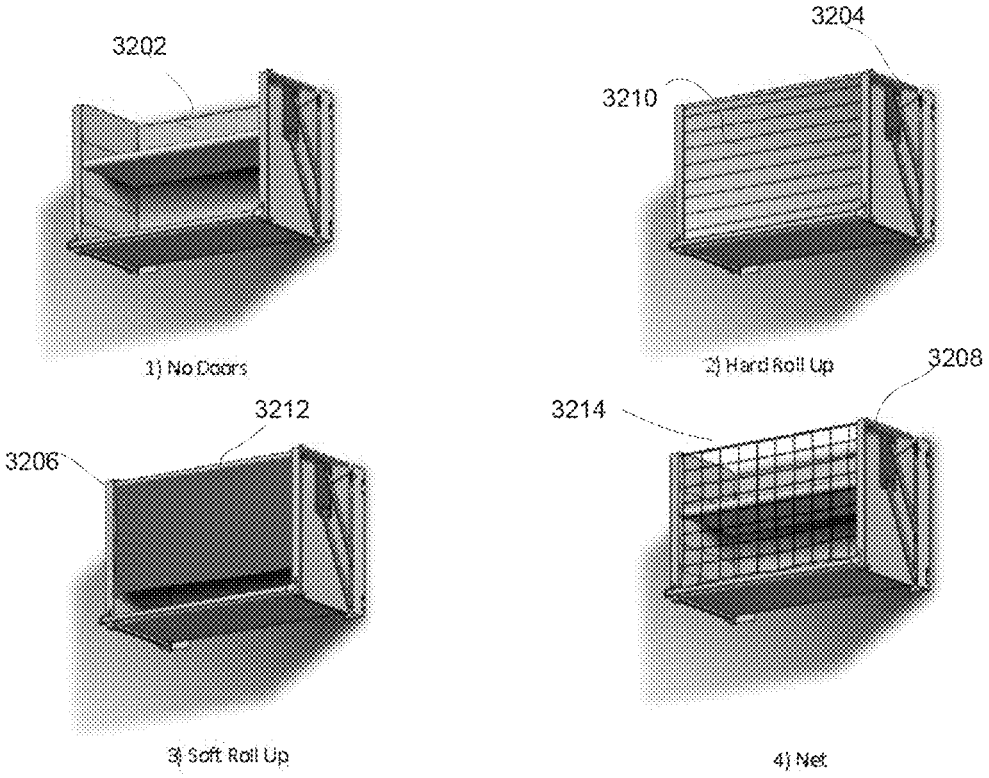
Figure 33:
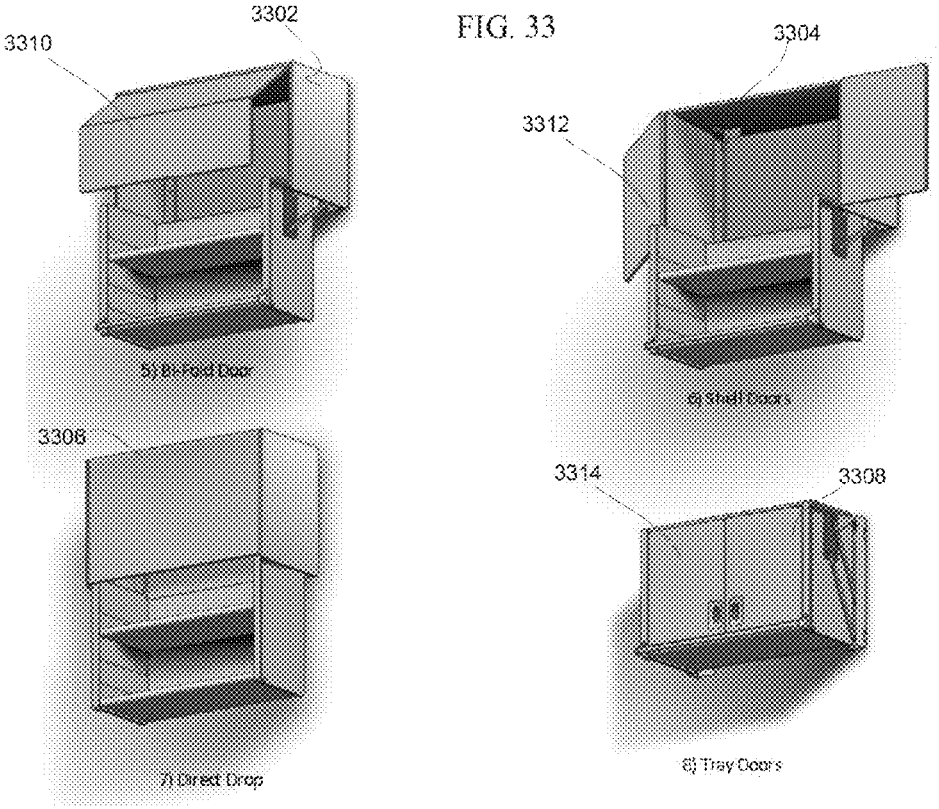

Turning now to FIG. 32, a pictorial representation illustrates various configurations of auto-balancing cabinets 3202, 3204, 3206, and 3208. FIGS. 32 and 33 show various embodiments for enclosing a tray. The tray or other components of the auto-balancing cabinet embodiments may be enclosed to keep the contents clean. In addition, enclosures may be important to prevent the user from removing content at any position, except for the bottom of the stroke or load position. In one embodiment, a linkage may be configured to prevent the enclosure, doors, or similar structure from being opened when the mechanism is in the weighing and load mode. In one embodiment, a cable between the mode change mechanism and the latch on the doors may be utilized to prevent unsafe access. However, any number of linkages, indicators, or attachment components may be utilized to prevent unsafe access to the auto-balancing cabinets.

As previously shown, the auto-balancing cabinet 3202 may only include shelves with no doors. The auto-balancing cabinet 3204 may include a hard roll up 3210 configuration as is known in the art. The auto-balancing cabinet 3204 may provide a different aesthetic and further secure the goods within the auto-balancing cabinet 3204 while also hiding the goods from view and keeping them clean.

The auto balancing cabinet 3206 may include a soft roll up 3212 configuration. For example, the auto-balancing cabinet 3206 may include a fabric or other material that may be rolled up and down for the same aesthetic and securing reasons. The auto-balancing cabinet 3208 may include safety netting 3214 as was previously described.

Turning now to FIG. 33, a pictorial representation illustrates various additional configurations of auto-balancing cabinets 3302, 3304, 3306, and 3308. The auto-balancing cabinet 3302 may include bi-fold doors 3310. The bi-fold doors 3310 may include springs or pneumatics to hold the doors open while the auto-balancing cabinet 3302 is being accessed or utilized by the user.

The auto-balancing cabinet 3304 may include shell doors 3312. The shell doors 3312 may be swung open to access the functionality of the auto-balancing cabinet 3304.

As was previously described, the auto-balancing cabinet 3306 may be configured to drop directly to further reduce the space footprint utilized and for aesthetics. The auto-balancing cabinet 3306 may be useful for applications where goods or other cabinets are not stored directly below the auto-balancing cabinet 3306 and where space is even further limited (or based on the user's requirements). In this embodiment, a shell encasing the tray may prevent contents from being accessed at any point other than when the tray is in the lowered position.

In another embodiment, the auto-balancing cabinet 3308 may include tray doors 3314. Any of the doors or other systems or methods of enclosing the auto-balancing cabinets of the varying embodiments may be configured to lock or be otherwise inaccessible. Several reasons exist for possibly enclosing the tray of the auto-balancing cabinets, such as keeping the content clean. Additionally, it may be important to prevent the user from removing content at any position but at the bottom of the stroke to avoid an imbalance in the load and the balancing force. To help prevent this, a linkage could be configured that only allows the doors (or like) to be opened when the assistance mechanism is in the weigh mode. For example, a cable may be attached between the mode change mechanism and the latch on the doors to accomplish this.

Figure 34:
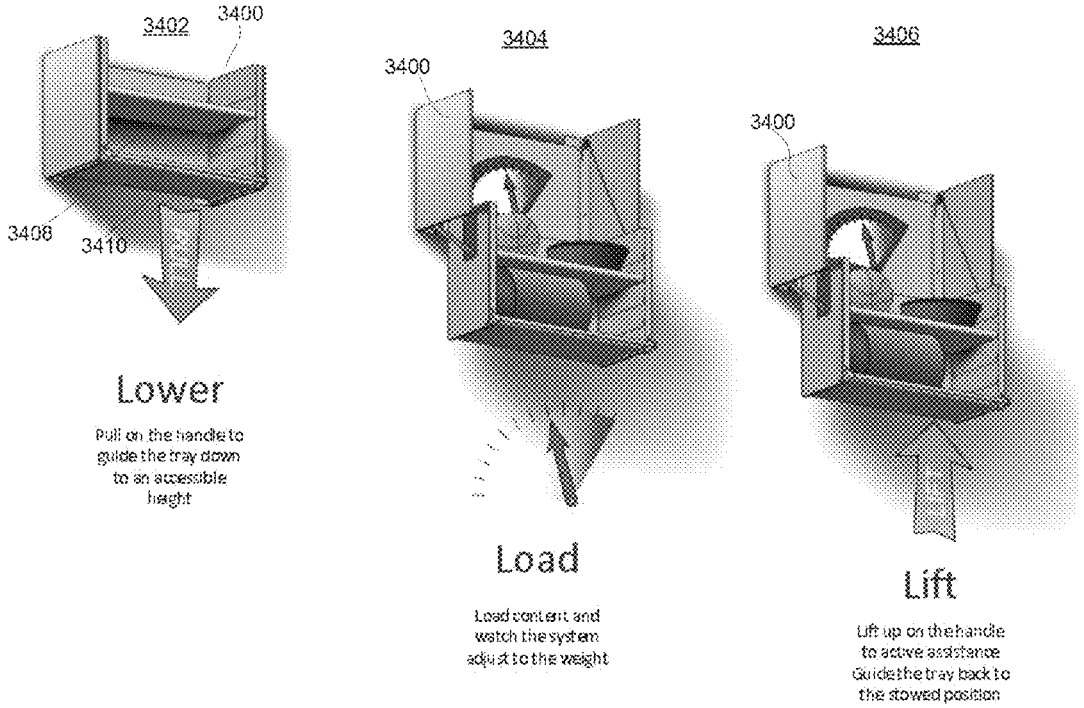
FIG. 34 is a pictorial representation of a process for utilizing an auto-balancing cabinet in accordance with an illustrative embodiment.

FIG. 34 is a pictorial representation of a process for utilizing an auto-balancing cabinet in accordance with an illustrative embodiment. FIG. 34 illustrates the auto-balancing cabinet 3400 being lowered (step 340), loaded (step 340), and lifted (step 340). From a closed position, a tray 3408 of the auto-balancing cabinet 3400 is lowered by pulling on a handle 3410 to guide the tray 3408 down to an accessible height (step 3402). In one embodiment, the user may simply pull downward or outward on the handle 3410 to initiate the process of step 3402. In another embodiment, the user may be required to perform a specific motion with the handle 3410 or other latching system to begin step 3402 as an additional safety step.

Next, the user may load content into the tray 3408 and visualize the auto-balancing cabinet 3400 adjusting to the weight (step 3404). In one embodiment, the force engine or other mechanisms may be mounted behind a cut-out, glass, Plexiglas, or other indicators may be otherwise presented to the user indicating that the tray 3408 has been loaded. In one embodiment, the auto-balancing cabinet 3400 may indicate if the maximum capacity of the auto-balancing cabinet is exceeded. For example, a warning indicator may be displayed. In another example, the auto-balancing cabinet 3400 may lock out the tray 3408 from being lifted up in response to determining the auto-balancing cabinet 3400 is overloaded. The auto-balancing cabinet 3400 may also include a mechanism for tracking the last lifted or stored loads for liability purposes.

Next, the user lifts up on the handle 3410 to activate assistance in lifting the tray 3408 and guides the tray 3408 back to the stowed position (step 3406). The auto-balancing cabinet 3400 provides assistance by providing most of the force required to lift the tray 3408 and corresponding load from the lower load and weighing position to the upper stored position. The assistance force may be activated by lifting up on or pressing the handle 3410 or by using any number of other engagement processes for the force engine of the auto-balancing cabinet 3400. In one embodiment, where the auto-balancing cabinet 3400 is driven by an electric motor, the handle 3410 may be part of a switch that engages the electric motor to raise or lower the tray 3408 based on the input or feedback provided to or against the handle 3410.

In other embodiments, the same processes and mechanisms may be similarly used with configuration changes for a system or cabinet in which the positions are reversed such that the stored position is lower and the tray 3408 is lifted up to the user to be loaded (in the higher load/weighing position) and then is subsequently pushed or guided down with assistance from the user to the lower stored position. In this configuration, the user may simply guide the tray 3408 when it is being lifted up with providing minimal input force and may be required to push down on the handle 3410 to lower the tray 3408 to the stored position. This embodiment may be particularly useful for individuals that are unable to bend over significantly or reach lower areas. The handle 3410 may also be attached to the top of the tray 3408 for easier access by the user.

Figure 35:
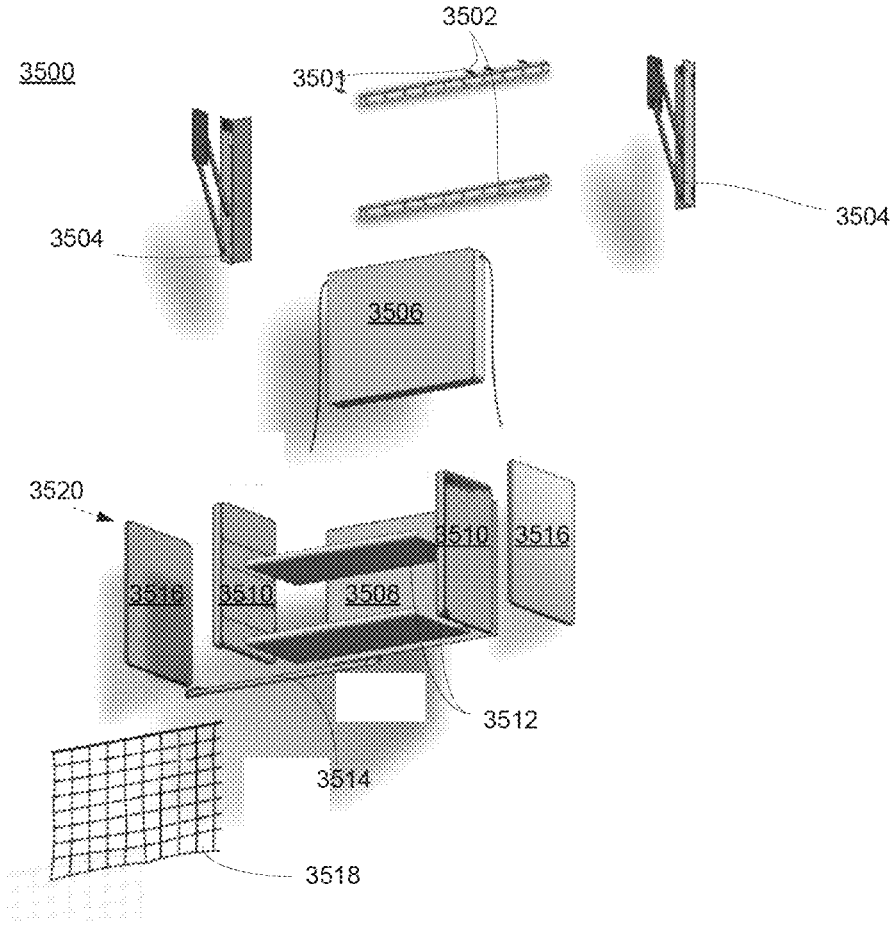
FIG. 35 is a partially exploded view of an auto-balancing system in accordance with an illustrative embodiment.

FIG. 35 is a partially exploded view of an auto-balancing system 3500 in accordance with an illustrative embodiment. In one embodiment, the auto-balancing system 3500 may include anchors 3501, rails 3502, lift arms 3504, an assistance mechanism 3506, a tray back 3508, tray sides 3510, shelves 3512, a handle 3514, end caps 3516, and safety netting 3518.

In one embodiment, the rail 3502 is a mounting system or brackets. In one embodiment the rail 3502 may be one or more rails attached parallel or perpendicular to the ground. For example, two rails may be utilized to provide support and safety to the auto-balancing system. In one embodiment, the rails 3502 are attached to a wall, frame, system, or other structure utilizing anchors 3501. The anchors may be nails, screws, bolts, rivets, or other similar attachment components. The components of the auto-balancing system 3500 may be attached directly or indirectly to the rails 3502. In one embodiment, the lift arms 3504 may be attached directly to the anchors 3502. The lift arms 3504 may be actively and passively secured to the rails 3502. For example, the rails 3502 may include tabs, hooks, or other components that utilized gravity to further secure the lift arms 3504.

The assistance mechanism 3506 includes the force engine. In one embodiment, the assistance mechanism 3506 includes mechanical components as herein described. In another embodiment, the assistance mechanism is an electric motor, air-driven engine, pneumatic engine, or a combination of components. Embodiments that utilize an electric motor may include power cords (or battery, generator, capacitor, or other power source), a gearbox, cables, pulleys, control systems, switches, chains or belts for connecting to the lift arms, sprockets, and gearing to provide the lifting force for a maximum weight. In one embodiment, the assistance mechanism 3506 is installed directly behind the tray. In another embodiment it may be installed above the tray. In another embodiment, the assistance mechanism 3506 may be installed externally or remotely from the auto-balancing system with cables or another linkage.

As shown, the tray back 3508, tray sides 3510, shelves 3512 and handle 3514 may be assembled to form a tray 3520. In another embodiment, the tray 3520 may be a single molded or integrated piece. The tray 3520 may take many forms as are herein described. For example, the tray 3520 may include doors, lids, or other securing components, such as the safety netting 3518. In other embodiments, the tray 3520 may be replaced by tools, equipment, systems, devices, or other components that need to be lifted up and down. For example, a drill press may replace the tray 3520 and may be attached to the lift arms 3504 and assistance mechanism 3506 to be raised and lowered. In another example, the tray 3520 may be replaced by a computer desk or bed that a user may pull down for utilization.

In one embodiment, the handle 3514 may be configured as a "crash bar" or bar that extends across the front of the auto-balancing system 3500. The handle may be attached to a linkage utilized to change the auto-balancing system 3500 from a waiting mode back to a lift mode when the user is ready to lift the tray 3520. In one embodiment, lifting the handle 3514 may activate the lifting mode of the auto-balancing system 3500 or, in other words, activate the assistance mechanism 3506 to provide a lifting or assistance force. Similarly, the tray 3520 may be secured in place at the top of the stroke and may only be released when the handle 3514 is pulled down. For example, a latch (not shown) may be utilized to secure the tray in either mode until the latch is released utilizing a linkage connected to the handle 3514.

Figure 36A:
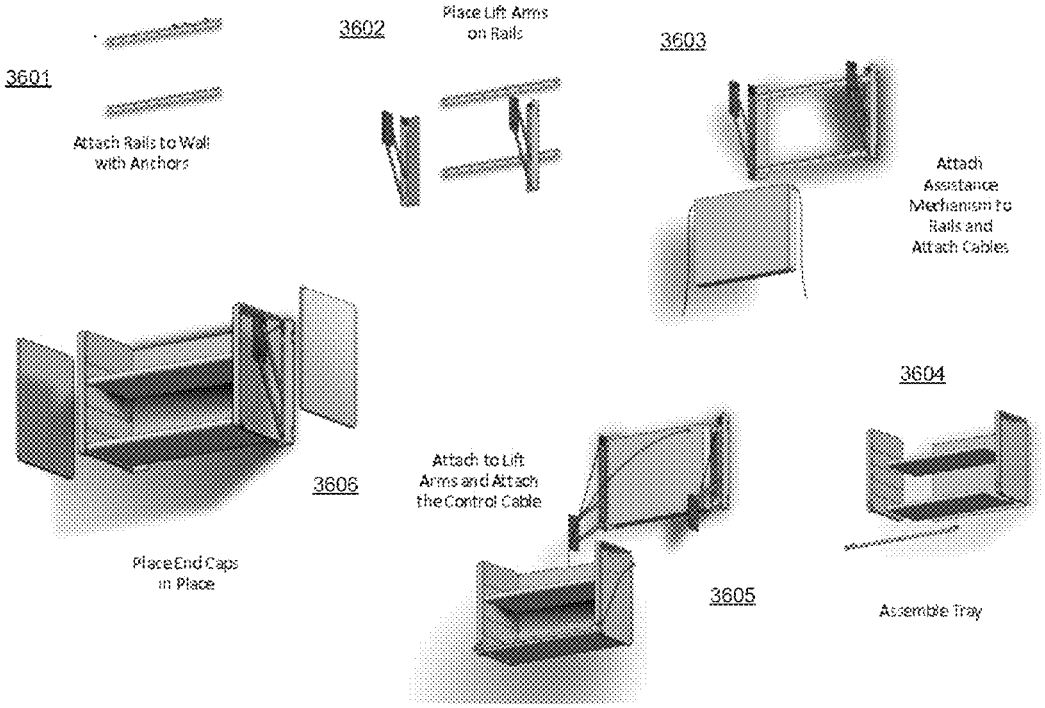
FIGS. 36A-B are pictorial representation of a process for assembling an auto-balancing system in accordance with an illustrative embodiment.
Figure 36B:
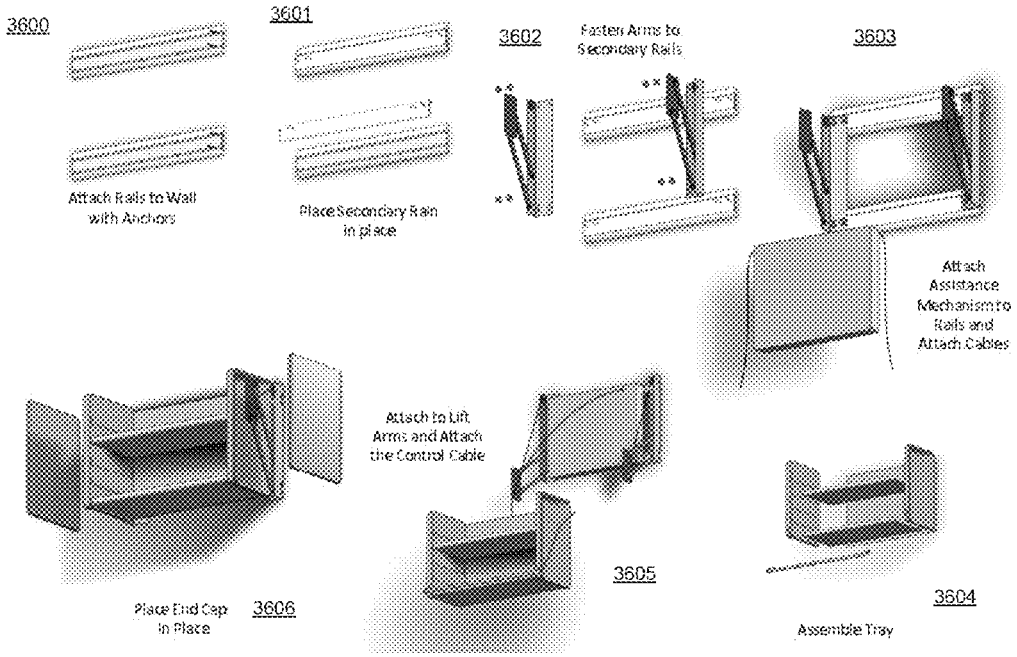

FIGS. 36A-B are pictorial representations of a process for a assembling an auto-balancing system in accordance with an illustrative embodiment. The processes of FIGS. 36A-B may be utilized to assemble or manufacture the auto-balancing system. The steps of FIGS. 36A-B may be performed sequentially or interchangeably. In another embodiment, the assembly may be remotely performed and then the storage system may be attached to a structure, such as a wall, as a single unit in the place where it is going to be used. In one embodiment, the process may be performed by an individual user, a commercial installer, or other party. The process of FIG. 36A may begin by attaching rails to a wall with anchors (step 3601). The rails may be rails as previously described.

Next, the user places lift arms on the rails (step 3602). The lift arms may be attached utilizing attachment mechanisms, such as screws, pins, knobs, or other attachment mechanisms. Next, the user attaches the assistance mechanism to the rails and attaches the corresponding cables (step 3603). The attachment mechanism may be similarly attached to the rails. The cables may be attached by use of a treaded end, wire rope clips, compressions sleeves or other methods know in the art. In one embodiment, the end of each of the cables may have a previously attached thimble or other end fitting that is simply bolted onto the lift arms.

Next, the user assembles a tray (step 3604). The tray may be assembled or may be molded or manufactured as a single component. The components are assembled individually to reduce the installation weight and to reduce the number of users that may be required to mount or assemble the auto-balancing system. In another embodiment, the entire auto-balancing system may be connected as a single unit to the rails.

Next, the user attaches the tray to the lift arms and attaches a control cable (step 3605). Other means of linking mechanical input from the user to the assistance mechanism may also be utilized. Additionally, there may not be need for a cable or linkage if the activating device is located directly on the mechanism. The process may end with the user placing end caps on the tray (step 3606). The end caps protect the lift arms and prevent the user from being pinched or otherwise injured by the moving parts of the auto-balancing system. In one embodiment, the end caps may also include a top covering.

The process of FIG. 36B is similar to the process of FIG. 36A, redundant process steps are not described again. The process of FIG. 36B may begin by attaching rails to a wall with anchors (step 3600). Next, the user places a secondary rail in place (step 3601). In one embodiment, the second rail may be attached to the first rail by sliding into place, snapping in, or being attached with attachment mechanisms, such as screws, nails, bolts, or so forth.

In one embodiment, the second rail installed in step 3601 may include bolts or posts for fastening lift arms to the secondary rails (step 3602). Nuts or other fasteners may be utilized to secure the lift arms to the secondary rails. For example, the bolts may include threads to which washers and nuts may be attached to secure the lift arms to the first and second rails. Additionally, the secondary rails and the lift arms may be attached together before placed on the primary rails.

Figure 37:
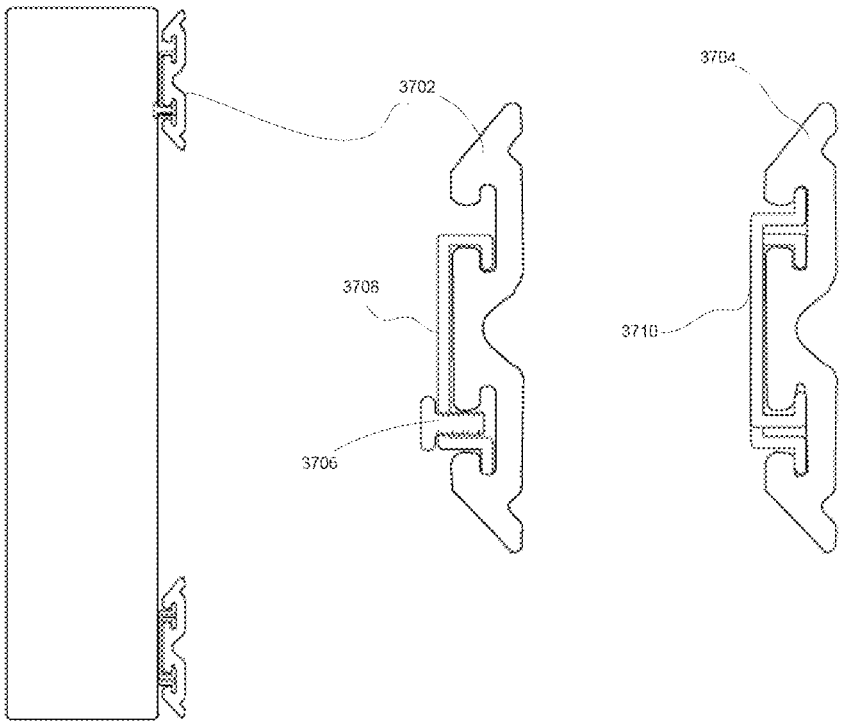
FIG. 37 is a pictorial representation of rails in accordance with illustrative embodiments.

FIG. 37 is a pictorial representation of rails 3702 and 3704 in accordance with illustrative embodiments. Preventing the auto-balancing system from coming off of the rails 3702 and 3704 is very important to protect the user and goods stored. For rail 3702 a threaded stud 3706 may be threaded through a lip into the opening in a slot of the rail 3702. The threaded stud 3706 may keep a hanger 3708 of the lift arms, assistance mechanism, or other components of the auto-balancing system from coming off.

For rail 3704, a hanger 3710 may be inserted into the top slot of the rail to apply pressure to the rail 3704. The rails 3702 and 3704 may represent any number of rails utilized in garage, home or commercial settings as are known in the art, such as rails or channel produced by Gladiator (GearTrack), Rubbermaid (e.g., FastTrack), Craftsman (Versa Track), and so forth.

Figure 38:
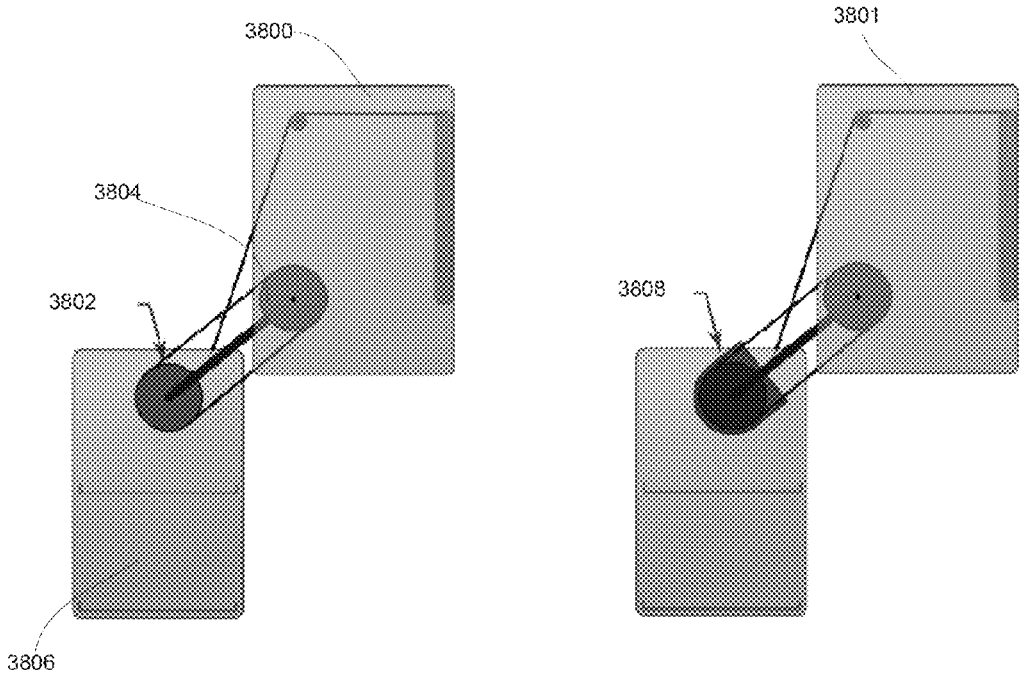
FIG. 38 is a side-view of an auto-balancing system in accordance with an illustrative embodiment.

FIG. 38 is a side-view of auto-balancing systems 3800 and 3801 with a pulley system utilized to stabilize a tray 3806 in accordance with an illustrative embodiment. The auto-balancing systems 3800 may include a pinch point 3802 on lift arms 3804 that has the potential to pinch, catch, or otherwise injure a user, clothing, or property during the motion of tray 3806. As a result, in one embodiment, the auto-balancing system 3801 may include a guard 3808 to protect the user during motion. In addition, the guard 3808 may prevent fingers, clothing, hair, or other objects from interfering with the motion of the lift arms 3804. The guard 3808 may prevent fingers of the user from being pinched between the cable and the pulley. The guard 3808 may be used to cover the lower pulley, the upper pulley, or both pulleys including the entire lift arms.

Any number of guards (not shown) may also be utilized in various other locations to protect the moving components of the auto-balancing systems 3800 and 3801.

Figure 39:
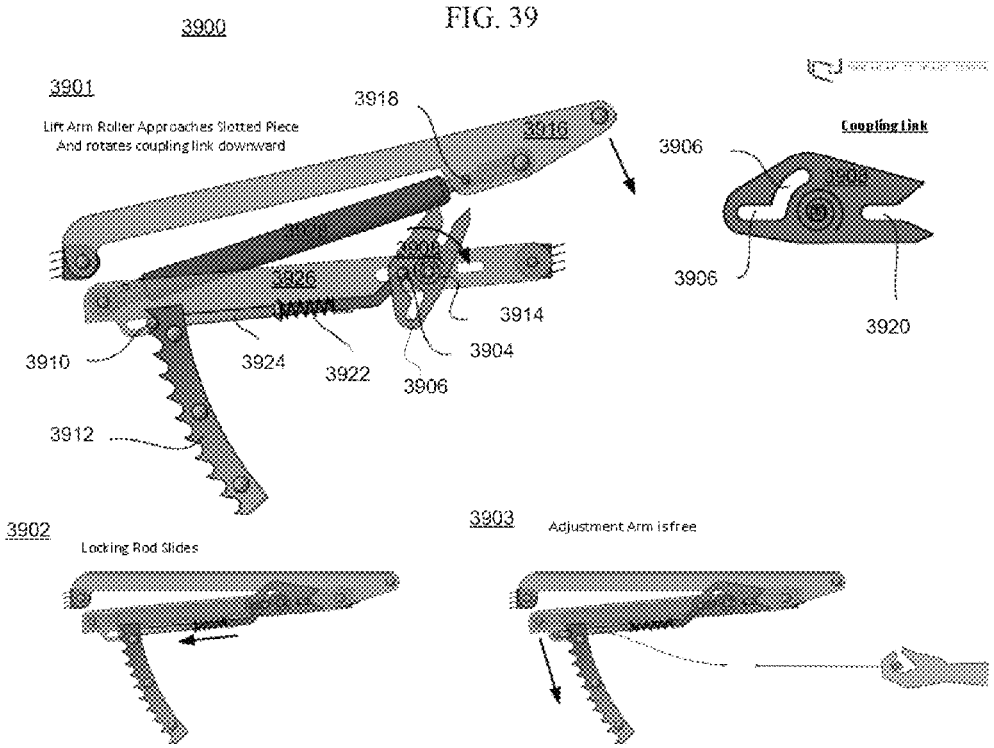
FIG. 39 is another embodiment of a lift arm mechanism and process for securing the lift arms in accordance with an illustrative embodiment.

FIG. 39 is another embodiment of a lift arm mechanism 3900 and process for securing the lift arms in accordance with an illustrative embodiment. The lift arm mechanism 3900 includes many of the components of the previous embodiments and may utilize similar functionality. The lift arm mechanism 3900 is reliable and easy-to-use. The design of the lift arm mechanism 3900 may be combined with other embodiments to provide the same functionality.

Starting in a lift mode as shown (step 3901), a change pin 3904 is currently engaged in the tangential slot 3906 of the coupling link 3908. This prevents a locking pin 3910 from disengaging with a toothed plate 3912. A torsion spring 3914 biases the coupling link 3908 to the upward open position. As a lift arm 3916 lowers, the coupling roller 3918 on the lift arm 3916 approaches a coupling slot 3920 on the coupling link 3908. As the coupling roller 3918 begins to engage, the coupling roller 3918 causes the coupling link 3908 to rotate, and encompass the coupling roller 3918. When the coupling link 3908 has rotated such that the change pin 3904 is in line with the radial slot 3906, a rod spring 3922 which biases a locking rod 3924 and change pin 3904 radially out from the coupling link 3908 thereby pushing the locking rod 3924 outward (step 3902). This action simultaneously releases the lock created by the locking pin 3924 and the toothed plate 3912 and fixes the rotation of the coupling link 3908, thus securing the coupling between the lift arm 3916 and an adjustment arm 3926. In step 3904, the adjustment arm 3926 is free to rotate to properly bias a spring 3928 for the associated load. The locking pin 3910 is released from the toothed plate 3912 to allow the adjustment arm 3926 to freely rotate as needed. When the user is ready to activate lifting, an input is given which moves the locking rod 3924 back to the original position. This locks the adjustment arm 3926 in place by engaging the locking pin 3910 with the toothed plate 3912 and also allows the coupling link 3908 to rotate and release the coupling roller 3918. In one embodiment, the rod spring 3922 is extended to disengage the locking pin 3910 from the toothed plate 3912 by activation (e.g. pressing, pulling, squeezing) of a handle, bar, lever, or other mechanism utilized to activate the weighing mode.

Key to the operation of the lift arm mechanism 3900 is the use of a linkage between two links which has two ranges of operation. In the shown embodiment, the first link may be seen as the coupling link 3908 and the second link as the locking rod 3924. The first range movement of the first link results in no movement and thereby prevents movement of the second link. The second range movement of the second link similarly results in no movement of and prevents movement of the first link. There is a change point in this linkage at which first and second ranges of movement intersect. Two light biasing devices (e.g. coupling link 3908 and rod spring 3922) may be used, both of which bias the first and second links away from the change point. Because the linkage is designed so that there is no kinematic relationship (movement in on link results in no possible movement in the second link) only a light biasing element is needed. This allows the user to direct which range is used without much effort. Once the mechanism is a given range it will not easily change. Additionally the change from one range to another occurs at a precise position and thus almost instantaneously which is important for the safe operation of this mechanism.

FIG. 40 is a pictorial representation of forces acting on the auto-balancing system in accordance with an illustrative embodiment. The forces shown may be utilized to determine calculations for mounting forces.

Figure 41:
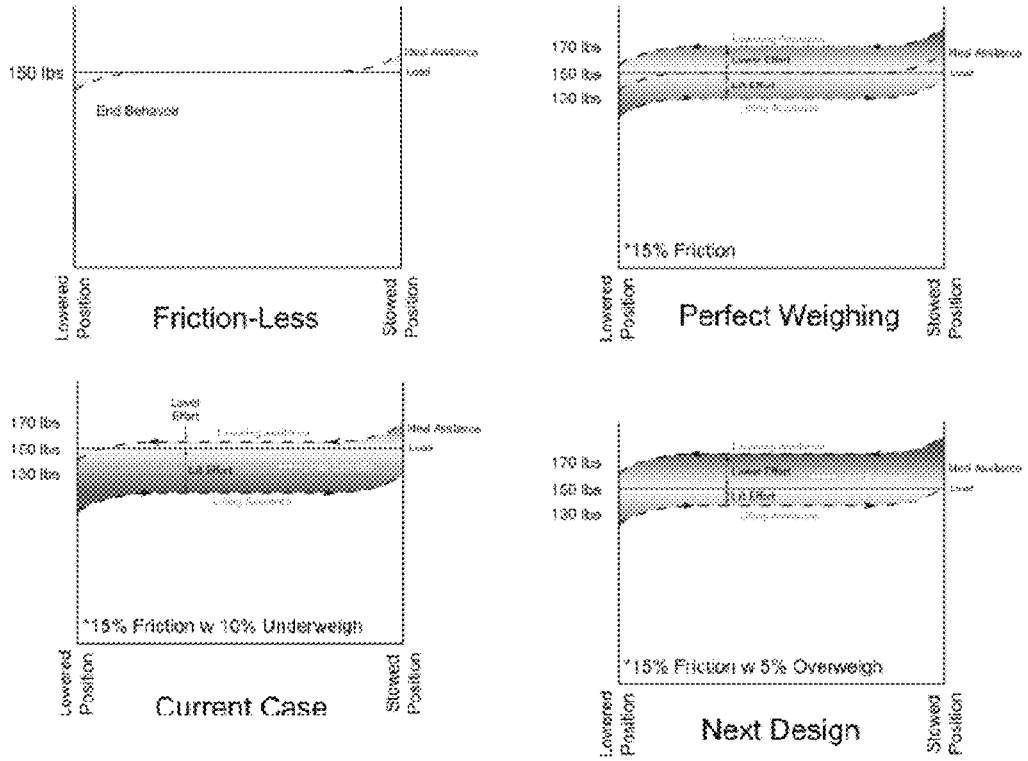
FIG. 41 are graphs illustrating lift assistance provided by an auto-balancing system in accordance with an illustrative embodiment.

FIG. 41 are graphs illustrating lift assistance provided by an auto-balancing system in accordance with an illustrative embodiment. The frictionless graph shows an ideal force curve at maximum capacity. At the bottom of the stroke, the balancing force is less than the load, thus keeping the tray locked at the lowered position. At the top of the stroke, the balancing force is greater than the load, keeping the tray naturally at the top position. As is known, any system will have some friction loss such that the assistance on the way up is less than the assistance on the way down. The system may be configured such that system will automatically adjust itself to a load so that the effort required by a user, or other assistance device is the approximately same on the way up as on the way down. In another embodiment, the system may be configured so that it adjusts preferably to require less assistance in one direction verses the other direction. For example, it may be beneficial to a user to use if it is easier for a user to pull down on a tray than lift up on a tray. In one embodiment, the auto-balancing system may be configured to require less input on the way up as opposed to the way down.

Figure 42:
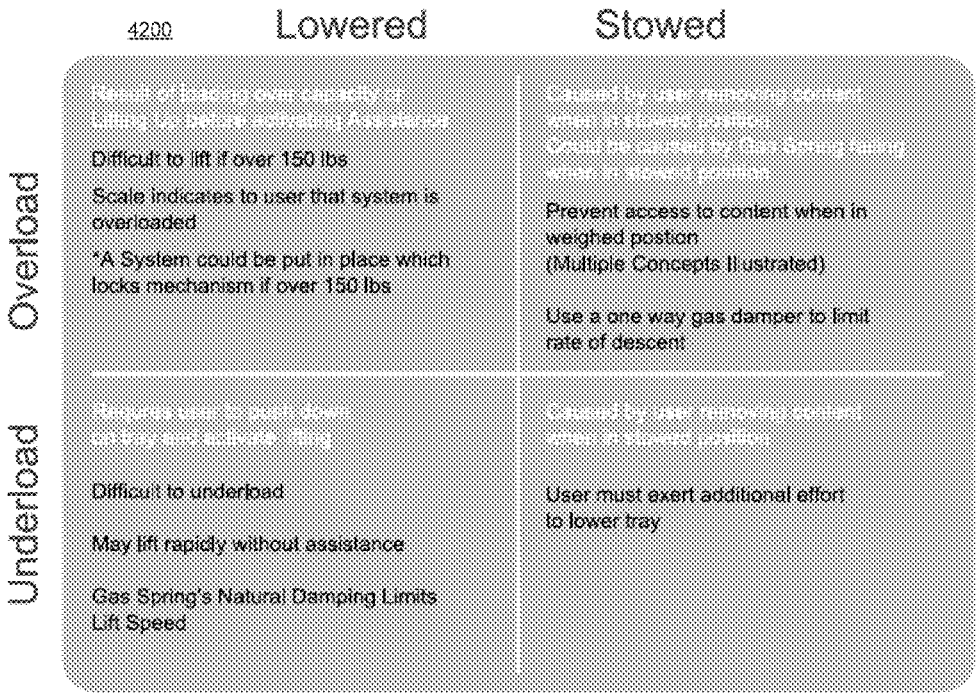
FIG. 42 is a table illustrating conditions for an auto-balancing system in accordance with an illustrative embodiment.

FIG. 42 is a table 4200 illustrating conditions for an auto-balancing system in accordance with an illustrative embodiment. The table 4200 details results of various conditions and factors that may affect the auto-balancing system, such as when lowered and stowed and when overloaded or under-loaded. The table 4200 represents several possible failure modes and possible remedies.

Any of the methods or mechanisms used herein may be used with an electric motor, to stabilize the tray, guide the tray up and down, further including the processes and methods of assembly, methods of enclosing the tray, and so forth.

Figure 43A:
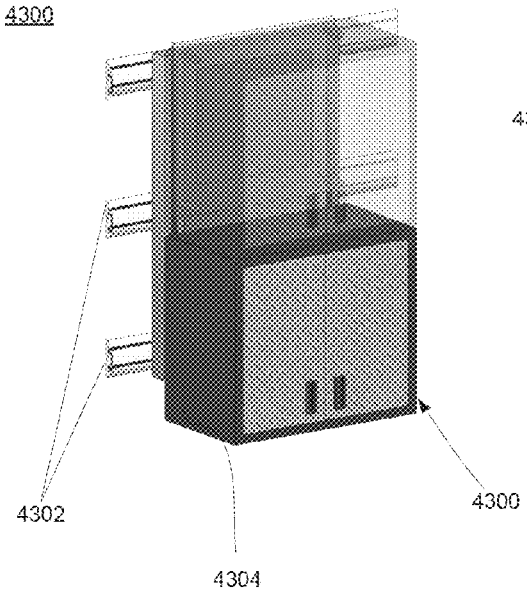
FIGS. 43A-B are a pictorial representation of a vertical lift cabinet in accordance with an illustrative embodiment.
Figure 43B:
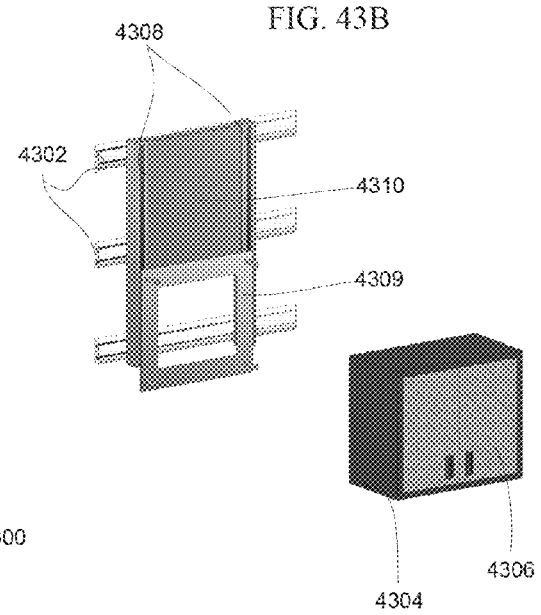

FIGS. 43A-B are pictorial representations of a vertical lift cabinet 4300 in accordance with an illustrative embodiment. The vertical lift cabinet 4300 may be attached to mounts 4302. The mounts 4302 are supports that are attachable to a wall of a building or other structure. The vertical lift cabinet 4300 may include cabinets 4304, doors 4306, tracks 4308, a lift assembly 4309, and lift mechanism 4310. In one embodiment, the vertical lift cabinet 4300 may be positioned above the head of a user to be lowered into an accessible position for loading and unloading.

The mounts 4302 may be any number of standard, third party, or proprietary channels, panels, rails, hanging systems, or mounts configured to attach to wall structures, studs, dry wall, pins, bolts, or so forth. The tracks 4308 may represent a vertical track system that may contain and control the motion of the vertical lift cabinet 4300. For example, the tracks 4308 may include slits configured to receive wheels, bearings, slides, or other components of the lift mechanism 4310.

In one embodiment, the lift assembly 4309 is configured to secure the cabinets 4304 to the lift mechanism 4310. The lift assembly 4309 and lift mechanism 4310 may be mechanically connected utilizing one or more cables and pulleys for raising and lowering the cabinets 4304 for access by the user.

In one embodiment, the lift mechanism 4310 may include a lifting engine or counterbalancing mechanism, mounting plate or base, wheels, and so forth. The cabinets 4304 may connect to the lift assembly 4309 utilizing bolts, pins, screws, rivets, quick releases, or other attachment mechanisms. The lift mechanism 4310 is configured to automatically adjust to the weight in the cabinet as previously discussed. For example, the lift mechanism 4310 may be in an adjustment mode when the cabinets 4304 are in a lowest position. As a result, the lifting engine may adjust to the addition or removal of weight from the cabinets 4304.

The doors 4306 may be configured to open to access the contents of the cabinets 4304. The cabinets 4304 may include locks, latches, or other components for securing the doors 4306. In another embodiment, the cabinets 4304 may include shelves and an additional moving storage system (as is shown and described herein) that extends out and down of the cabinets 4304 for further accessing the contents of the cabinets 4304. As a result, the cabinets 4304 may be mounted in a high position to free up floor space while still providing full access to the contents of the vertical lift cabinets 4300.

In one embodiment, the counterbalance mechanism in the lift mechanism 4310 is attached to the lift assembly 4309 by cables that extend through the tracks 4308. The lift mechanism 4310 may be configured to be fixed in a static position relative to the cabinets 4304 or may move with the cabinets 4304. For example, the lift mechanism 4310 may be integrated with the lift assembly 4309.

Figure 44A:
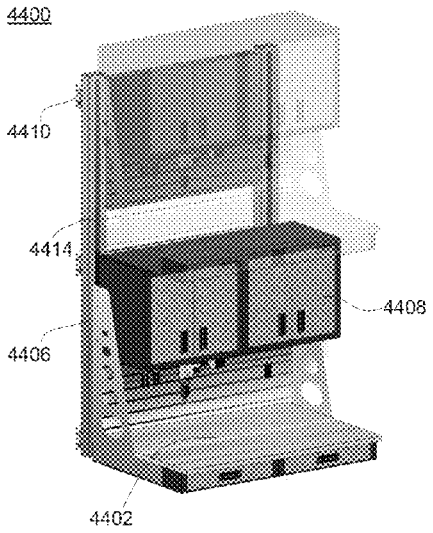
FIG. 44A is a pictorial representation of a moveable work bench in accordance with an illustrative embodiment.
Figure 44B:
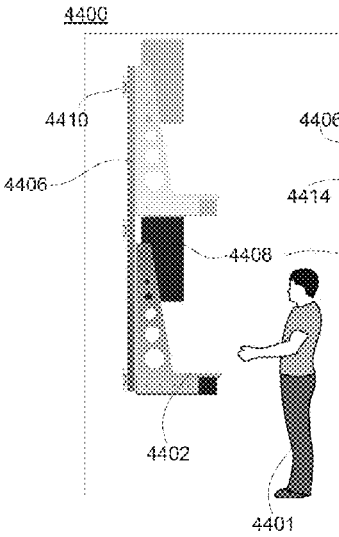
FIG. 44B is a side view of the moveable work bench of FIG. 44A in accordance with an illustrative embodiment.
Figure 44C:
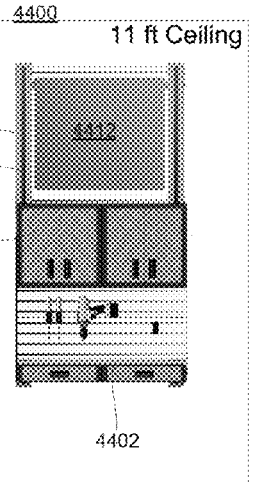
FIG. 44C is a front view of the moveable work bench of FIG. 44A in accordance with an illustrative embodiment.

FIGS. 44A-C are pictorial representations of a moveable work bench 4400 in accordance with an illustrative embodiment. In one embodiment, the moveable work bench 4400 may be moved between an upper and lower position. The moveable work bench 4400 may be configured to be lowered to a position selected by a user 4401 based on the user's height and needs. In another embodiment, the moveable work bench 4400 may be moved between a lower (e.g. floor level) position and an upper usable position (e.g. waist high). The moveable work bench 4400 may be dynamically balanced for receiving goods for storage on a work bench 4402 or in the cabinets 4404. For example, the moveable work bench 4400 may adjust to the weight of the work bench 4402 and the cabinets 4408 when in a lower position (associated with an adjusting mode).

The moveable work bench 4400 may include a latch, lock, pin, or other locking mechanism for fixing the moveable work bench 4400 in place whether extended or stowed. The locking mechanism provides additional safety, support, and stability. As a result, a user may affix the moveable work bench 4402 in place to do work at a rigid work station. In one embodiment, the moveable work bench 4400 may be assembled from existing goods or products, such as drawers, a work surface or work bench 4402, a back surface with a rack 4406, cabinets 4408, mounting rails 4410, and so forth. For example, a counterbalance mechanism 4412, rails 4414, and connecting cables (not shown), may be required to assemble or generate the moveable work bench 4400. In one embodiment, side brackets may provide stability to the moveable work bench 4400. Any number of brackets, cables, rails, tethers, or other supports may be attached to the moveable work bench 4400 or structural surface (i.e., wall) securing the moveable work bench 4400.

In one embodiment, each of the components of the moveable work bench 4400 may be separately shipped, mounted, and attached to form the moveable work bench 4400. For example, the balance mechanism 4412 may be a force engine or lowering mechanism as was previously described. The work bench 4402 and the cabinets 4408 may be slidably attached to the rails 4414. For example, the work bench 4402 and the cabinets 4408 may include wheels, bearings, rollers, or slides configured to roll or slide as the moveable work bench 4400 is adjusted between positions. The rails 4414 may securely attached to securing components of the work bench 4402 and the cabinets 4408.

The work bench 4402 may be utilized to store projects, tools, or so forth. In another embodiment, the work bench 4402 may be a tool bench dedicated to securing one or more commercial grade or personal tools, such as a drill press, table saw, band saw, or other tool.

Figure 45:
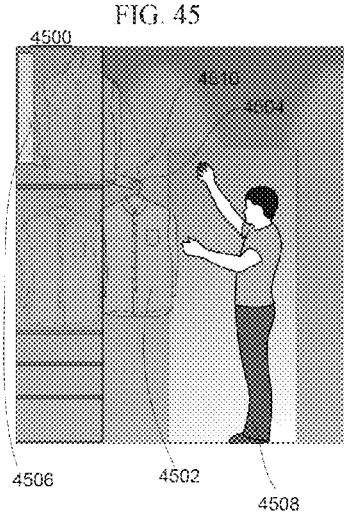
FIG. 45 is a pictorial representation of a moveable clothes rack in accordance with an illustrative embodiment.

FIG. 45 is a pictorial representation of a moveable clothes rack 4500 in accordance with an illustrative embodiment. The moveable clothes rack 4500 may be utilized to raise and lower clothes 4502 hung on a closet rod 4504. In one embodiment, a user may have an upper clothes rod 4504 that is above the head of the user in a stowed or upper position. The user may grip the closet rod 4504 or the clothes 4502 to reposition the moveable clothes rack 4500. Alternatively, a strap, handle, or other gripping (or mechanical or electrical mechanism not shown) may be utilized to move the moveable clothes rack 4500 to an access or lower position or be gripped by the arm of the user 4508.

In the access position, the counterbalance mechanism 4506 may weigh the clothes and other stored goods attached to or hanging on the clothes rod 4504 to provide the necessary lift and support forces when moving the clothes rod 4504 to a stored position. The counterbalance mechanism 4506 may be mounted at the back or side of the moveable clothes rack 4500 for driving the motion of the clothes rod 4504. The moveable clothe rack 4500 may utilize the out and down motion previously described or a down and out motion (J-arch) to lower the clothes or other hung or stored goods. The moveable clothes rack 4500 may also be utilized to lift clothes out and up to a user 4508 in a similar embodiment. The moveable clothes rack 4500 may be utilized in residential, commercial, industrial, or other settings.

In one embodiment, the user may rotate or twist the clothes rod 4504 to transition between modes. For example the ends of the rod 4504 may include cables or a linkage connected to the counterbalance mechanism 4506 configured to transition between modes. In another embodiment, the lift arms 4510 may operable by a remote lever, and may include a lever for actuating the lift arms 4510 up or down.

Figure 46:
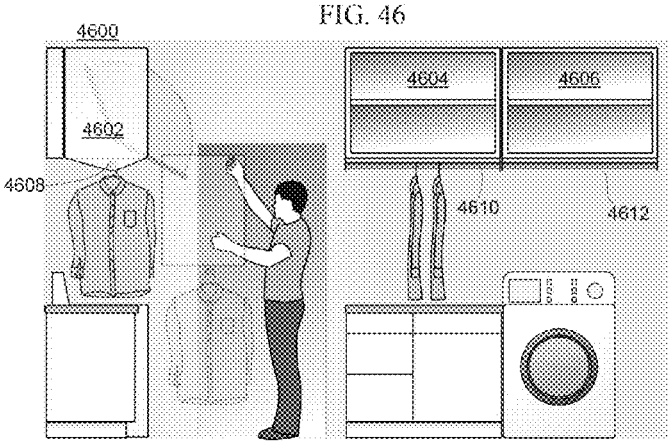
FIG. 46 is a pictorial representation of a moveable clothes rack and moveable shelves in accordance with an illustrative embodiment.

FIG. 46 is a pictorial representation of a counterbalanced cabinet system 4600 in accordance with an illustrative embodiment. The counterbalanced cabinet system 4600 may include cabinets 4602, 4604 and 4606. The cabinets 4602, 4604, and 4606 may include clothes rods 4608, 4610, and 4612. As a result, the cabinets 4602, 4604 and 4606 may be loaded with goods, clothes, and other stowable goods increasing the functionality of the counterbalanced cabinet system 4600.

As shown, the counterbalanced cabinet system 4600 may be particularly useful in laundry rooms, laundromats, closets, storage rooms, and so forth. In one embodiment, each of the cabinets 4602, 4604, and 4606 may include a counterbalance mechanism. In another embodiment, the cabinets may share a single counterbalance mechanism with only one of the cabinets able to be lowered at a time.

FIGS. 47A-D shows mechanism for changing modes between a weigh and lift mode in accordance with illustrative embodiments. The mechanisms of FIGS. 47A-D are alternatives to an activation handle or other mechanisms previously described. The embodiment shown is for a moveable storage rack 4700 similar to that shown in FIG. 45, however, the mechanisms described may be utilized with any of the storage or counterbalance systems herein described. The illustrative mechanisms may be particularly useful when the system does not include a tray or the movable portion is out of reach. The described mechanisms may be biased so that the counterbalance mechanism only enters an adjusting mode in response to user input to transition between a lifting/lowering mode and the adjusting mode.

Figure 47A:
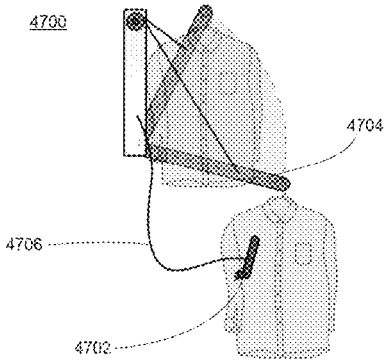
FIG. 47 A-D are side views of a moveable clothes rack in accordance with illustrative embodiments.

Referring now to FIG. 47A, this shows an activation handle 4702 that is attached to the side of a stationary cabinet, wall, or so forth. When the activation handle 4702 is pulled, pressed, or activated a transition force may be provided through a cable 4706, the counterbalance mechanism (not shown) may transition between a lowering mode (providing a lifting or lowering force) and an adjustment mode and back again. For example, the cable 4706 may represent a protected cable with a housing or sheath to protect the user and ensure motion of the cable 4706. In another embodiment, the activation handle 4702 may also be utilized to release the lifting arms 4704 from a stowed position to a load position and between the associated lift mode and weigh mode.

Figure 47B:
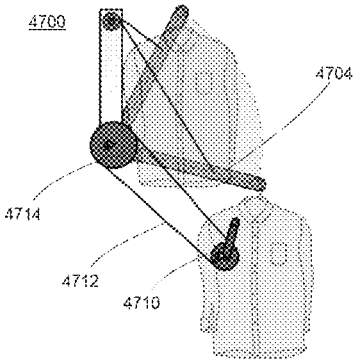

Turning now to FIG. 47B, showing a crank 4710 (or other moveable member) attached to a side of a cabinet (not shown). The crank 4710 may not be directly tied to the lifting arms 4704. For example, a connecting component, such as cable, rod, belt, chain, gears or so forth may transmit user input between the crank 4710 and the counterbalance mechanism. For example, a belt 4712 and gear 4714 may be connected to the lifting arms 4704. The gear 4714 is shown as attached at a base of the lifting arms 4704. However, the gear 4714 may be connected to any portion of the counterbalance mechanism or lifting arms 4704. In one embodiment, the first portion of force generated by the user utilizing the crank 4710 is utilized to activate the lifting mode and after that the crank 4710 is utilized to provide the mechanical force which provides the minimal amount of effort that is needed to lift or guide the load up into the stowed position in a controlled manner.

Figure 47C:
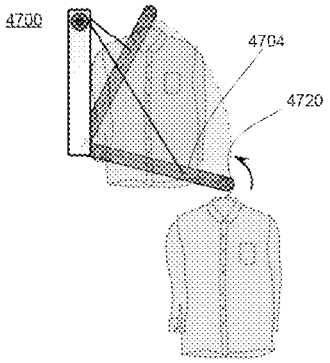

Turning now to FIG. 47C, this shows a rod 4720 being utilized as the transition component. In one embodiment, the rod 4720 may be twisted to activate the weighing and lifting modes through a linkage between the rod 4720 and the counterbalance mechanism. For example, by twisting the rod 4720 counter clockwise, the counterbalance mechanism may be placed in an adjusting mode and releasing the rod 4720 may transition the counterbalance mechanism to a lifting mode. With other embodiments, different components of the counterbalance mechanism may be twisted, rotated, or moved to engage and disengage the modes of the counterbalance mechanism.

Figure 47D:
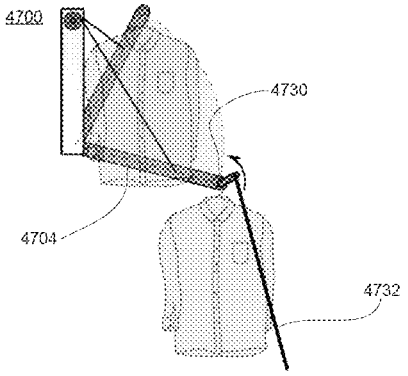

Turning now to FIG. 47D, this shows a link 4730 at one or more ends of the lifting arms 4704. The link 4730 may be hingedly attached to a rod 4732. For example, when the user pushes on the rod 4732, the link 4730 is rotated transmitting a displacement from the user input to the lifting mechanism to activate the lifting mode. The rod 4732 may also be utilized to guide the load including a clothes rod 4834 to the stowed position. The rod 4732 may also be utilized to lower the clothes rod from the stowed position back down to the loading position. For example, the link 4730 may be activated with a downward force from the rod 4732 to release an interconnected latch (not shown) securing the moveable storage rack 4700 in a storage position. The rod 4732 may represent any number of straps, handles, cords, or so forth. The link 4730 and the rod 7432 may make the moveable storage rack 4700 accessible when positioned high above a user's head.

The embodiments of FIGS. 47A-47D may be similarly amended to function with other counterbalance mechanisms, such as the lifting systems and storage systems herein described. For example, the described mechanisms may be utilized to bring the lift arms to an accessible position and transition between a lifting/lowering mode and an adjusting mode for adjusting to the imposed weight.

Figure 48:
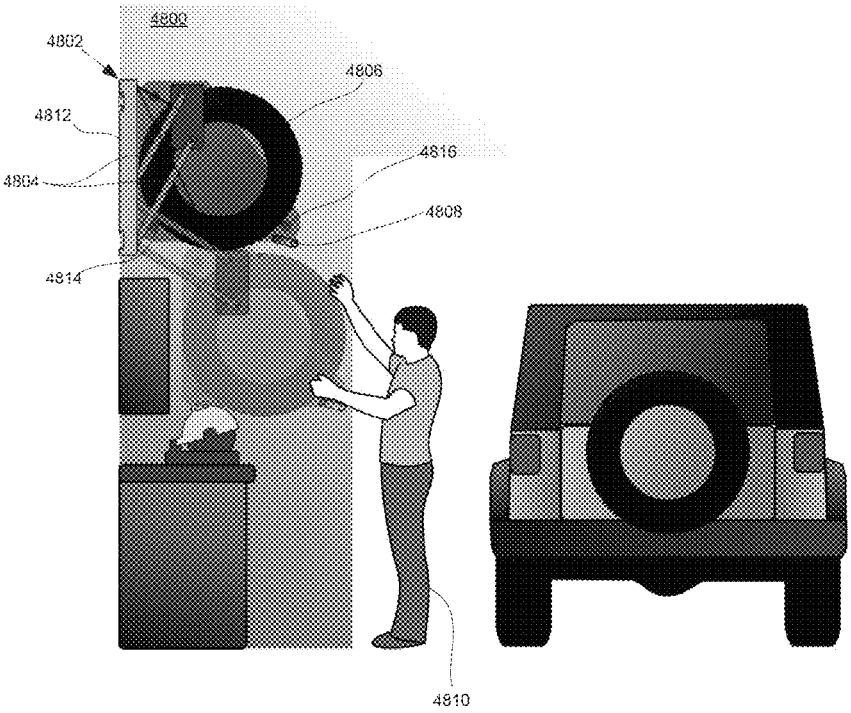
FIG. 48 is a pictorial representation of a moveable tire rack in accordance with an illustrative embodiment.

FIG. 48 is a pictorial representation of a moveable tire storage system 4800 in accordance with an illustrative embodiment. The moveable tire storage system 4800 may utilize a tire rack 4802 and lift arms 4804 to raise and lower tires 4806. For example, the moveable tire storage system 4800 may be mounted to a wall in a garage for storing winter or off-road tires for access when needed. As a result, additional space is left for a vehicle and other goods stored in a garage. The moveable tire storage system 4800 may also be utilized in a tire store or repair shop to increase the accessibility and usable store space.

In one embodiment, the moveable tire storage system 4800 may sit on two rods or supports 4814 and 4816. The tires 4806 may rest on the supports 4814 and 4816 when stored. In other embodiments, the tire rack 4802 may include hooks, clamps, straps, or extensions for securing or hanging the tires 4806 from the moveable tire storage system 4800.

In one embodiment, the supports 4814 and 4816 may be configured to rotate freely for rolling the tires onto the supports 4814 and 4816. In another embodiment, the supports 4814 and 4816 may include any number of fixed or pivoting rollers or bearings.

In one embodiment, the moveable tire storage system 4800 may include an activation handle 4808 at a front portion of the tire rack 4802 to release the tires 4806 to be lowered for access by a user 4810. The counterbalance mechanism 4812 is installed at the back of the tire rack 4802. In another embodiment, the counterbalance mechanism 4812 may be installed below the tire rack 4802 or remotely from the tire rack 4802 and connected by cables and pulleys to lower and raise the tires 4806. For example, because of the potential weight involved, the size of the lift mechanism may be increased.

The tires 4806 are shown in this embodiment, however, the storage system 4800 may be utilized for any number of products, goods, tools, equipment, where the weight may vary. The storage system 4800 may also be connected to moveable structures, such as a fire truck for raising and lowering ladders, hoses, personal breathing apparatuses, heavy equipment (i.e. power tools) or other equipment.

Figure 49:
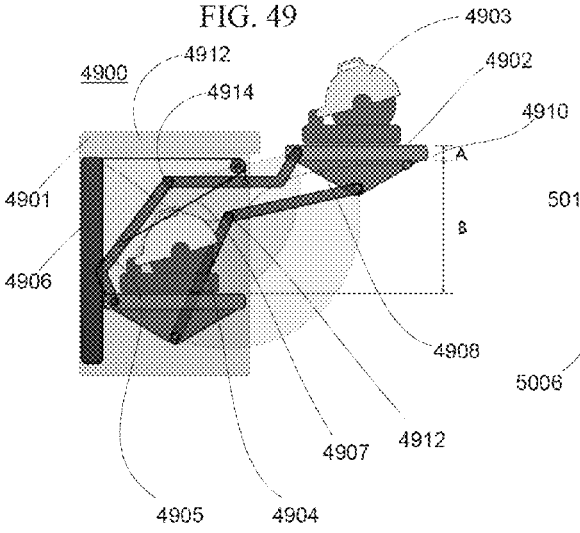
FIG. 49 is a pictorial representation of a liftable storage system in a raised position in accordance with an illustrative embodiment.

Turning now to FIG. 49, this shows a pictorial representation of liftable storage system 4900 in accordance with an illustrative embodiment. FIG. 49 shows the liftable storage system 4900 moving between a lowered position and a raised position. The liftable storage system 4900 may be utilized to lift goods up to a user with no user input or minimal user input. The liftable storage system 4900 may be utilized to perform arced lifting (out-and-up, or up-and-out).

The liftable storage system 4900 may include a frame 4901, a lift tray 4902, lifting arms 4904 and 4905, a counterbalance mechanism 4906, cables 4907, an activation cable 4908, and a handle 4910. The liftable storage system 4900 may have the counterbalance mechanism 4906 positioned in the back, side, or bottom of the liftable storage system 4900. The liftable storage system 4900 may raise the lift arm in response to the user activating a release or in response to minimal user force (e.g. pulling the lift tray 4902 out and up). For example, the liftable storage system 4900 may be configured to move between a stowed or storage position and the loading or operating position in response to a user activating the handle 4910.

As previously disclosed, the counterbalance mechanism 4906 drives the motion of the lifting arms 4904 and 4905. The lifting arms 4904 and 4905 may be configured as a four bar linkage as shown. The lifting arms 4904 and 4905 may be shaped to allow for lifting around interfering structural components. For example, the lifting arms 4904 may be straight and attach to a bottom portion of the lift tray 4902. The lifting arms 4905 may have a dog leg shape. For example, the lifting arm 4905 may curve back toward the lift tray 4902 to avoid hitting the stored goods. For example, pivots 4912 and 4914 are hingedly attached to the lifting arms 4904 and 4905 and may be positioned to avoid instability as the lifting arms 4904 and 4905 are moved between a storage and access position. In one embodiment, pivots 4912 ad 4914 are attached to the frame or sides of the liftable storage system. In other embodiments, the pivots 4912 may be connected to support beams, panels, or other similar members.

In another embodiment, the lifting arms 4904 and 4905 may be configured as previously disclosed except for being configured for an out-and-up configuration. As shown, a load 4903 is stored in the lift tray 4902 out of the way under a work surface 4912. The work surface 4912 may be a table, shelf, counter, desk, rack, storage component, work bench, or so forth. The cable 4908 and the handle 4910 are utilized to transition the counterbalance mechanism 4906 between modes. The cable 4908 and the handle 4910 may also be utilized to release the lift tray 4902 from the stowed position or loading position shown in FIG. 49. The adjustment of the counterbalance mechanism 4906 may occur in the raised position as shown in FIG. 49. In another embodiment, the counterbalance mechanism 4906 may be configured to adjust at another position along the lift path.

The counterbalance mechanism 4906 provides a force to drive the lift tray 4902 between the stowed position and the loading position in response to minimal (or zero) user input, force, or guidance. For example, the lift tray 4902 may include a handle, straps, foot plate, drive pedal, electrical switch, button, crank, hook, or other component for gripping or providing an input force. The counterbalance mechanism 4906 may also utilize an electric motor, static force, pneumatic, or hydraulic motor or generator to drive the motion of the lift tray 4902.

In one embodiment, the liftable storage system 4900 may include the handle 4910 or release as previously described for transitioning between an operating (lifting or lowering) mode and an adjusting mode. For example, the handle 4910 or lever is a release that when moved, engaged, or activated transfers an input through the activation cable 4908 to reconfigure the counterbalance mechanism 4906 to provide a force that is applied by the counterbalance mechanism 4906 to the cable 4908, lifting arms 4904 and 4905, and the lift tray 4902. In one embodiment, the handle 4910 may only be activated when the lift tray 4902 is fully extended. For example, the lift tray 4902 may receive a new or changed load 4903 necessitating an adjustment to the counterbalance mechanism 4906 that is performed automatically or in response to a user input or selection of the handle 4910. The adjustment to the counterbalance mechanism 4906 allows the counterbalance mechanism 4906 to provide or generate a counterbalancing force to that of the load 4903 through the displacement path. Activation of the handle 4910 may reconfigure the counterbalance mechanism 4906 and temporarily set the counterbalance force. In another embodiment, the handle 4910 may be activated when the lift tray 4902 is stowed or partially extended. The handle 4910 may also be utilized to release the lift tray 4902 from a stored position.

The liftable storage system 4900 may also include one or more latches, supports, linkages, or locking mechanisms for temporarily locking the lift tray 4902 in place whether extended or stowed. The locking mechanism provides additional safety, support, and stability. For example, the lift tray 4902 may be linked to the work surface 4912 by a linkage providing stabilization support and mechanical relief for the various components. In another embodiment, legs may be extended from the lift tray 4902 to stabilize the lift tray 4902.

Figure 50:
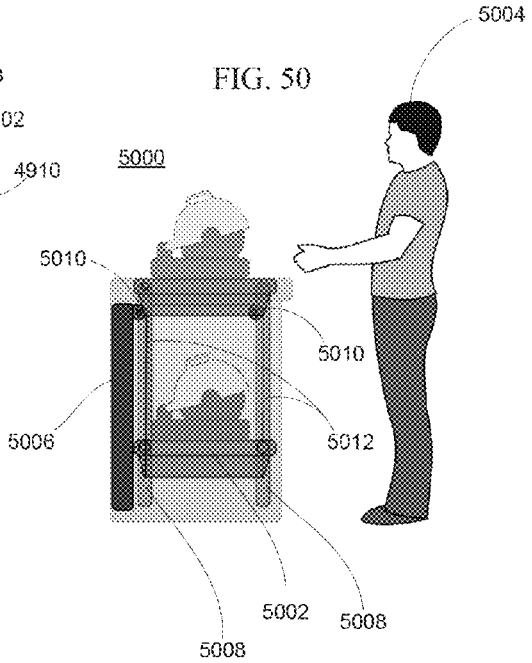
FIG. 50 is a pictorial representation of a liftable storage system in a stored position in accordance with an illustrative embodiment.

FIG. 50 is a pictorial representation of a liftable storage system 5000 in accordance with another illustrative embodiment. The liftable storage system 5000 may be configured to vertically lift a lifting tray 5002 to a user 5004. The liftable storage system 5000 may transfer forces generated by a counterbalance mechanism 5006 to vertical forces utilized to lift the lifting tray 5002. The liftable storage system 5000 may include rails 5008 (or guides), pulleys 5010, and one or more cables 5012 for transferring and applying the forces from the counterbalance mechanism 5006 to the lifting tray 5002.

In one embodiment, the liftable storage system 5000 may store any number of goods. For example, the lifting tray

5002 may represent a table saw that is lifted up for the user to access. Although not shown, the liftable storage system 5000 may include a lift up cover, flip up cover, retractable cover, work surface, or sliding cover for utilizing a top surface of the liftable storage system 5000 when the lifting tray 5002 is stored. For example, the liftable storage system 5500 may be utilized as a standard counter or bench and then when needed, the lifting tray 5002 may be raised up for access by the user. The lifting tray 5002 may be locked in place when stored or when extended utilizing a latch, pins, mechanical or electrical switch, or other locking mechanism.

The liftable storage system 5000 (and any of the described embodiments) may also include integrated electrical connections, such as an outlet and the corresponding wiring for powering one or more tools, appliances, or other electrical instruments. In one embodiment, the wiring may be inserted through the frame of the liftable storage system 5000. The wiring may also include contacts or an adaptable cord for being raised and lowered with the lifting tray 5002. In one embodiment, the liftable storage system 5000 may include a central plug for power one or more outlets and an electric motor of the liftable storage system 5000 if utilized. A power switch shutoff may ensure that connected tools or devices may not be powered on until the lifting tray 5002 is in a raised/extended and locked position.

The liftable storage system 5000 may have a smaller footprint than other lifting systems. The liftable storage system 5000 may be ideal for individuals with handicaps, disabilities, back or bending problems, or so forth. As a result, any number of goods may be lifted up to a user for any number or reasons, needs, benefits, or convenience.

In other embodiments, the liftable storage systems may lift or move a lifting tray or goods diagonally, horizontally, or so forth. In addition, the lifting tray 5002 may be replaced my any number of shelves, tools, surfaces, accessories, or so forth.

Figure 51:
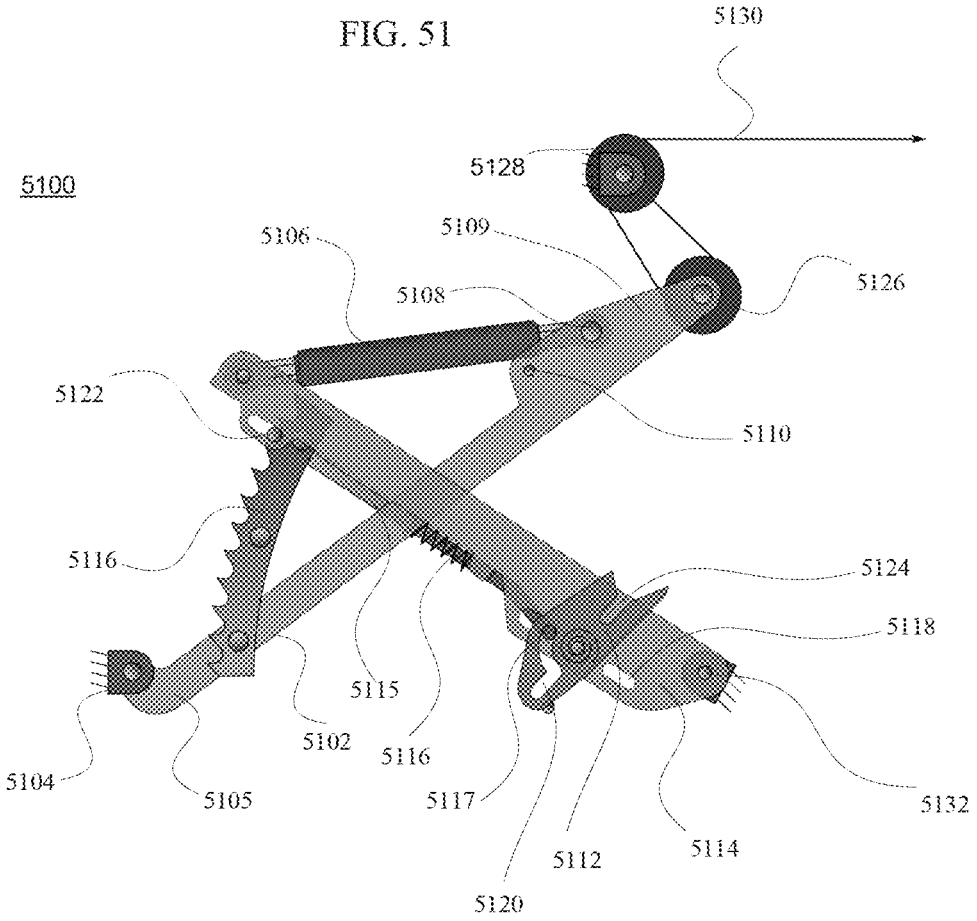
FIG. 51 is a pictorial representation of a lifting engine in accordance with an illustrative embodiment.

FIG. 51 is a pictorial representation of a lifting engine 5100 in accordance with an illustrative embodiment. Likewise, FIGS. 52A-F are pictorial representations of the lifting engine 5100 of FIG. 51 in different positions. The different positions represent operation of the lifting engine 5100. As previously described, the lifting engine 5100 may function in a lifting mode (FIGS. 53A-B) and in an adjusting mode (FIGS. 53C-53E) and show as stowed in FIG. 53F. The lifting engine 5100 differs from the previously described engines and counterbalance mechanisms in that the lifting engine 5100 allows for adjustment when the energy reservoir 5106 (spring) is in an unloaded, low energy, raised position as opposed to adjustment when the energy reservoir 5106 is in a loaded, high energy, lowered position.

The lifting engine 5100 includes many of the components previously described. In one embodiment, the lifting engine 5100 includes a traveling member 5102 (or link arm) hingedly connected to a hinge 5104 at a first end 5105 and an energy reservoir 5106 at an attachment point 5108 at a second end 5109. The travelling member 5102 also includes a roller 5110 utilized for coupling with a coupling link 5112 hingedly attached to a variable member 5114 (or weigh arm).

The pivoting motion of the coupling link 5112 is driven by a locking rod 5115 that is biased by a spring 5116 and includes a change pin 5117 that slides within a slot 5118 of the variable member 5114 and a slot 5120 of the coupling link 5112. Another end of the locking rod 5115 interacts with a tooth plate 5116 utilizing a locking pin 5122. As shown, the locking rod 5115 is slidably attached to the variable member 5114 for changing the lifting engine 5100 between an operating mode and an adjustment mode. The coupling link 5112 may include a slot 5124 configured for receiving the roller 5110 for transitioning between modes. The lifting engine 5100 may also include pulleys 5126 and 5128, a cable 5130, and a hinge 5132. The pulley 5126 may be rotationally attached to the second end of the traveling member 5102.

In one embodiment, the cable 5130 may be fixedly attached at one end to the pulley 5128 and then wrap around the pulley 5126 attached to the lift arm 5102 and then back around pulley 5128 and then attached to the applicable load (not shown), such as a shelf that is being raised to an access position and then lowered to a stowed position. The cable 5130 and configuration of the pulleys 5126 and 5128 provides various advantages including that a greater stroke or motion of the cable 5130 is output for moving connected devices. In another embodiment, the cable 5130 may also be attached directly to the end of the arm. As was previously described, any number of pulleys may be utilized to redirect the forces applied by the lifting engine 5100 for raising, lowering, or moving connected components or goods in innumerable directions.

As shown, a number of components may be attached to the fixed or static points (i.e. grounded), such as immovable portions of the auto balancing cabinets, walls, or other structures. For example, the pulley 5128, the tooth plate 5116, the hinge 5104, and the hinge 5132.

The lifting engine 5100 is adjusted when the energy reservoir 5106 is compressed. To do this, the lift arm 5102 and the variable member 5114 (weigh arm) are in the same region (overlap each other) as opposed to the other embodiments.

Figure 52A:
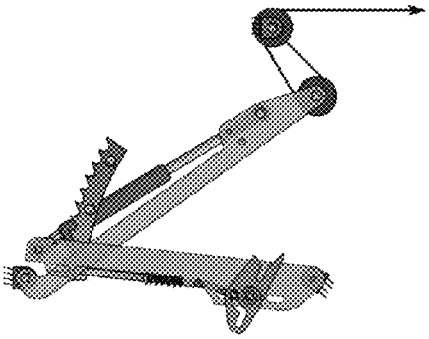
FIGS. 52A-F are pictorial representations of the lifting engine of FIG. 51 in different positions in accordance with illustrative embodiments.
Figure 52F:
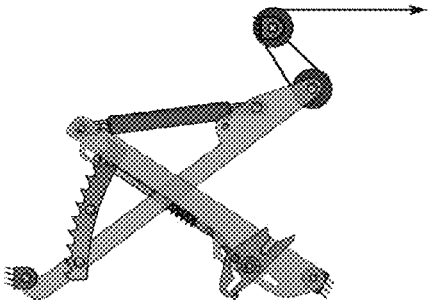
Figure 52B:
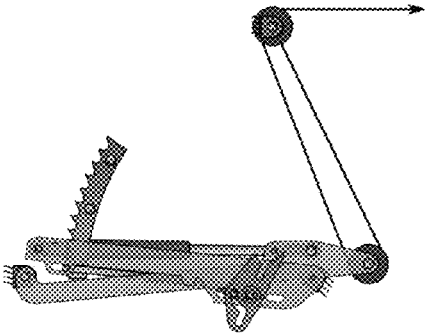
Figure 52E:
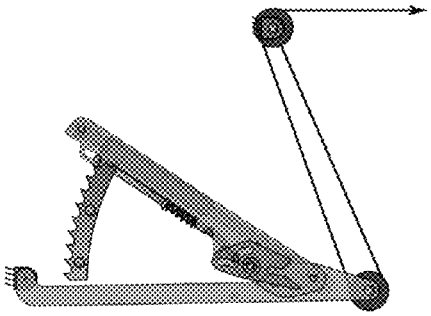
Figure 52C:
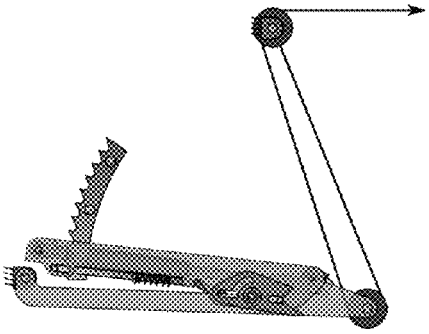
Figure 52D:
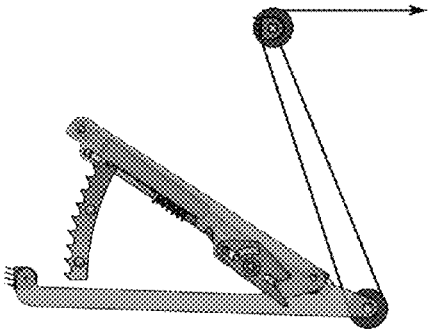

FIGS. 52A-F illustrate the changes in the lifting engine 5100 during the modes. In FIG. 52A, the load of the lifting engine 5100 is in the lowered position with the energy reservoir at a minimum capacity, in FIG. 52B the lifting engine is approaching and transitioning to the adjusting/weigh mode at minimum capacity, in FIG. 52C the force engine is in adjust mode at minimum capacity, in FIG. 52D the engine is in adjust mode and has adjusted to maximum capacity, in FIG. 52E the lifting engine is leaving the adjusting mode, and in FIG. 52F the load is in a stowed position at a maximum capacity.

Figure 53:
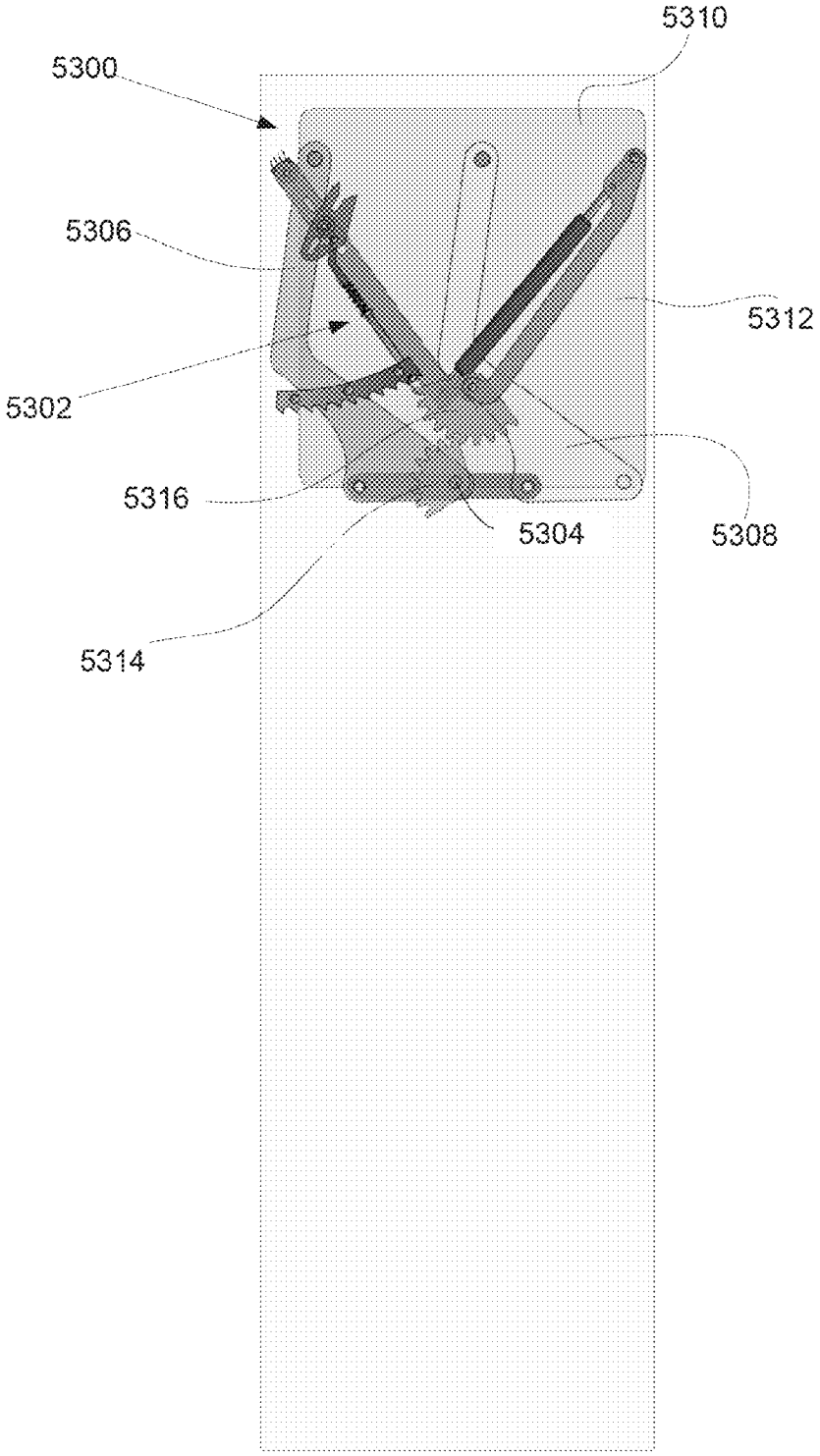
FIG. 53 is a pictorial representation of a shelf storage system in accordance with an illustrative embodiment.
Figure 54:
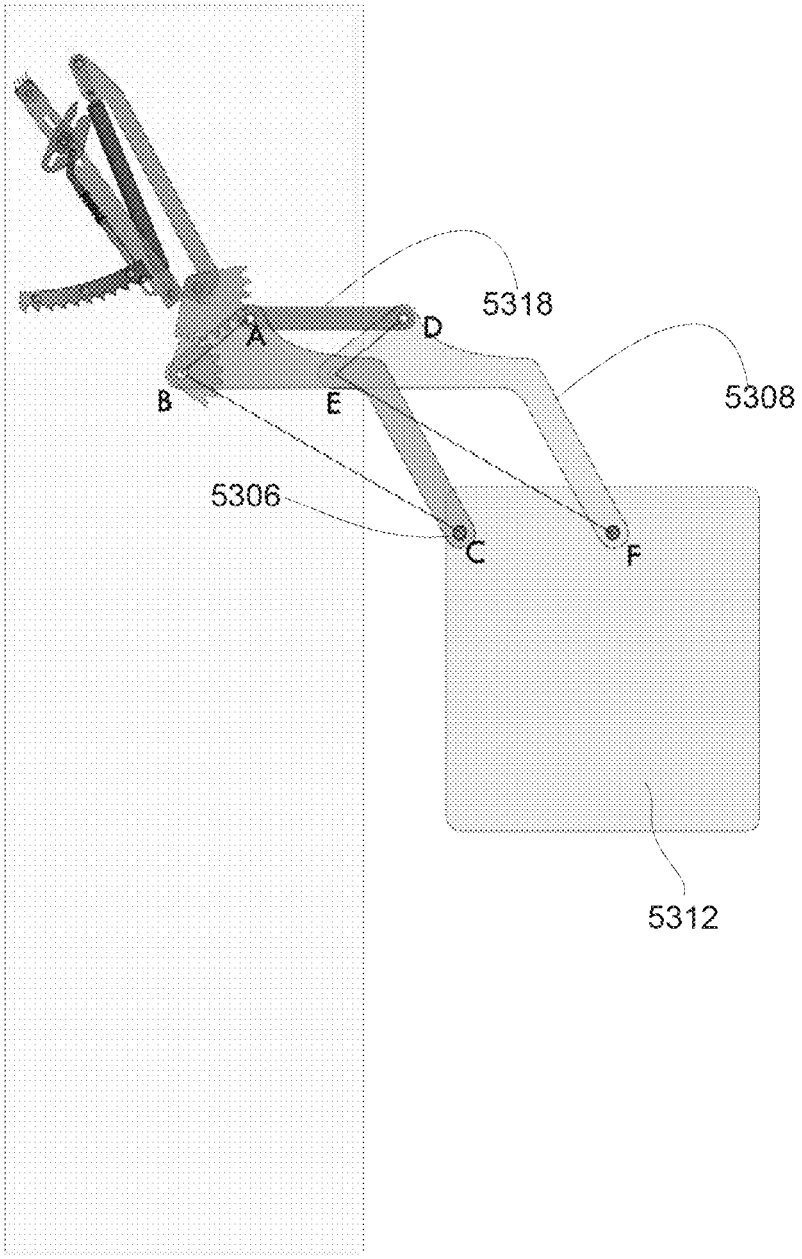
FIG. 54 is a side view of the shelf storage system of FIG. 53 fully extended in accordance with an illustrative embodiment.
Figure 55:
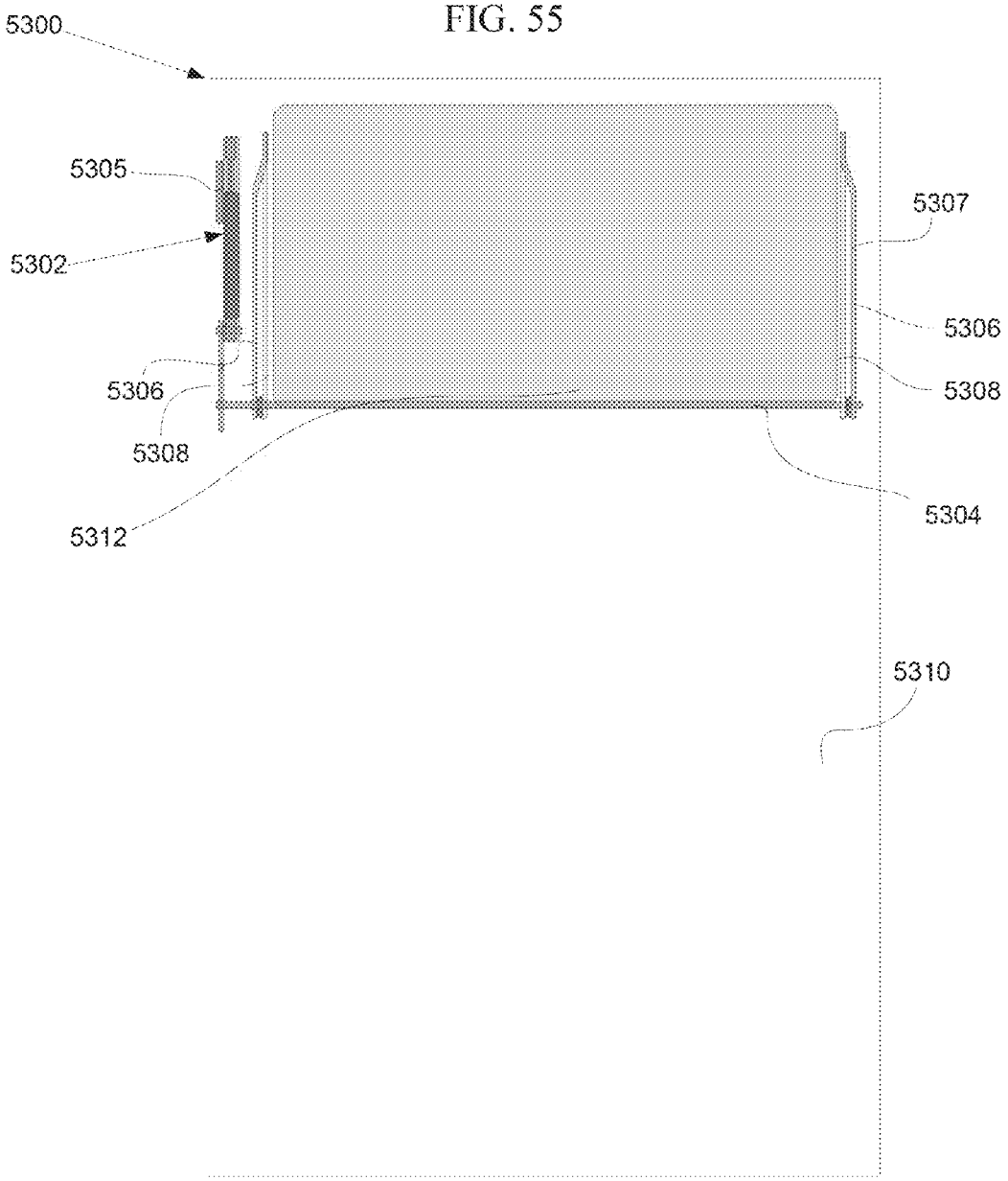
FIG. 55 is a front view of the shelf storage system of FIG. 53 in accordance with an illustrative embodiment.

Referring now to FIGS. 53-55, the illustrative embodiments illustrate a shelf storage system 5300. In one embodiment, the shelf storage system 5300 is a stand-alone and modular system configured to be inserted as an upper shelf, replacement shelf, or storage component. In another embodiment, the shelf storage system 5300 may be assembled from different components as are described herein. For example, the shelf storage system 5300 may be integrated in a shelf structure for insertion in cabinets, furniture, closets, small rooms, or against a wall (the "structures").

The shelf storage system 5300 may be configured to lower goods as shown (or lift goods as was previously described). In one embodiment, the shelf storage system 5300 may be inserted and then fitted into the structure and then be ready to use in providing assisted storage. The shelf storage system 5300 may be useful for utilizing spaces that are unavailable to most users (short or otherwise). For example, the shelf storage system 5300 may replace higher shelves or empty spaces that are typically inaccessible to most users without a chair, stepping stool, ladder, or so forth.

In one embodiment, the shelf storage system 5300 may be inserted into a structure. The shelf storage system 5300 may include feet, anchors, or bases (not shown) that are configured to expand or contract to fit the width of the structure. For example, the feet may be widened to fit against the walls of the structure. As a result, the shelf storage system 5300 may be self-supporting. In other embodiments, the shelf storage system 5300 may be supported by brackets, nails, screws, pins, pegs, glue, rivets, or other similar attachment mechanisms. In one embodiment, the components of the shelf storage system 5300 may be expanded or contracted within a range to fit the subtle differences in structures and to provide a more universal product.

In one embodiment, a counterbalancing engine 5302 may be substantially configured as previously described. In one embodiment, a torsion rod 5304 passes between a master engine 5305 on one side and a slave engine 5307 on the other side. In other embodiments, cables, belts, or chains may be utilized to couple the lift engines. In another embodiment, both sides of the shelf storage system 5300 may include the counterbalancing engine 5302.

In one embodiment, the lift arms 5306 and 5308 are configured to lift a shelf 5312 up and then out and then down to clear the front edge of a cabinet 5310. For example, the shelf storage system 5300 may lower the shelf 5312 approximately one and a half feet. In other embodiments, the motion of the shelf 5312 may be out and down. The shelf 5312 may also be configured to slide horizontally before being lifted down in an arc. The lifting embodiments of the shelf storage system 5300 may utilize the same principles as are herein described for lifting out and up or up and out. In one embodiment, the cabinet 5310 (or other structure) may extend all or a portion of the way to the floor. Configurations of the shelf storage system 5300 may vary based on whether there are dividers within the cabinets or other structures that limit motion. For example, some dividers may require the shelf storage system have two different counterbalancing engines 5302 and shelves 5312 that function on either side of the divider. A single frame may be utilized to house multiple shelf storage systems 5300. In another embodiment, multiple shelf storage systems 5300 may be horizontally connected.

In one embodiment, the force engine 5302 includes gears 5314 and 5316 coupled to the lift arms 5306 and 5308 for driving the motion of the shelf 5312. The gears 5314 and 5316 are of different sizes to achieve a step up ratio. For example, the gears may allow for a smaller range of motion in the force engine 5302 to drive a larger range of motion in the lift arms 5306 and 5308. In one embodiment, the lift engine 5302 rotates approximately 70-80 degrees, but the lift arms 5306 and 5308 rotate approximately 120-140 degrees to balance the torque from the force engine 5302 to provide the drop or stroke needed for the shelf 5312.

In another embodiment, a four bar linkage may be used to link the force engine 5302 to the lift arms 5306 and 5308, where the arm linked to the force engine 5302 are longer than the arm linked to the lift arms 5306 and 5308. The shorter arm may pass a toggle point and allow for counterbalancing of the shelf/tray even as the tray passes over the equilibrium point as the tray is moved back into the stowed position.

The illustrative embodiment shows a four bar linkage used to lift the shelf 5312 that rotates past a toggle point without the risk of instability. A link 5318 is attached to the lift arms 5306 and 5308. The link 5318 from base point B to a shelf attachment point C is almost perpendicular to the base point B to an attachment point A of the link 5318 preventing instabilities.

In one embodiment, the shelf 5312 may include a handle, strap, or rod that extends from the shelf 5312 to begin the lowering process. In other embodiments, the user may grip the shelf 5312 to begin lowering it to a more accessible position. As previously described, the width of the shelf storage system 5300 may be expanded to fit a width of a structure. In particular, the shelf 5312 and the torsion rod 5304 may include nesting or overlapping structures or mechanisms, rails, or other components for being slidably extended or contracted.

The included description, illustrative embodiments, engines, lift systems, pulley systems, and components as well as those included in the priority applications may be combined in any number of combinations and configurations. The description of the present invention has been presented for purposes of illustration and description, and is not intended to be exhaustive or limited to the form disclosed. Many modifications and variations will be apparent to those of ordinary skill in the art. The embodiments were chosen and described in order to best explain the principles of the invention, the practical application, and to enable others of ordinary skill in the art to understand the invention for various embodiments with various modifications as are suited to the particular use contemplated.

What is claimed is:

1. A storage system for elevating a load, comprising one or more rails for attaching the storage system to a structure;

one or more arms attached to the one or more rails;

a non-electrical counterbalance mechanism attached to the one or more arms configured to provide an adjustable lifting force generally offsetting a load applied to the one or more arms, wherein the counterbalance mechanism changes the adjustable lifting force based on a change in the load acting on an arresting mechanism connecting two of the one or more arms together;

a traveling arm and an adjusting arm of the one or more arms, a pinned end and an adjustment end of the adjusting arm, and an adjusting mode wherein the traveling and adjusting arms are arrested together at an arresting point by the arresting mechanism, wherein the arresting point is located near a lifting end of the traveling arm;

a release for engaging the counterbalance mechanism to assist a user in repositioning the one or more arms; and a single connection comprised between the traveling arm and the load, and the single connection between the traveling arm and the load being the only connection between the load and all other components of the counterbalance mechanism;

wherein the traveling arm and the adjusting arm rotate in opposing directions to increase the lifting force exerted by the counterbalance mechanism at the lifting end;

wherein rotation of the traveling arm and the adjusting arm stops when the lifting torque exerted by the counterbalance mechanism equals the load.

2. The storage system of claim 1, wherein the structure is a wall of a building.

3. The storage system of claim 1, wherein the one or more arms are connected to a tray, and wherein the tray is repositioned out and down from a stowed position.

4. The storage system of claim 3, wherein the tray comprises:

one or more shelves, a back, sides, and end caps.

5. The storage system of claim 3, wherein the tray is enclosed by a safety net, a hard roll up cover, a soft roll up cover, bi-fold doors, shell doors, a case, or tray doors.

6. The storage system of claim 1, wherein the counterbalance mechanism has one or more adjustment positions configured in an adjustment mode to adjust to the load applied to the one or more arms.

7. The storage system of claim 1, wherein the release is a handle attached to the counterbalance mechanism by a cable to change between an assistance mode to provide the force and an adjustment mode for adjusting to the load.

8. The storage system of claim 1, wherein the one or more lift arms include one or more guards for protecting a user.

9. The storage system of claim 1, wherein the one or more rails comprise at least two rails.

10. The storage system of claim 1, wherein the adjustable lifting force is transferred through the single connection and wherein the counterbalance mechanism is reconfigured to the load by the adjustable lifting force communicated through the single connection.

11. The storage system of claim 1, wherein the one or more arms comprise one or more lift arms configured to provide the adjustable lifting force to assist lifting the load.

12. The storage system of claim 1, wherein the counterbalance mechanism comprises a mechanical force engine having a spring for driving motion of the one or more arms to assist lifting the load.

13. A method for assembling a storage system, comprising:

attaching rails to a wall;

securing lift arms to the rails;

attaching a counterbalance mechanism to the rails and dynamically attaching the counterbalance mechanism to the lift arms;

attaching a tray to the lift arms using a single connection, wherein the tray has a load;

attaching a release to an assistance mechanism;

arresting two of the lift arms at an arresting point of an arresting mechanism, wherein the arresting point is located near a lifting end of one of the two lift arms, wherein the lifting end lifts the tray;

rotating simultaneously both the two lift arms in opposing directions to increase a force exerted by the counterbalance mechanism at the lifting end;

stopping rotation of the two lift arms when the torque exerted by the counterbalance mechanism equals the load;

wherein the single connection is between the lifting end and the tray, and the single connection between the lifting end and the tray being the only connection between the tray and all other components of the counterbalance mechanism.

14. The method of claim 13 further comprising:

storing goods on the tray for a user.

15. The method of claim 13 further comprising:

assembling the tray including one or more shelves, a back, sides, and end caps.

16. The method of claim 13 further comprising:

enclosing the tray by any of a safety net, a hard roll up cover, a soft roll up cover, bi-fold doors, shell doors, a case, or tray doors.

17. The method of claim 13, wherein the counterbalance mechanism is a mechanical force engine including a spring for driving motion of the lift arms and the tray, wherein the release is a handle attached to the assistance mechanism to change between at least two modes.

18. A storage system, comprising:

a frame for attaching the storage system to a structure;

one or more lift arms attached to the frame and configured to raise and lower the one or more lift arms, the one or more lift arms are configured to support a load;

a counterbalance mechanism attached to the one or more lift arms, wherein the counterbalance mechanism is configured to adjust a lifting force applied to the one or more lift arms based upon a change in the load acting on an arresting mechanism connecting two of the one or more arms together;

a traveling arm and an adjusting arm of the one or more lift arms, a pinned end and an adjustment end of the adjusting arm, and an adjusting mode wherein the traveling and adjusting arms are arrested together at an arresting point by the arresting mechanism, wherein the arresting point is located near a lifting of the adjusting arm, wherein the traveling arm and the adjusting arm both simultaneously rotate during the adjusting mode to adjust the lifting force; and a release for engaging the counterbalance mechanism to assists a user in raising or lowering the one or more lift arms;

a single connection comprised between the traveling arm and the load, and the single connection between the traveling arm and the load being the only connection between the load and all other components of the counterbalance mechanism;

wherein the traveling arm and the adjusting arm rotate in opposing directions to increase the lifting force exerted by the counterbalance mechanism at the lifting end;

wherein rotation of the traveling arm and the adjusting arm stops when the lifting torque exerted by the counterbalance mechanism equals the load.

* * * * *